US008284128B2

(12) United States Patent
Kimura

(10) Patent No.: US 8,284,128 B2
(45) Date of Patent: Oct. 9, 2012

(54) SEMICONDUCTOR DEVICE

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 98 days.

(21) Appl. No.: 12/963,672

(22) Filed: Dec. 9, 2010

(65) Prior Publication Data

US 2011/0133828 A1 Jun. 9, 2011

Related U.S. Application Data

(62) Division of application No. 10/859,475, filed on Jun. 3, 2004, now Pat. No. 7,852,330.

(30) Foreign Application Priority Data

Jun. 6, 2003 (JP) ..... 2003-162749

(51) Int. Cl.
*G09G 3/30* (2006.01)

(52) U.S. Cl. ..... 345/76; 345/690; 315/169.3

(58) Field of Classification Search ..... 345/76–82, 345/204, 205, 206, 211, 690
See application file for complete search history.

(56) References Cited

U.S. PATENT DOCUMENTS 3,040,237 A 6/1962 Jones
3,231,812 A 1/1966 Brian
3,244,965 A 4/1966 Gutzwiller
4,742,292 A 5/1988 Hoffman
5,212,616 A 5/1993 Dhong et al.
5,404,053 A 4/1995 Poma et al.
5,585,749 A 12/1996 Pace et al.
5,614,848 A 3/1997 Kaminaga et al.
5,663,659 A 9/1997 Kaminaga et al.
5,666,035 A 9/1997 Basire et al.
5,744,984 A 4/1998 Drapac et al.
5,905,677 A 5/1999 Casagrande et al.

(Continued)

FOREIGN PATENT DOCUMENTS

CN 1389847 A 1/2003

(Continued)

OTHER PUBLICATIONS

International Search Report (Application No. PCT/JP2004/005001), Aug. 10, 2004, 3 pages.

(Continued)

*Primary Examiner* — Duc Dinh
(74) *Attorney, Agent, or Firm* — Fish & Richardson P.C.

(57) ABSTRACT

A semiconductor device is provided in which a transistor which supplies a current to a load (an EL pixel and a signal line) can supply an accurate current without being affected by a variation. A voltage of each terminal of a transistor is controlled by using a feedback circuit using an amplifier circuit. A current Idata is inputted from a current source circuit to a transistor and a gate-source voltage (a source potential) required for the transistor to flow the current Idata is set by using the feedback circuit. The feedback circuit is controlled to operate so that a drain potential of the transistor becomes a predetermined potential. Then, a gate voltage required to flow the current Idata is set. By using the set transistor, an accurate current can be supplied to the load (an EL element and a signal line). As a drain potential can be controlled, the kink effect can be reduced.

10 Claims, 66 Drawing Sheets

U.S. PATENT DOCUMENTS

| | | | | |
|---|---|---|---|---|
| 6,087,821 | A | 7/2000 | Kojima | |
| 6,127,997 | A * | 10/2000 | Tsuchi | 345/98 |
| 6,222,357 | B1 | 4/2001 | Sakuragi | |
| 6,229,506 | B1 | 5/2001 | Dawson et al. | |
| 6,285,177 | B1 | 9/2001 | Mallikarjunaswamy et al. | |
| 6,316,990 | B1 | 11/2001 | Tanizawa | |
| 6,373,454 | B1 | 4/2002 | Knapp et al. | |
| 6,437,550 | B2 | 8/2002 | Andoh et al. | |
| 6,556,475 | B2 | 4/2003 | Yamazaki et al. | |
| 6,567,327 | B2 | 5/2003 | Tsuchi | |
| 6,600,305 | B2 | 7/2003 | Andoh et al. | |
| 6,661,180 | B2 | 12/2003 | Koyama | |
| 6,686,797 | B1 | 2/2004 | Eker | |
| 6,693,388 | B2 | 2/2004 | Oomura | |
| 6,707,257 | B2 | 3/2004 | Norris | |
| 6,774,572 | B2 * | 8/2004 | Fukuzako | 315/169.1 |
| 6,784,865 | B2 * | 8/2004 | Akimoto et al. | 345/98 |
| 6,841,947 | B2 | 1/2005 | Berg | |
| 6,870,192 | B2 | 3/2005 | Yamazaki et al. | |
| 6,873,200 | B2 | 3/2005 | Evers et al. | |
| 6,927,618 | B2 * | 8/2005 | Kimura et al. | 327/427 |
| 6,949,963 | B2 | 9/2005 | De Haas et al. | |
| 6,975,290 | B2 * | 12/2005 | Asano | 345/76 |
| 7,002,547 | B2 | 2/2006 | Yamada | |
| 7,030,865 | B2 | 4/2006 | Ishiyama | |
| 7,170,094 | B2 | 1/2007 | Yamazaki et al. | |
| 7,215,307 | B2 | 5/2007 | Ochi et al. | |
| 7,327,170 | B2 * | 2/2008 | Omori et al. | 327/108 |
| 7,777,698 | B2 * | 8/2010 | Takahara et al. | 345/76 |
| 2001/0020844 | A1 | 9/2001 | Andoh et al. | |
| 2001/0032990 | A1 | 10/2001 | Koyama et al. | |
| 2002/0021606 | A1 | 2/2002 | Tsuchi | |
| 2002/0135312 | A1 | 9/2002 | Koyama | |
| 2002/0153844 | A1 | 10/2002 | Koyama | |
| 2002/0175664 | A1 | 11/2002 | Andoh et al. | |
| 2002/0180720 | A1 | 12/2002 | Ishiyama | |
| 2003/0020413 | A1 | 1/2003 | Oomura | |
| 2003/0128199 | A1 | 7/2003 | Kimura | |
| 2003/0128200 | A1 | 7/2003 | Yumoto | |
| 2003/0156102 | A1 | 8/2003 | Kimura | |
| 2003/0169250 | A1 | 9/2003 | Kimura | |
| 2003/0205993 | A1 | 11/2003 | Andoh et al. | |
| 2004/0085029 | A1 | 5/2004 | Kimura | |
| 2004/0085270 | A1 | 5/2004 | Kimura | |
| 2004/0100202 | A1 | 5/2004 | Koyama | |
| 2005/0057189 | A1 | 3/2005 | Kimura | |
| 2005/0162206 | A1 | 7/2005 | Kimura | |
| 2005/0168905 | A1 | 8/2005 | Kimura | |
| 2005/0259054 | A1 | 11/2005 | Wu | |
| 2006/0220581 | A1 | 10/2006 | Yamazaki et al. | |

FOREIGN PATENT DOCUMENTS

| | | | |
|---|---|---|---|
| CN | 1409402 | A | 4/2003 |
| EP | 0282725 | A1 | 9/1988 |
| EP | 1130565 | A1 | 9/2001 |
| EP | 1265217 | A2 | 12/2002 |
| EP | 1333422 | A1 | 8/2003 |
| EP | 1103946 | B1 | 5/2007 |
| JP | 63-229509 | A | 9/1988 |
| JP | 04246909 | A | 9/1992 |
| JP | 06085179 | A | 3/1994 |
| JP | 11-149783 | A | 6/1999 |
| JP | 2000-081920 | A | 3/2000 |
| JP | 2000-112548 | A | 4/2000 |
| JP | 2001-005426 | A | 1/2001 |
| JP | 2001-284464 | A | 10/2001 |
| JP | 2001319329 | A | 11/2001 |
| JP | 2001-343933 | A | 12/2001 |
| JP | 2002111462 | A | 4/2002 |
| JP | 2002-514320 | A | 5/2002 |
| JP | 2002-517806 | A | 6/2002 |
| JP | 2002-351357 | A | 12/2002 |
| JP | 2003-043993 | A | 2/2003 |
| JP | 2003-058106 | A | 2/2003 |
| JP | 2003-108069 | A | 4/2003 |
| JP | 2004030779 | A | 1/2004 |
| JP | 2004522344 | A | 7/2004 |
| WO | WO 98-48403 | A1 | 10/1998 |
| WO | WO 99-65011 | A2 | 12/1999 |
| WO | WO 01-06484 | A1 | 1/2001 |
| WO | WO 02-39420 | A1 | 5/2002 |
| WO | 2002073804 | A2 | 9/2002 |
| WO | WO 03-038793 | A1 | 5/2003 |
| WO | WO 03-038794 | A1 | 5/2003 |
| WO | WO 03-038795 | A1 | 5/2003 |
| WO | WO 03-038796 | B1 | 9/2003 |
| WO | WO 03-038797 | B1 | 9/2003 |

OTHER PUBLICATIONS

Written Opinion (Application No. PCT/JP2004/005001), Aug. 10, 2004, 5 pages with partial translation.

International Search Report (Application No. PCT/JP2004/005969), Aug. 31, 2004, 2 pages.

Written Opinion (Application No. PCT/JP2004/005969), Aug. 31, 2004, 5 pages with partial translation.

International Search Report (Application No. PCT/JP2004/007367), Aug. 31, 2004, 2 pages.

Written Opinion (Application No. PCT/JP2004/007367), Aug. 31, 2004, 4 pages with partial translation.

Chinese Office Action (Application No. 200480015745.X), dated Dec. 21, 2007.

Taiwanese Office Action (Application No. 93116032) dated Jul. 2, 2010, with English translation, 10 pages.

Search Report (EP Application No. 04726321.5) dated Dec. 19, 2007.

Search Report (EP Application No. 04731468.7) dated Jan. 2, 2008.

Analog Electronic Techniques, Oct. 1, 2000. pp. 300-317.

Office Action (Application No. 200480015745.X) dated Sep. 11, 2009 with English translation.

Japanese Office Action in corresponding Japanese Application No. 2007002483, mailed Apr. 12, 2011, 5 pages.

* cited by examiner

SEMICONDUCTOR DEVICE

CROSS-REFERENCE TO RELATED APPLICATIONS

This application is a divisional of U.S. application Ser. No. 10/859,475, filed Jun. 3, 2004, now U.S. Pat. No. 7,852,330, which claims the benefit of a foreign priority application filed in Japan as Serial No. 2003-162749 on Jun. 6, 2003, both of which are incorporated by reference.

TECHNICAL FIELD

The present invention relates to a semiconductor device provided with a function to control by a transistor a current to be supplied to a load. More particularly, the invention relates to a semiconductor device including a pixel formed of a current drive type light emitting element of which luminance changes according to current, and a signal line driver circuit which drives a pixel.

BACKGROUND ART

In a display device using a self-light emitting type light emitting element represented by an organic light emitting diode (also referred to as an OLED (Organic Light Emitting Diode), an organic EL element, an electroluminescence (EL) element and the like), a passive matrix method and an active matrix method are known as its driving method. The former has a simple structure, but has a problem such that a realization of a large and high definition display is difficult. Therefore, the active matrix method is actively developed in recent years in which a current flowing to the light emitting element is controlled by a thin film transistor (TFT) provided in a pixel circuit.

In the case of a display device of the active matrix method, there is a problem that a current flowing to a light emitting element varies due to a variation in current characteristics of driving TFTs, which varies a luminance. That is, a driving TFT which drives a current flowing to the light emitting element is used in a pixel circuit. When characteristics of these driving TFTs vary, a current flowing to the light emitting element varies, which varies a luminance. Then, various circuits to suppress a variation in luminance are suggested in which a current flowing to a light emitting element does not vary even when characteristics of driving TFTs in a pixel circuit vary. (For example, see Patent Documents 1 to 4)

[Patent Document 1]
Published Japanese Translation of PCT International Publication for Patent Application No. 2002-517806
[Patent Document 2]
International Publication WO01/06484
[Patent Document 3]
Published Japanese Translation of PCT International Publication for Patent Application No. 2002-514320
[Patent Document 4]
International Publication WO02/39420

Patent Documents 1 to 3 disclose a circuit configuration for preventing a variation of a current value flowing to a light emitting element due to a variation in characteristics of driving TFTs arranged in a pixel circuit. This configuration is referred to as a current write type pixel or a current input type pixel. Patent Document 4 discloses a circuit configuration for suppressing a variation of a signal current due to a variation of TFTs in a source driver circuit.

FIG. 6 shows a first configuration example of a conventional active matrix type display device disclosed in Patent Document 1. The pixel shown in FIG. 6 comprises a source signal line 601, first to third gate signal lines 602 to 604, a current supply line 605, TFTs 606 to 609, a capacitor 610, an EL element 611, and a current source 612 for inputting a signal current.

An operation from a write of a signal current to a light emission is described with reference to FIG. 7. Reference numerals denoting each portion in the drawing correspond to those in FIG. 6. FIGS. 7A to 7C each schematically shows a current flow. FIG. 7D shows a relationship of a current flowing each path when writing a signal current. FIG. 7E shows a voltage accumulated in the capacitor 610 when writing a signal current, that is a gate-source voltage of the TFT 608.

First, a pulse is inputted to the first gate signal line 602 and the second gate signal line 603 and the TFTs 606 and 607 are turned ON. At this time, a current flowing through the source signal line, that is a signal current is denoted as Idata.

As the current Idata flows through the source signal line, the current path is divided into I1 and I2 in the pixel as shown in FIG. 7A. These relationships are shown in FIG. 7D. It is needless to say that Idata=I1+I2 is satisfied.

A charge is not held in the capacitor 610 at the moment the TFT 606 is turned ON, therefore, the TFT 608 is OFF. Therefore, I2=0 and Idata=I1 are satisfied. In other words, current only flows into the capacitor 610 to be accumulated in the meantime.

After that, as the charge is gradually accumulated in the capacitor 610, a potential difference starts to generate between both electrodes (FIG. 7E). When the potential difference between the both electrodes reaches Vth (a point A in FIG. 7E), the TFT 608 is turned ON and I2 generates. As described above, as Idata=I1+I2 is satisfied, current still flows and a charge is accumulated in the capacitor while I1 decreases gradually.

The charge keeps being accumulated in the capacitor 610 until the potential difference between the both electrodes, that is a gate-source voltage of the TFT 608 reaches a desired voltage, that is a voltage (VGS) which can make the TFT 608 flow the current Idata. When the charge stops being accumulated (a point B in FIG. 7E), the current I1 stops flowing and the TFT 608 flows a current corresponding to VGS at that time, thus Idata=I2 is satisfied (FIG. 7B). Thus, a write operation of a signal is terminated. At last, selections of the first gate signal line 602 and the second gate signal line 603 are terminated to turn OFF the TFTs 606 and 607.

Subsequently, a light emitting operation starts. A pulse is inputted to the third gate signal line 604 to turn ON the TFT 609. As the capacitor 610 holds VGS which is written before, the TFT 608 is ON and the current Idata flows from the current supply line 605. Thus, the EL element 611 emits light. Provided that the TFT 608 is set to operate in a saturation region, Idata keeps flowing without change even when a source-drain voltage of the TFT 608 changes.

In this manner, an operation to output a set current is hereinafter referred to as an output operation. As a merit of the current write type pixel, a desired current can be accurately supplied to an EL element because a gate-source voltage required to flow the current Idata is held in the capacitor 610 even when the TFTs 608 have a variation in characteristics and the like. Therefore, a luminance variation due to the variation in characteristics of TFTs can be suppressed.

The aforementioned examples relate to a technology for correcting a change of current due to a variation of driving TFTs in a pixel circuit, however, the same problem occurs in a source driver circuit as well. Patent Document 4 discloses a circuit configuration for preventing a change of a signal current due to a variation of the TFTs in the source driver circuit generated in fabrication.

Further, there is a driver circuit of a light emitting element provided with a current supply circuit (1) and a drive control circuit (2*a*) which have configurations that are capable of leading a current (Is) having the same current value as a current (Ir) flowing from a supply transistor (M5) which supplies a current to drive a light emitting element (EL) to a drive control circuit (2*a*) through a reference transistor (M4), and of controlling so that the current (Is) approaches a desired set current value (Idrv) and each source-drain voltage data (Vs, Vr) become equal to each other based on the current (Is), the source-drain voltage data (Vs) of the reference transistor (M4) and source-drain voltage data (Vr, Vdrv) of the supply transistor (M5). (see Patent Document 5)

[Patent Document 5]

Published Japanese Translation of PCT International Publication for Patent Application No. 2003-108069 (p. 5 to 6, FIG. 6)

Further, there is a known technology configured with a light emitting element provided in series between a first power source and a second power source, a driving transistor which drives the light emitting element, a first switching transistor for leading a control signal for controlling the driving transistor to a gate of the driving transistor, a differential amplifier for comparing a voltage at a connection node of the light emitting element and the driving transistor and a control voltage which shows a luminance of a pixel, which is inputted to the display device, and configured so that the control signal is lead to the gate of the driving transistor through the first switching transistor. (see Patent Document 6)

[Patent Document 6]

Published Japanese Translation of PCT International Publication for Patent Application No. 2003-58106 (p. 3 to 4, FIG. 1)

In this manner, in a conventional technology, a signal current and a current for driving a TFT, or a signal current and a current which flows to a light emitting element when it emits light are configured to be equal or in proportion to each other.

DISCLOSURE OF THE INVENTION

However, a parasitic capacitance of a wiring used for supplying a signal current to a driving TFT and a light emitting element is quite large, therefore, a time constant for charging the parasitic capacitance of the wiring becomes large when the signal current is small, which makes a signal write speed slow. That is, the problem is that even when a signal current is supplied to a transistor, it takes a long time until a voltage required to flow the current is generated at a gate terminal, thus a write speed of a signal becomes slow.

Moreover, as shown in FIG. 7A, a gate terminal and a drain terminal of the transistor 608 are connected to each other when inputting a current. Therefore, a gate-source voltage (Vgs) and a drain-source voltage (Vds) are equal. As shown in FIG. 7C, on the other hand, a drain-source voltage is determined by characteristics of a load when supplying a current to the load.

FIG. 61 shows a relationship of a current flowing to the transistor 608 and the EL element 611 and a voltage applied to each of them. Moreover, FIG. 62 shows voltage-current characteristics 6201 of the EL element 611 and voltage-current characteristics of the transistor 608 in the configuration shown in FIG. 61. Intersections of each graph correspond to operating points.

First, in the case where a current value is large (the case where an absolute value of a gate-source voltage of the transistor 608 is large), it operates at an operating point 6204 as Vgs=Vds is satisfied when inputting a current with voltage-current characteristics 6202*a* of the transistor 608. Then, when supplying a current to the EL element 611, an intersection 6205*a* of the voltage-current characteristics 6201 of the EL element 611 and the voltage-current characteristics 6202*a* of the transistor 608 is an operating point. That is, a drain-source voltage differs between when inputting a current and when supplying a current to the EL element 611. However, a current value is constant in a saturation region, therefore, a proper amount of current can be supplied to the EL element 611.

However, an actual transistor cannot flow a current of constant value in many cases due to a kink (Early) effect. Therefore, when supplying a current to the EL element 611, an intersection 6205*c* of the voltage-current characteristics 6201 of the EL element 611 and voltage-current characteristics 6202*c* of the transistor 608 is an operating point, which changes a current value.

On the other hand, in the case where a current value is small (the case where an absolute value of a gate-source voltage of the transistor 608 is small), it operates at an operating point 6206 as Vgs=Vds is satisfied when inputting a current with voltage-current characteristics 6203*a* of the transistor 608. Then, when supplying a current to the EL element 611, an intersection 6207*a* of the voltage-current characteristics 6201 of the EL element 611 and the voltage-current characteristics 6203*a* of the transistor 608 is an operating point.

In consideration with the kink (Early) effect, an intersection 6207*c* of the voltage-current characteristics 6201 of the EL element 611 and the voltage-current characteristics 6203*c* of the transistor 608 is an operating point when supplying a current to the EL element 611. Therefore, a current value when supplying a current to the EL element 611 differs from the one when inputting a current.

In the case where a current value is large (the case where an absolute value of a gate-source voltage of the transistor 608 is large) and the case where a current value is small (the case where an absolute value of a gate-source voltage of the transistor 608 is small) are compared, the operating point 6204 and the operating point 6205*c* do not deviate much in the former case. That is, a drain-source voltage of a transistor does not deviate much between when inputting a current and when supplying a current to the EL element 611. In the case where a current value is small, however, the operating point 6206 and the operating point 6207*c* deviate largely. That is, a drain-source voltage of a transistor deviates largely between when inputting a current and when supplying a current to the EL element 611. Therefore, a current value deviates largely as well.

As a result, more current flows to the EL element 611. Therefore, in the case where an image with low luminance is to be displayed, a brighter image is actually displayed. Therefore, there is a case where a little light emission occurs when black is to be displayed. As a result, a contrast is reduced.

In the case of the configuration shown in FIG. 6, the gate and drain of the transistor 608 are connected when inputting a signal current. That is, Vgs=Vds is satisfied. A normal transistor does not flow a current almost at all in the case where Vgs=0. However, a current flows depending on a value of a threshold voltage (Vth). For example, current flows when Vth>0 in the case of a P-channel type transistor, and when Vth<0 in the case of an N-channel type transistor. In such cases, a transistor operates in a linear region, not in a saturation region when Vgs=Vds is satisfied. Therefore, a transistor operates in a linear region in FIG. 7A. Therefore, provided that a transistor operates in a saturation region in FIG. 7C, a current value changes between FIG. 7A and FIG. 7C.

That is, in the case where Vgs=0 is satisfied, a transistor of which threshold voltage (Vth) allows a current to flow, it operates only in a linear region when Vgs=Vds is satisfied, thus it cannot operate in a saturation region.

For example, in the configurations shown in FIG. 6 and FIG. 7, the transistor 608 operates in a saturation region. Therefore, as shown in FIG. 63, an operating point only changes from the operating point 6205*a* to an operating point 6205*b* when the voltage-current characteristics 6201*a* of the EL element 611 shifts due to deterioration. That is, even when a voltage applied to the EL element 611 or a drain-source voltage of the transistor 608 changes, a current supplied to the EL element 611 does not change. Accordingly, a screen burn of the EL element 611 can be decreased.

In the case of Patent Document 6 (a configuration shown in FIG. 1 described therein), a voltage of a connection node of an EL element and a driving transistor and a control voltage which shows a luminance of a pixel which is inputted to the display device are compared. Therefore, when voltage-current characteristics of the EL element shift, a current flowing to the EL element 611 changes. That is, a screen burn of the EL element 611 occurs.

In the case of Patent Document 5 (a configuration shown in FIG. 6 described therein), a transistor M7 and a transistor M9 are required to be equal in current characteristics. In the case where the current characteristics vary, a current supplied to the light emitting element (EL) varies too. Similarly, a transistor M8 and a transistor M11, and a transistor M10 and a transistor M12 are required to be equal in current characteristics. Thus, current characteristics are required to be equal in many transistors. In the case the current characteristics are not equal, a current supplied to the EL element varies. Therefore, problems occur such that a manufacturing yield is decreased, a cost is increased, a layout area of a circuit is increased, and power consumption is increased.

The invention is made in view of the aforementioned problems and it is an object of the invention to provide a semiconductor device which is capable of decreasing an effect of a variation in characteristics of transistors, supplying a predetermined current even when voltage-current characteristics of a load changes, and improving a write speed of a signal sufficiently even when a signal current is small.

The invention controls a potential applied to a transistor which supplies a current to a load by using an amplifier circuit, and achieves the aforementioned object by stabilizing a potential applied to a gate of a transistor by forming a feedback circuit.

The invention is a semiconductor device provided with a circuit for controlling by a transistor a current to be supplied to a load, a source or a drain of the transistor is connected to a current source circuit, and is characterized in that an amplifier circuit is provided which is for controlling a gate-source voltage and a drain-source voltage of the transistor when a current is supplied from the current source circuit to the transistor.

The invention is a semiconductor device provided with a circuit for controlling by a transistor a current to be supplied to a load, a source or a drain of the transistor is connected to a current source circuit and is characterized in that, and an amplifier circuit for stabilizing a gate potential of the transistor is provided so that a drain potential or a source potential of the transistor becomes a predetermined potential.

The invention is a semiconductor device provided with a circuit for controlling by a transistor a current to be supplied to a load, a source or a drain of the transistor is connected to a current source circuit, and is characterized in that a feedback circuit which stabilizes a gate potential of the transistor is provided so that a drain potential or a source potential of the transistor becomes a predetermined potential.

The invention is a semiconductor device provided with a transistor for controlling a current to be supplied to a load and an operational amplifier, a non-inverting input terminal of the operational amplifier is connected to a drain terminal side of the transistor connected to a current source circuit, and is characterized in that an output terminal of the operational amplifier is connected to the gate terminal.

A transistor applicable to the invention may be a thin film transistor (TFT) using a non-single crystalline semiconductor film represented by amorphous silicon or polycrystalline silicon, a MOS type transistor formed by using a semiconductor substrate or an SOI substrate, a junction type transistor, a bipolar transistor, a transistor using an organic semiconductor, a carbon nanotube, or the like. Furthermore, a substrate on which a transistor is mounted is not exclusively limited to a certain type. It may be a single crystalline substrate, an SOI substrate, a glass substrate, and the like.

In the invention, a connection means an electrical connection. Therefore, in the configurations disclosed in the invention, another element which makes an electrical connection (for example, another element, a switch and the like) may be disposed therebetween additionally to the predetermined connections.

According to the invention, a feedback circuit is formed by using an amplifier circuit, thereby a transistor is controlled. Thus, the transistor can output a constant current without being affected by a variation. In the case of setting in this manner, a set operation can be performed rapidly since an amplifier circuit is used. Therefore, an accurate current can be outputted in an output operation. Further, in the case of setting a current, Vds of a transistor can be controlled, therefore, it can be prevented that a current flows too much and a normal operation can be performed even with a transistor which flows a current when Vgs=0 is satisfied.

DESCRIPTION OF NUMERALS

Figure 1:
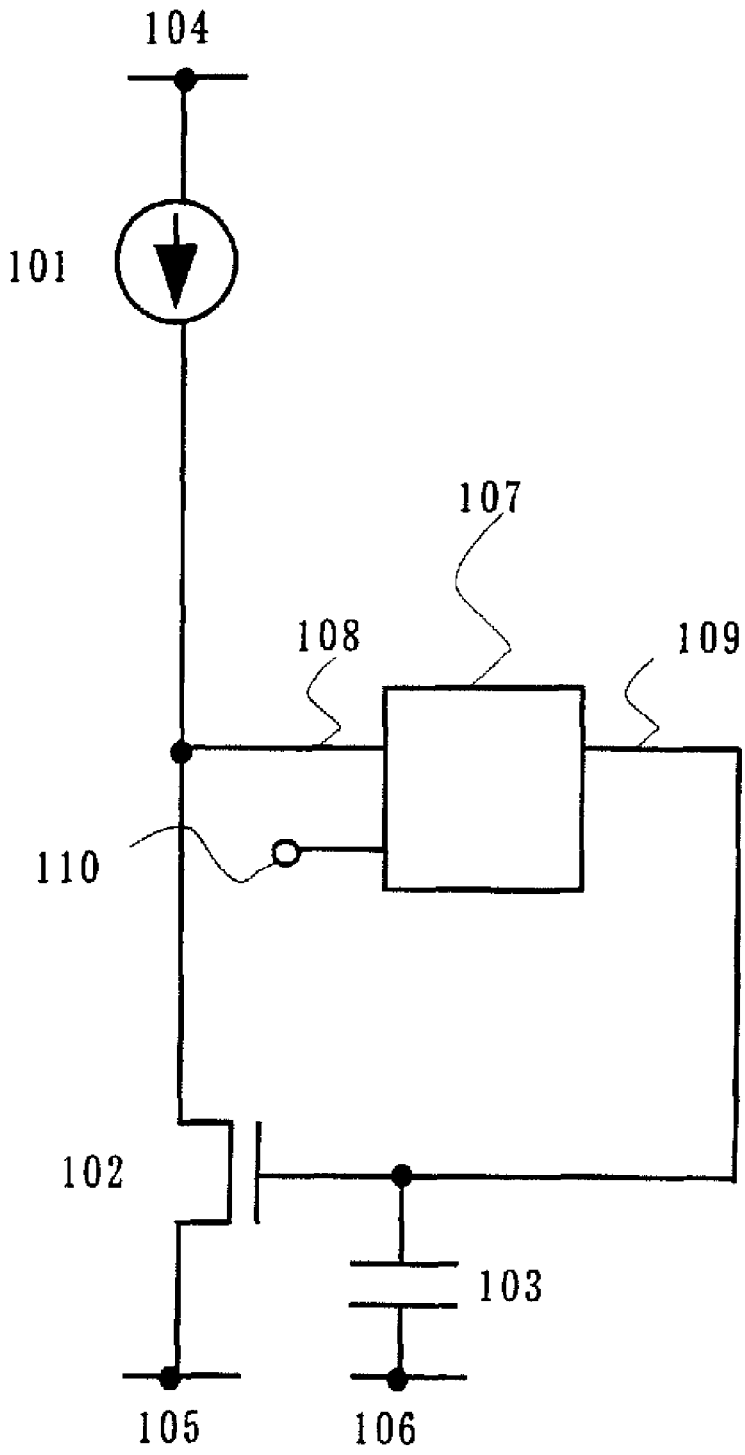
FIG. 1 is a diagram showing a configuration of a semiconductor device of the invention.

101, 201 current source circuit
102, 102*a*, 102*b*, 202, 302 current source transistor
103, 203, 610 capacitor
103*a*, 103*b*, 203*a* capacitor
104, 105, 106, 204, 205, 206, 905, 905*a*, 905*b*, 1605, 1805, 2005 wiring
107, 207 amplifier circuit
108, 208 first input terminal
109, 209 output terminal
110, 210 second input terminal
407, 507 operational amplifier
601 source signal line
602 first gate signal line
603 second gate signal line
604 third gate signal line
605 current supply line
606, 607, 608, 609 TFT
611 EL element
612 current source for inputting a signal current
901, 901*a*, 901*b*, 901*aa*, 901*bb*, 901*ca*, 901*da* load

902, 902*a*, 902*b*, 903, 903*a*, 903*b*, 904, 904*a*, 904*b*, 1801, 1901, 2002, 2003, 2501*aa*, 2501*ab*, 2501*ba*, 2501*bb*, 2502*aa*, 2502*ab*, 2502*ba*, 2502*bb*, 2601*ca*, 2601*cb*, 2601*da*, 2601*db*, 2602*ca*, 2602*cb*, 2602*da*, 2602*db*, 2603*ca*, 2603*cb*, 2603*da*, 2603*db*, 2904 switch
1602, 4402 current transistor
1702 multi transistor
1802 parallel transistor
1902 series transistor
2101 circuit
2401, 2401*a*, 2401*b* resource circuit
2402, 2402*a*, 2402*b* current line
2403, 2403*a*, 2403*b* voltage line
2404*a*, 2404*b*, 2404*aa*, 2404*ab*, 2404*ba*, 2404*bb*, 2404*ca*, 2404*cb*, 2404*da*, 2404*db* unit circuit
2604*c*, 2604*d*, 2907, 2908, 2909, 3304, 3305, 3504, 3505, 4205, 4705, 4706 wiring
2901, 3301, 3501 current source circuit
2902, 3601, 4204, 4304, 4403, 4404, 4704, 5403*a*, 5403*b*, 5403*c* switch
2903, 4703 capacitor
2905 signal line
2906 select gate line
3302, 3402, 3502, 5201, 5401*a*, 5401*b*, 5401*c* transistor
3303, 3403, 3503, 5202 gate terminal
3310, 3410, 3510, 5402*a*, 5402*b*, 5402*c* terminal
4007 amplifier circuit
5501 pixel arrangement
5502 gate line driver circuit
5503 shift register
5504 LAT1
5505 LAT2
5506 digital-analog converter circuit
5508 video signal line
5509 latch control line
5510 signal line driver circuit
5514 reference current source circuit
5701 pixel arrangement
5705 LAT2
5706 digital-analog converter circuit
5714 reference current source circuit
6201, 6201*a*, 6201*b*, 6202*a*, 6202*c*, 6203*a*, 6203*c* voltage-current characteristics
6204 operating point
6205*a* intersection
6205*b* operating point
6205*c* intersection
6206 operating point
6207*a*, 6207*b*, 6207*c* intersection
6401 current source circuit
6403 switch
6405 wiring
13001 housing
13002 support base
13003 display portion
13004 speaker portion
13005 video input terminal
13101 main body
13102 display portion
13103 image receiving portion
13104 operating key
13105 external connecting port
13106 shutter
13201 main body
13202 housing
13203 display portion
13204 keyboard
13205 external connecting port
13206 pointing mouse
13301 main body
13302 display portion
13303 switch
13304 operating key
13305 infrared port
13401 main body
13402 housing
13403 display portion A
13404 display portion B
13405 recording medium reading portion
13406 operating key
13407 speaker portion
13501 main body
13502 display portion
13503 arm portion
13601 main body
13602 display portion
13603 housing
13604 external connecting port
13605 remote control receiving portion
13606 image receiving portion
13607 battery
13608 audio input portion
13609 operating key
13701 main boy
13702 housing
13703 display portion
13704 audio input portion
13705 audio output portion
13706 operating key
13707 external connecting port
13708 antenna

BEST MODE FOR CARRYING OUT THE INVENTION

Although the present invention will be fully described by way of embodiment modes with reference to the accompanying drawings, it is to be understood that various changes and modifications will be apparent to those skilled in the art. Therefore, unless such changes and modifications depart from the scope of the present invention, they should be constructed as being included therein.

Embodiment Mode 1

According to the invention, a pixel is formed by an element which is capable of controlling a luminance according to a current value supplied to a light emitting element. Typically, an EL element can be applied. There are various structures of an EL element, however, any element structure can be applied to the invention as long as it can control a luminance according to the current value. That is, an EL element is formed by freely combining a light emitting layer, a charge transporting layer, or a charge injection layer. A low molecular weight organic material, a medium molecular weight organic material (that does not have subliming property and that has 20 or less of molecules, or a length of chained molecules of 10 μm or less) and a high molecular weight organic material may be used as materials for forming the EL element. Further, materials those an inorganic material is mixed or dispersed with these materials may be used.

Moreover, the invention can be applied not only to a pixel having a light emitting element such as an EL element, but also to various analog circuits having a current source. In this embodiment mode, a principle of the invention is described.

First, a configuration based on the basic principle of the invention is shown in FIG. 1. A current source circuit 101 and a current source transistor 102 are connected between a wiring 104 and a wiring 105. FIG. 1 shows the case where a current flows from the current source circuit 101 to the current source transistor 102. A first input terminal 108 of an amplifier circuit 107 is connected to a drain terminal of the current source transistor 102. Further, a second input terminal 110 of the amplifier circuit 107 is connected to a predetermined wiring. An output terminal 109 of the amplifier circuit 107 is connected to a gate terminal of the current source transistor 102.

A capacitor 103 is connected to the gate terminal of the current source transistor 102 and a wiring 106 in order to hold a gate voltage of the current source transistor 102. Note that the capacitor 103 can be omitted when substituted by a gate capacitance of the current source transistor 102 and the like.

In such a configuration, a current Idata is supplied and inputted from the current source circuit 101. The current Idata flows to the current source transistor 102. The amplifier circuit 107 controls the current Idata supplied from the current source 101 so that it flows to the current source transistor 102 and that a potential difference between the first input terminal 108 and the second input terminal 110 of the amplifier circuit 107 becomes a predetermined level. Then, the gate potential of the current source transistor 102 is controlled to be a level required for the current source transistor 102 to flow the current Idata when a potential of the first input terminal 108 of the amplifier circuit 107, that is a drain potential of the current source transistor 102 is a predetermined potential. At this time, the gate potential of the current source transistor 102 becomes an appropriate level independently of current characteristics (mobility, threshold voltage and the like) and a size (gate width W and gate length L) of the current source transistor 102. Therefore, the current source transistor 102 can flow the current Idata even when the current characteristics and the size of the current source transistor 102 vary. As a result, the current source transistor 102 can operate as a current source and becomes capable of supplying a current to various loads (another current source transistor, a pixel, a signal line driver circuit and the like).

Note that an operating region of a transistor (here, it is assumed to be an NMOS type transistor for simplicity) generally can be divided into a linear region and a saturation region. The border is when (Vgs−Vth)=Vds is satisfied with a drain-source voltage assumed to be Vds, a gate-source voltage assumed to be Vgs, and a threshold voltage assumed to be Vth. In the case where (Vgs−Vth)>Vds is satisfied, a transistor operates in a linear region and a current value is dependent on levels of Vds and Vgs. In the case where (Vgs−Vth)<Vds is satisfied, a transistor operates in a saturation region and it is ideal that a current value hardly changes even when Vds changes. That is, a current value is determined only by the level of Vgs.

Therefore, a region where the current source transistor 102 operates is determined by a drain-source voltage (Vds), a gate-source voltage (Vgs), and a threshold voltage (Vth) of the current source transistor 102. That is, in the case where Vgs−Vth<Vds is satisfied, the current source transistor 102 operates in a saturation region. In the saturation region, a current value does not change even when Vds changes in an ideal case. Therefore, in the case of supplying the current Idata to the current source transistor 102, namely the case of performing a set operation, and in the case of supplying a current from the current source transistor 102 to a load, namely the case of performing an output operation, a current value does not change even when Vds changes.

However, a current changes even in a saturation region due to the kink (Early) effect. In that case, the drain potential of the current source transistor 102 can be controlled by controlling a potential of the second input terminal 110 of the amplifier circuit 107, therefore, the kink (Early) effect can be reduced.

For example, Vds can be approximately equal between the case of performing the set operation and the case of performing the output operation by controlling the potential of the second input terminal 110 of the amplifier circuit 107 appropriately according to the size of the current Idata.

Further, in the case where the size of the current Idata when performing the set operation is small, by controlling the potential of the second input terminal 110 of the amplifier circuit 107 appropriately so that Vds when performing the set operation becomes higher than Vds when performing the output operation, it can be prevented that a current flows too much or a contrast is reduced.

Further, when performing the set operation by supplying the current Idata to the current source transistor 102 and the current source transistor 102 operates in a linear region, an appropriate current can be supplied to a load by making Vds approximately equal to that when supplying a current from the current source transistor 102 to a load. It is to be noted that the potential of the second input terminal 110 of the amplifier circuit 107 is to be controlled in order to make Vds approximately equal.

Further, when performing the set operation, a transistor which flows a current when Vgs=0 is satisfied can operate in a saturation region as Vds can be controlled. Therefore, a normal operation can be obtained also in this case.

In the case even where voltage-current characteristics of a load change due to a deterioration and the like, an appropriate size of current can be supplied by controlling Vds when performing the set operation to be approximately equal to Vds when performing the output operation by controlling the potential of the second input terminal 110 of the amplifier circuit 107 appropriately. Thus, a screen burn can be prevented in the case where the load is an EL element and the like.

In this manner, by operating in a linear region, Vds can be small. As a result, a voltage becomes small and power consumption can be reduced.

Moreover, the amplifier circuit 107 does not have a high output impedance. Therefore, it can output a large current. Thus, it can charge the gate terminal of the current source transistor 102 rapidly. That is, a write speed of the current Idata is increased, which can complete writing rapidly and requires only a short time until a steady state is obtained.

The amplifier circuit 107 has a function to detect a voltage of the first input terminal 108 and the second input terminal 110, amplify their input voltages, and output to an output terminal 109. In FIG. 1, the first input terminal 108 and the drain terminal of the current source transistor 102 are connected, and the output terminal 109 and the gate terminal of the current source transistor 102 are connected. When the gate terminal of the current source transistor 102 changes, the drain terminal of the current source transistor 102 changes. When the drain terminal of the current source transistor 102 changes, the first input terminal 108 of the amplifier circuit 107 changes, which changes the output terminal 109 of the amplifier circuit 107. When the output terminal 109 of the amplifier circuit 107 changes, the gate terminal of the current source transistor 102 changes. That is, a feedback circuit is formed. Therefore, a voltage which stabilizes the state of each terminal is outputted through the aforementioned feedback operation.

In FIG. 1, the drain terminal of the current source transistor 102 is connected to the first input terminal 108, the gate terminal of the current source transistor 102 is connected to the output terminal 109, and the second input terminal 110 of the amplifier circuit 107 is connected to a predetermined wiring. Therefore, a voltage which stabilizes voltages of the drain terminal of the current source transistor 102 and the second input terminal 110 of the amplifier circuit 107 is outputted to the gate terminal of the current source transistor 102 by the amplifier circuit 107. At this time, the current Idata is supplied from the current source circuit 101 to the current source transistor 102. Therefore, a voltage required for the current source transistor 102 to flow the current Idata is outputted from the current source circuit 101 to the gate terminal of the current source transistor 102.

As described above, by using a feedback circuit having the amplifier circuit 107, a gate potential can be set so that the current source transistor 102 flows the same size of current as a current supplied from the current source circuit 101. At this time, as the amplifier circuit 107 is used, a set can be completed rapidly, thus a write can be terminated for a short period of time. Then, the current source transistor 102 which is set can operate as a current source circuit and supply a current to various loads.

Figure 2:
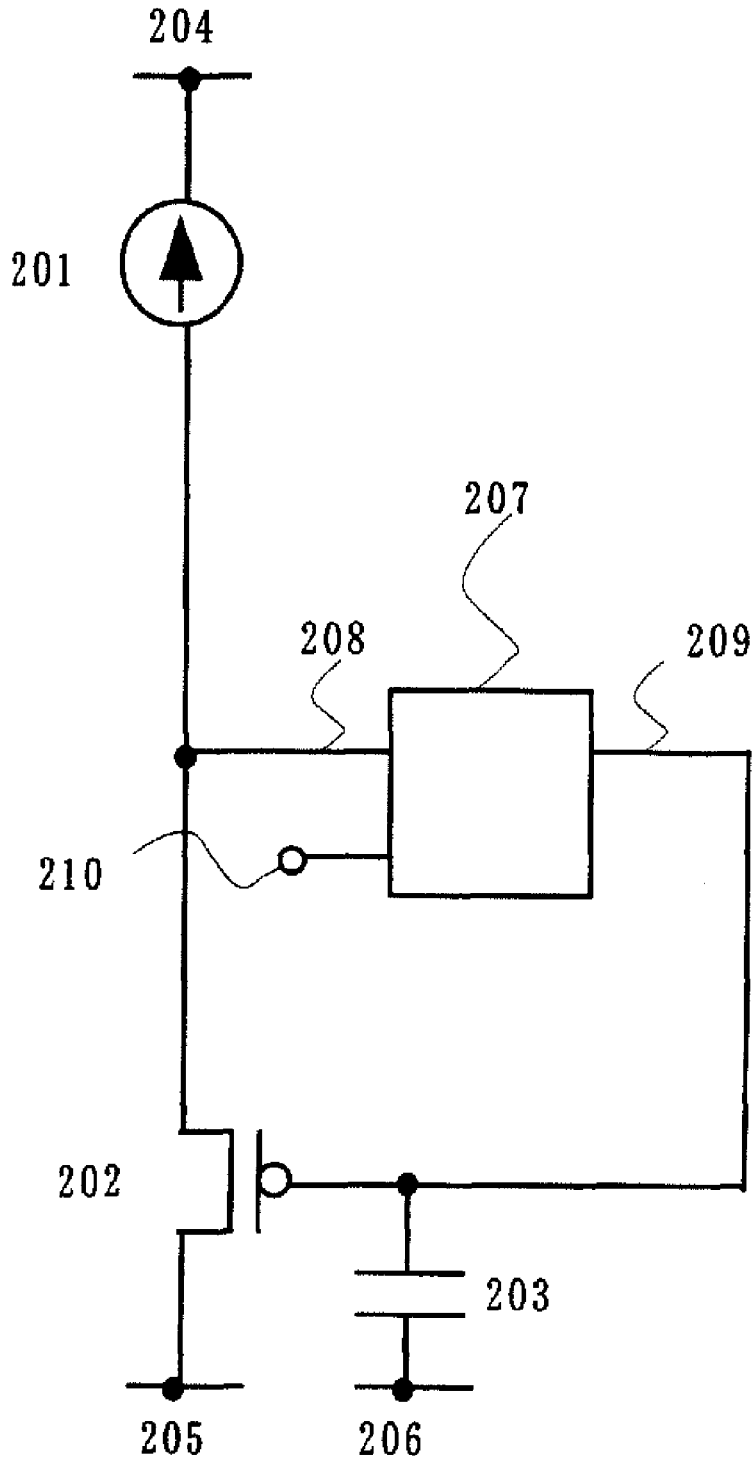
FIG. 2 is a diagram showing a configuration of a semiconductor device of the invention.

Note that FIG. 1 shows the case where a current flows from the current source circuit 101 to the current source transistor 102, however, the invention is not limited to this. FIG. 2 shows the case where a current flows from a current source transistor 202 to a current source circuit 201. In this manner, by changing the polarity of the current source transistor 202, a direction of current flow can be changed without changing connections of a circuit.

Figure 3:
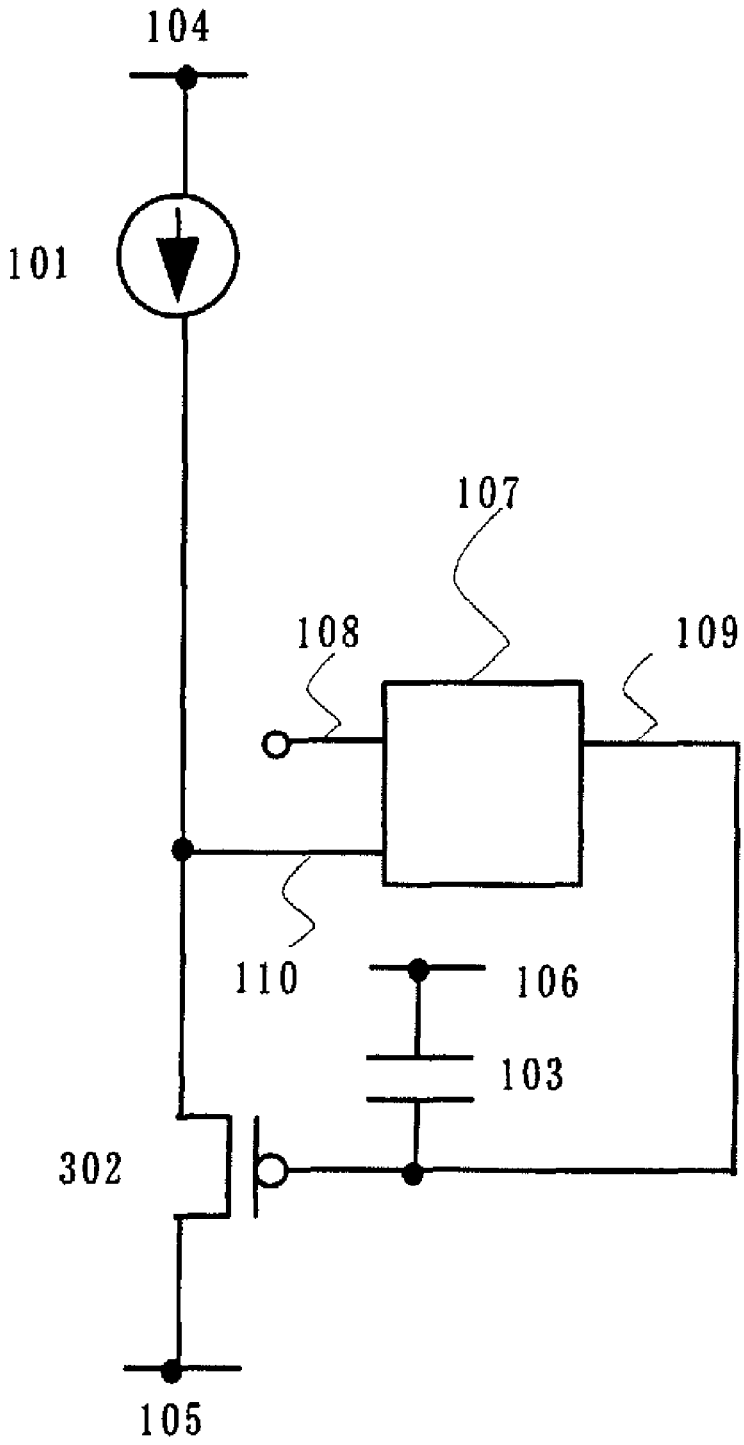
FIG. 3 is a diagram showing a configuration of a semiconductor device of the invention.

Note that an N-channel type transistor is used as the current source circuit 101 in FIG. 1, however, the invention is not limited to this and a P-channel type transistor may be used as well. However, when polarity of a transistor is changed without changing a direction of current flow, a source terminal and a drain terminal are switched. Therefore, connections of a circuit are required to be changed. FIG. 3 shows a configuration in that case. The current source circuit 101 and a current source transistor 302 are connected between the wiring 104 and the wiring 105. FIG. 3 shows the case where a current flows from the current source circuit 101 to the current source transistor 302, however, a direction of current can be changed similarly to the case of FIG. 2. The second input terminal 110 of the amplifier circuit 107 is connected to a source terminal of the current source transistor 302. Also, the first input terminal 108 of the amplifier circuit 107 is connected to a predetermined wiring. The output terminal 109 of the amplifier circuit 107 is connected to a gate terminal of the current source transistor 302.

Therefore, a voltage which stabilizes voltages of the source terminal of the current source transistor 302 and the first input terminal 108 is outputted to the gate terminal of the current source transistor 302 by the amplifier circuit 107. At this time, a current Idata is supplied from the current source circuit 101 to the current source transistor 302. Therefore, a voltage required for the current source transistor 302 to flow the current Idata is outputted from the current source circuit 101 to the gate terminal of the current source transistor 302.

Note that in FIG. 1, the second input terminal 110 of the amplifier circuit 107 is connected to a predetermined wiring while the first input terminal 108 of the amplifier circuit 107 is connected to a predetermined wiring in FIG. 3, however, the invention is not limited to this. It is only required to be connected so that an operation of a feedback circuit is obtained. It is required to be considered that a positive voltage is outputted at the output terminal 109 when a potential of the first input terminal 108 is higher, or that of the second input terminal 110 is higher. Further, it is required to be considered that a drain potential or a source potential rises or falls when the gate potential of the current source transistor rises. That is, a circuit is required to be connected so as to receive a negative feedback and to have a stabilized state as a feedback circuit. With a positive feedback received, a potential of the output terminal 109 oscillates or changes close to a positive or negative power source potential, thus a normal operation cannot be obtained. A circuit may be configured in consideration of the aforementioned.

Note that in FIG. 1, the capacitor 103 is only required to hold a gate potential of the current source transistor 102, therefore, a potential of the wiring 106 may be arbitrary. Therefore, potentials of the wiring 105 and the wiring 106 may be either the same or different. However, a current value of the current source transistor 102 is determined by its gate-source voltage. Therefore, it is more preferable that the capacitor 103 holds a gate-source voltage of the current source transistor 102. Therefore, it is preferable that the wiring 106 is connected to the source terminal (the wiring 105) of the current source transistor 102. As a result, a gate-source voltage can be held even when a current of the source terminal changes. Thus, an effect of a wiring resistance and the like can be reduced.

Similarly, in FIG. 2, is it preferable that a wiring 206 is connected to the source terminal (a wiring 205) of the current source transistor 202. Further, in FIG. 3, it is preferable that a wiring 306 is connected to a source terminal of the current source transistor 302.

Note that a load 901 may be an element such as a resistor, a transistor, an EL element, other light emitting elements, a current source circuit configured with a transistor, a capacitor, a switch and the like, a wiring connected to an arbitrary circuit, a signal line, or a signal line and a pixel connected to it. The pixel may include an element used in an EL element and an FED, or an element which is driven by a current flowing therethrough.

Embodiment Mode 2

In Embodiment Mode 2, an example of an amplifier circuit used in FIGS. 1 to 3 is described.

Figure 4:
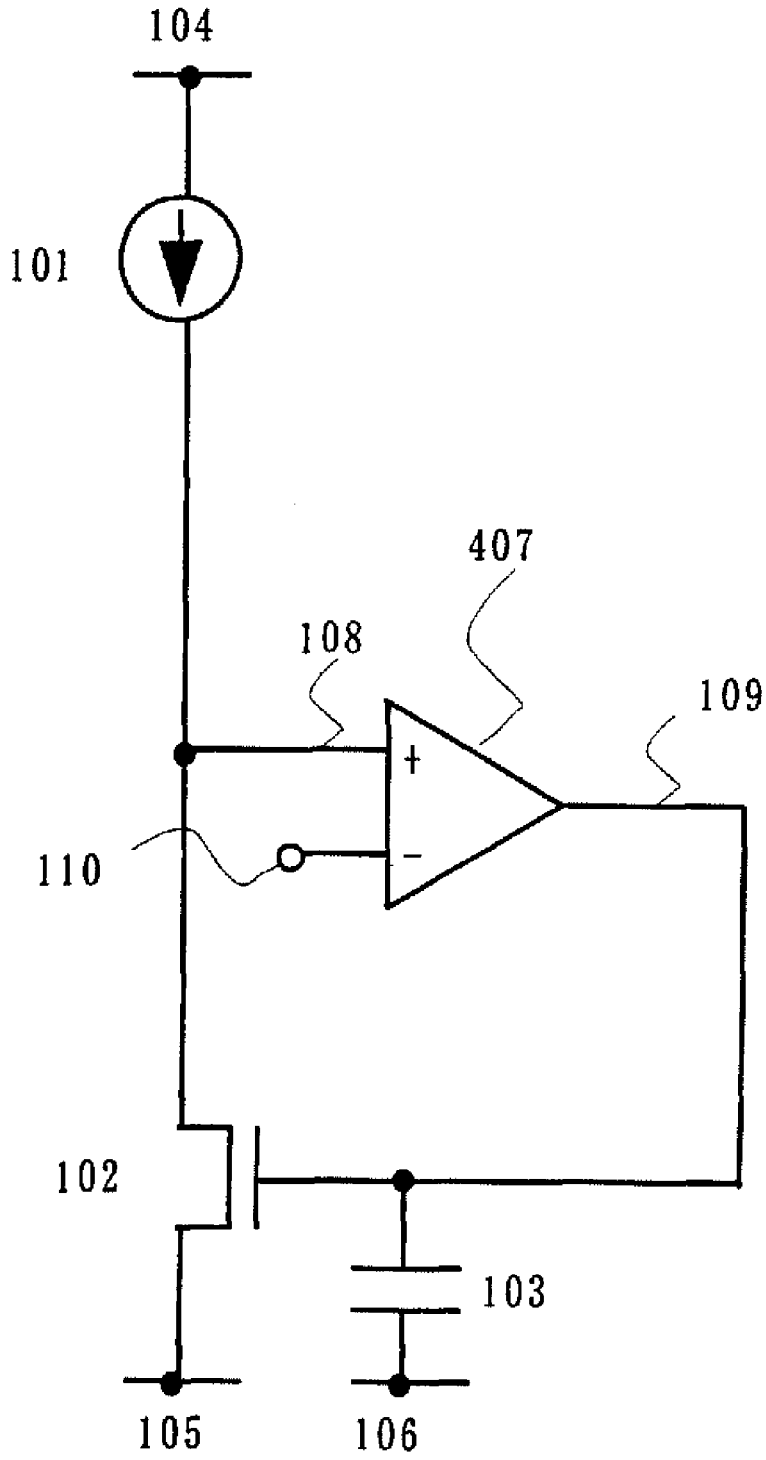
FIG. 4 is a diagram showing a configuration of a semiconductor device of the invention.

First, an operational amplifier is taken as an example of an amplifier circuit. FIG. 4 shows a configuration diagram corresponding to FIG. 1 as the case of using an operational amplifier as an amplifier circuit. The first input terminal 108 of the amplifier circuit 107 corresponds to a non-inverting (positive) input terminal while the second input terminal 110 corresponds to an inverting input terminal of the operational amplifier 407.

An operational amplifier normally operates so that a potential of a non-inverting (positive) input terminal and a potential of an inverting input terminal become equal to each other. Therefore, in the case of FIG. 4, the gate potential of the current source transistor 102 is controlled so that a drain potential of the current source transistor 102 and a potential of the inverting input terminal become equal to each other. Therefore, in the case where $(Vgs-Vth)<Vds$ is satisfied according to the potential of the inverting input terminal, the current source transistor 102 operates in a saturation region, while in the case where $(Vgs-Vth)>Vds$ is satisfied, the current source transistor 102 operates in a linear region. Further, by controlling the potential of the inverting input terminal, Vds of the current source transistor 102 can be controlled.

That is, when performing the set operation, a transistor which flows a current when Vgs=0 is satisfied can operate in a saturation region as Vds can be controlled.

Figure 5:
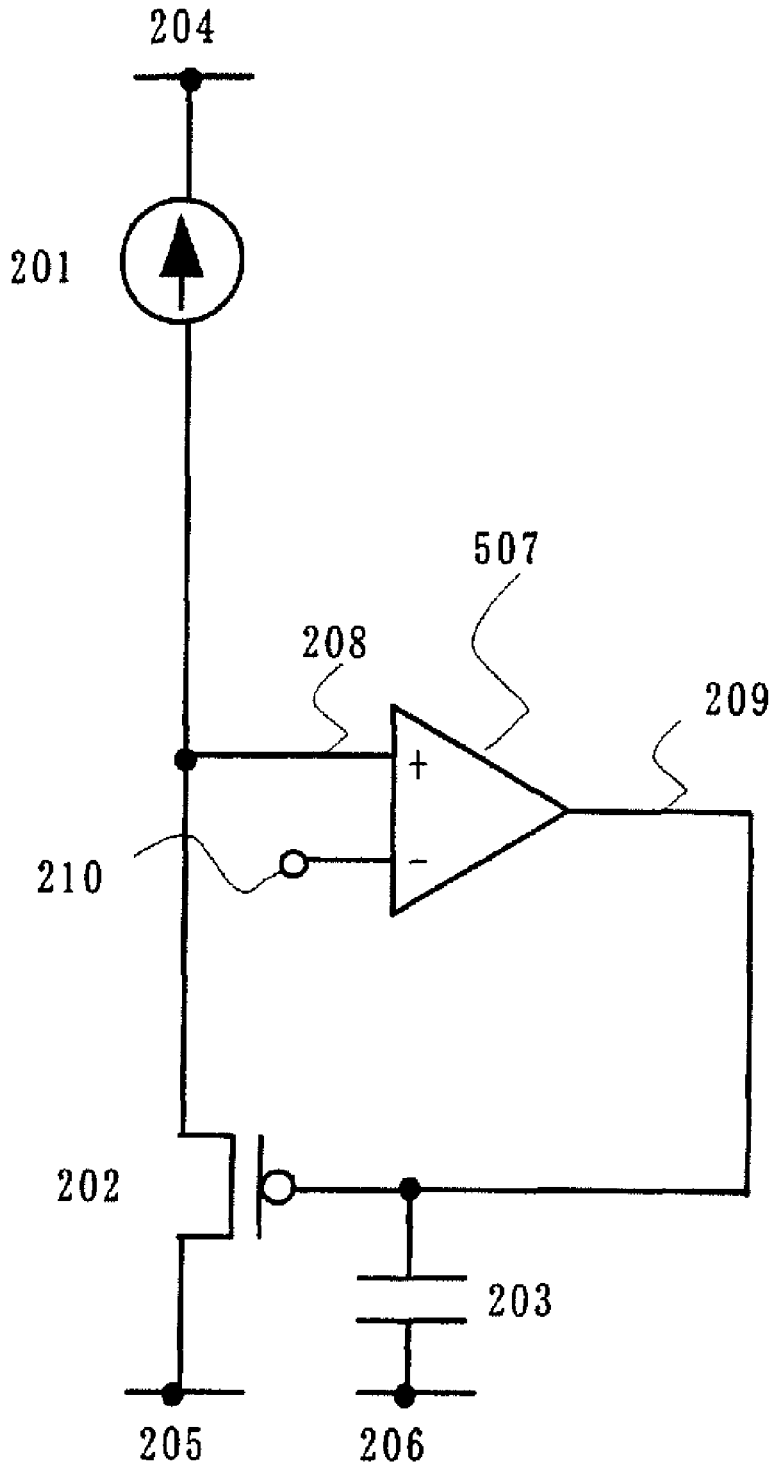
FIG. 5 is a diagram showing a configuration of a semiconductor device of the invention.
Figure 6:
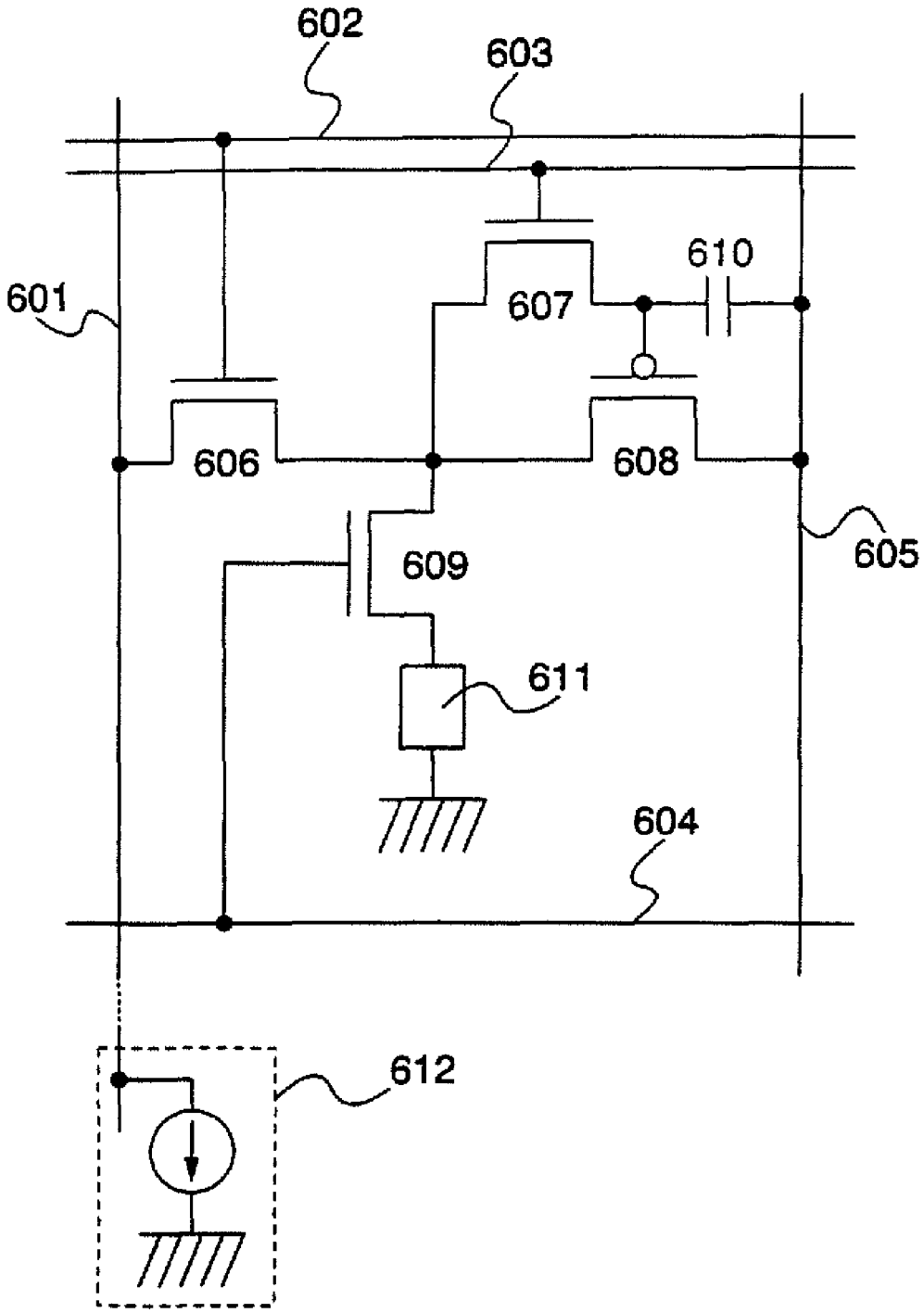
FIG. 6 is a diagram showing a configuration of a conventional pixel.
Figure 7:
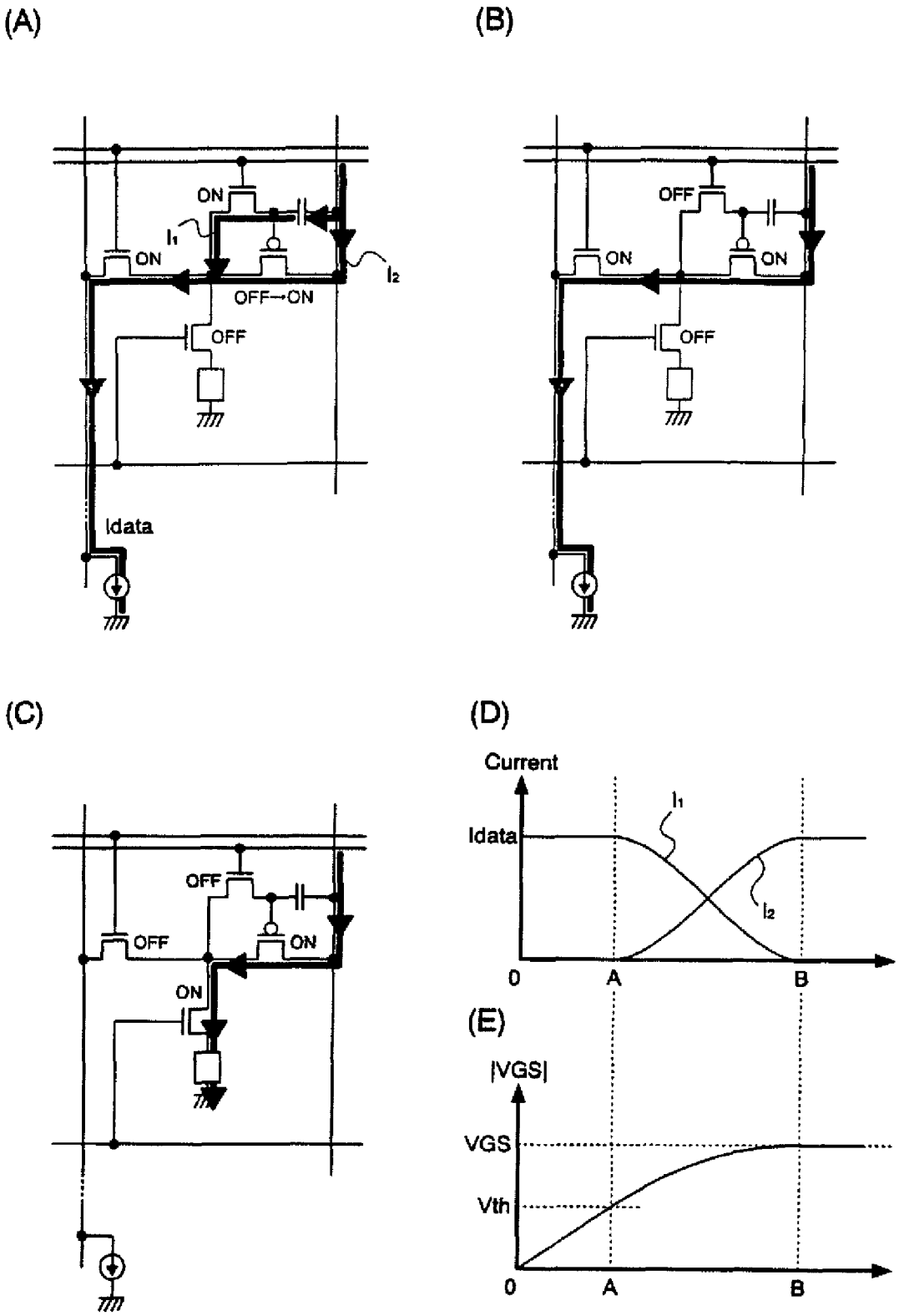
FIG. 7 shows diagrams showing an operation of a conventional pixel.
Figure 8:
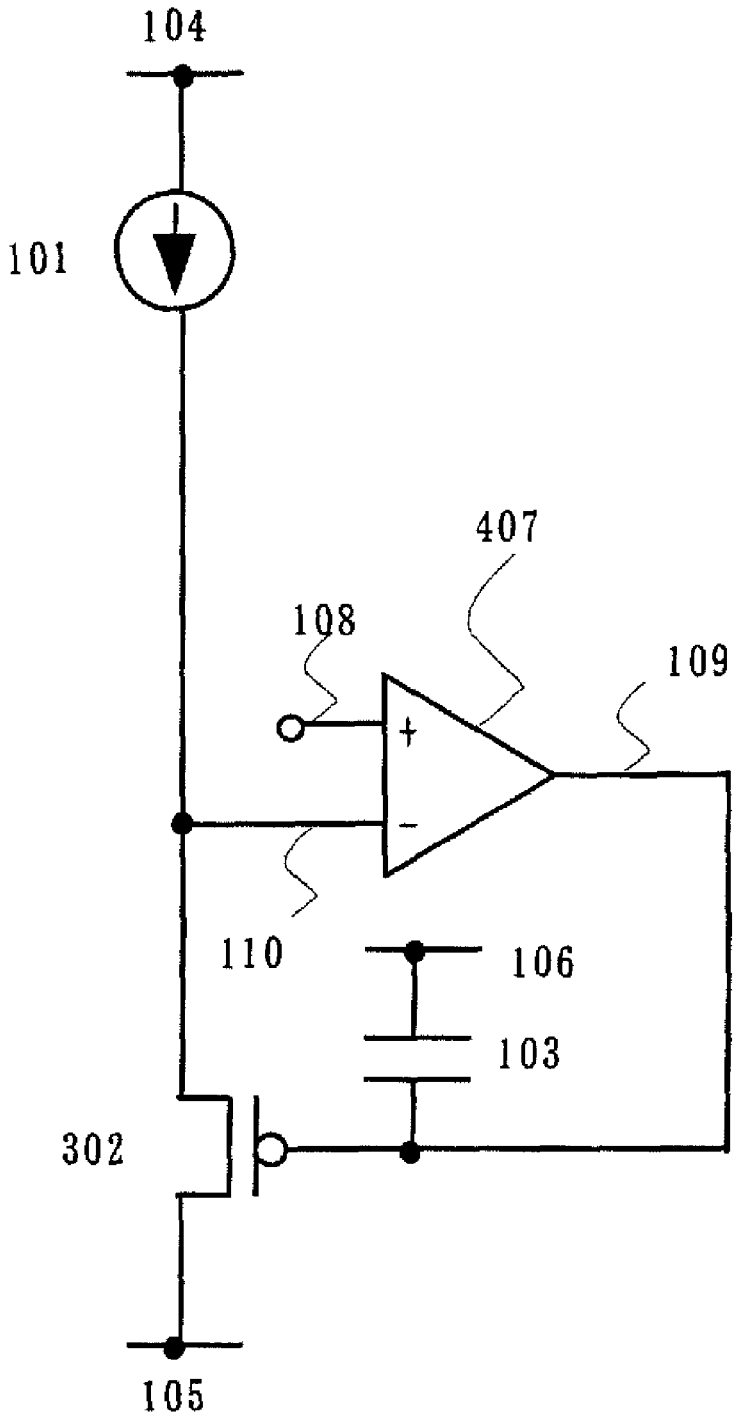
FIG. 8 is a diagram showing a configuration of a semiconductor device of the invention.

Similarly to FIG. 4, FIG. 5 shows a configuration diagram corresponding to FIG. 2 and FIG. 8 shows a configuration diagram corresponding to FIG. 3.

In the case of FIG. 8, the gate potential of the current source transistor 102 is controlled so that the source potential of the current source transistor 102 and the potential of the non-inverting (positive) input terminal become equal to each other. Therefore, in the case where (Vgs−Vth)<Vds is satisfied according to the potential of the non-inverting (positive) input terminal, the current source transistor 302 operates in a saturation region, while in the case where (Vgs−Vth)>Vds is satisfied, the current source transistor 302 operates in a linear region.

Note that a configuration of the operational amplifier used in FIGS. 4, 5, and 8 is not limited and an arbitrary operational amplifier can be used. A voltage feedback type operational amplifier or a current feedback type operational amplifier may be used. An operational amplifier additionally provided with various correction circuits such as a phase compensation circuit may be used as well.

Note that an operational amplifier normally operates so that a potential of a non-inverting (positive) input terminal and a potential of an inverting input terminal become equal to each other, however, the potential of the non-inverting (positive) input terminal and the potential of the inverting input terminal do not become the same due to a variation in characteristics and the like in some cases. That is, an offset voltage may generate. In that case, similarly to a normal operational amplifier, the potential of the non-inverting (positive) input terminal and the potential of the inverting input terminal may be controlled to be equal for operation.

In the case of this invention, an operation may be performed as long as Vds of the current source transistor 102 at the set operation is large. Alternatively, a current value at the output operation does not vary much in the case of operating in a saturation region even when Vds varies. Therefore, in the case of operating as such, an offset voltage may generate at an operational amplifier. Even when the offset voltage varies, it will not affect much. Therefore, provided that an operational amplifier is configured by using transistors of which current characteristics vary largely, an approximately normal operation can be obtained. Therefore, a thin film transistor (including amorphous and polycrystal) or an organic transistor can operate efficiently as well as a single crystalline transistor.

In this embodiment mode, an operational amplifier is used as an example of an amplifier circuit, however, various circuits such as a differential circuit, a common drain amplifier circuit, a common source amplifier circuit and the like may be used to configure an amplifier circuit.

Note that the content described in this embodiment mode corresponds to a detailed description of an amplifier circuit having a configuration described in Embodiment Mode 1. However, the invention is not limited to this and various changes can be made as long as the gist of the invention is not changed.

Note that the configuration of an amplifier circuit described in this embodiment mode can be implemented in combination with that of Embodiment Mode 1.

Embodiment Mode 3

The invention is set so that the current source transistor can flow the current Idata by flowing the current Idata from the current source circuit. Then, the current source transistor which is set operates as a current source circuit to supply a current to various loads. In this embodiment mode, a connecting structure of a load and a current source transistor, a structure of a transistor when supplying a current to a load and the like are described.

Note that in this embodiment mode, the configuration of FIG. 1, a configuration using an operational amplifier as an amplifier circuit (FIG. 4) and the like are referred for description, however, the invention is not limited to this and can be applied to other configurations described in FIGS. 2 to 8.

Further, the case of flowing a current from the current source circuit to the current source transistor which is an N-channel type transistor is described, however, the invention is not limited to this and can be applied to other configurations described in FIGS. 2 to 8.

Figure 9:
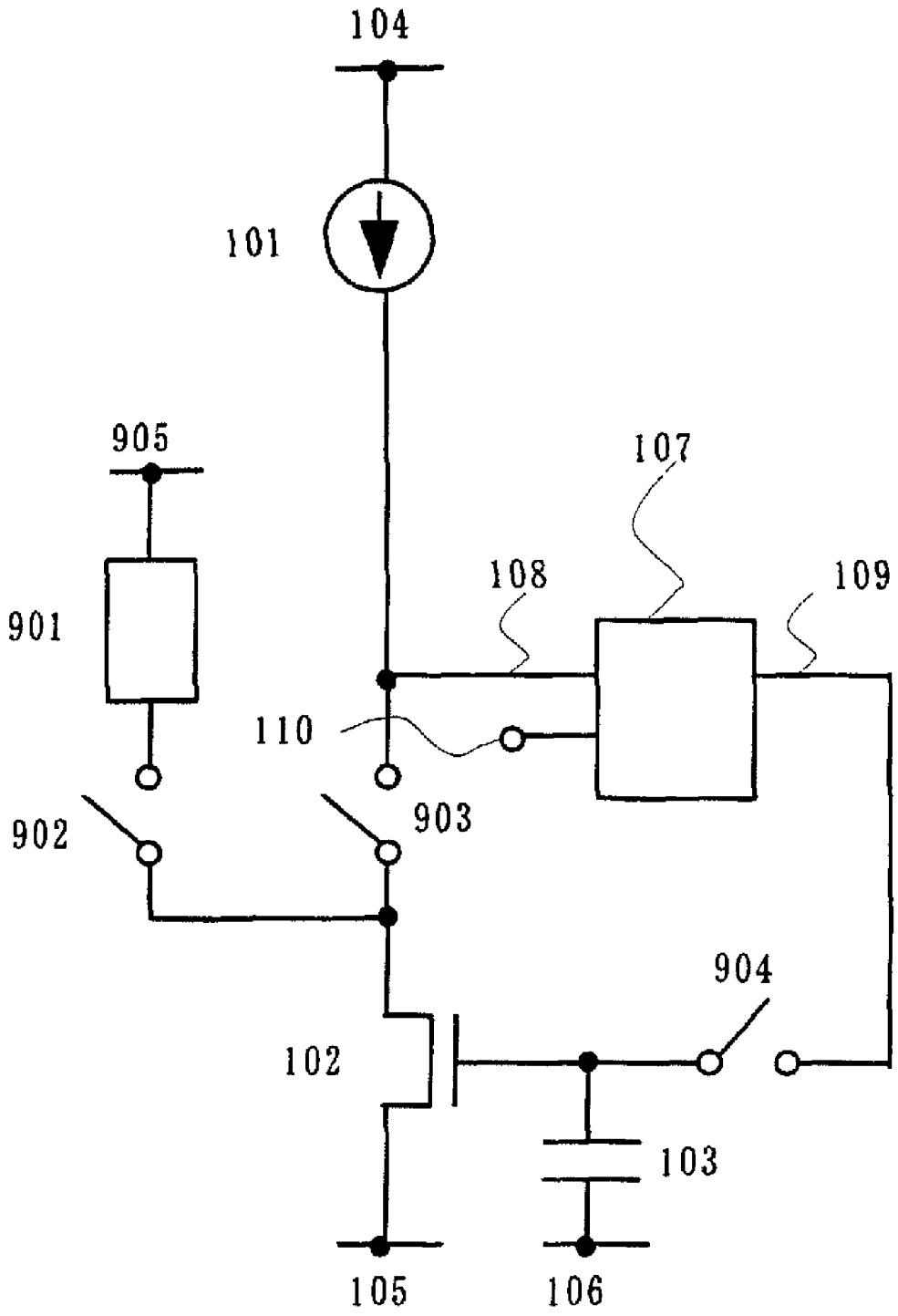
FIG. 9 is a diagram showing a configuration of a semiconductor device of the invention.
Figure 10:
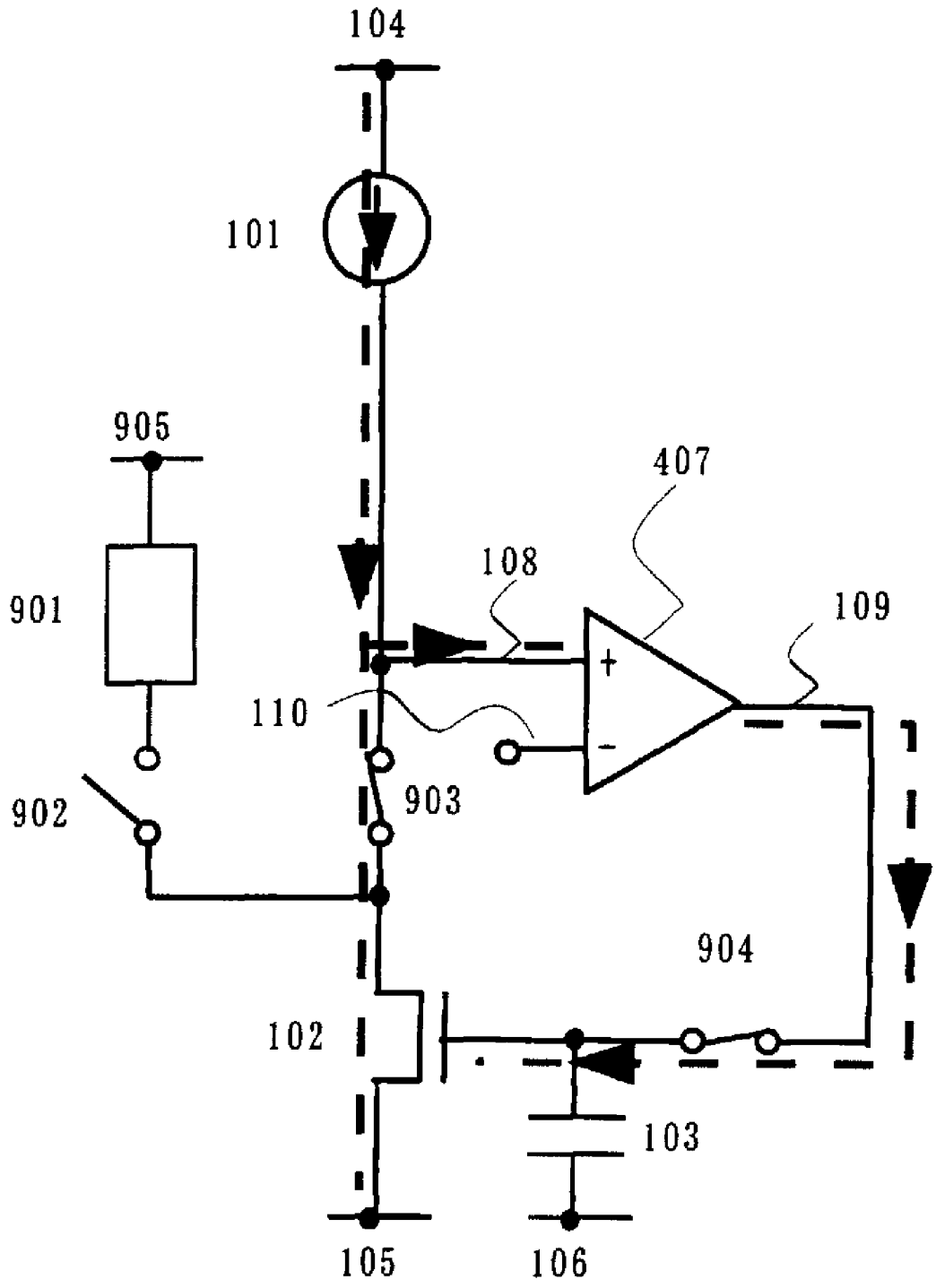
FIG. 10 is a diagram showing an operation of a semiconductor device of the invention.

First, FIG. 9 shows a configuration in the case of supplying a current to a load by using only a current source transistor supplied with a current from the current source circuit. FIG. 10 shows the case of using an operational amplifier as an amplifier circuit.

Figure 11:
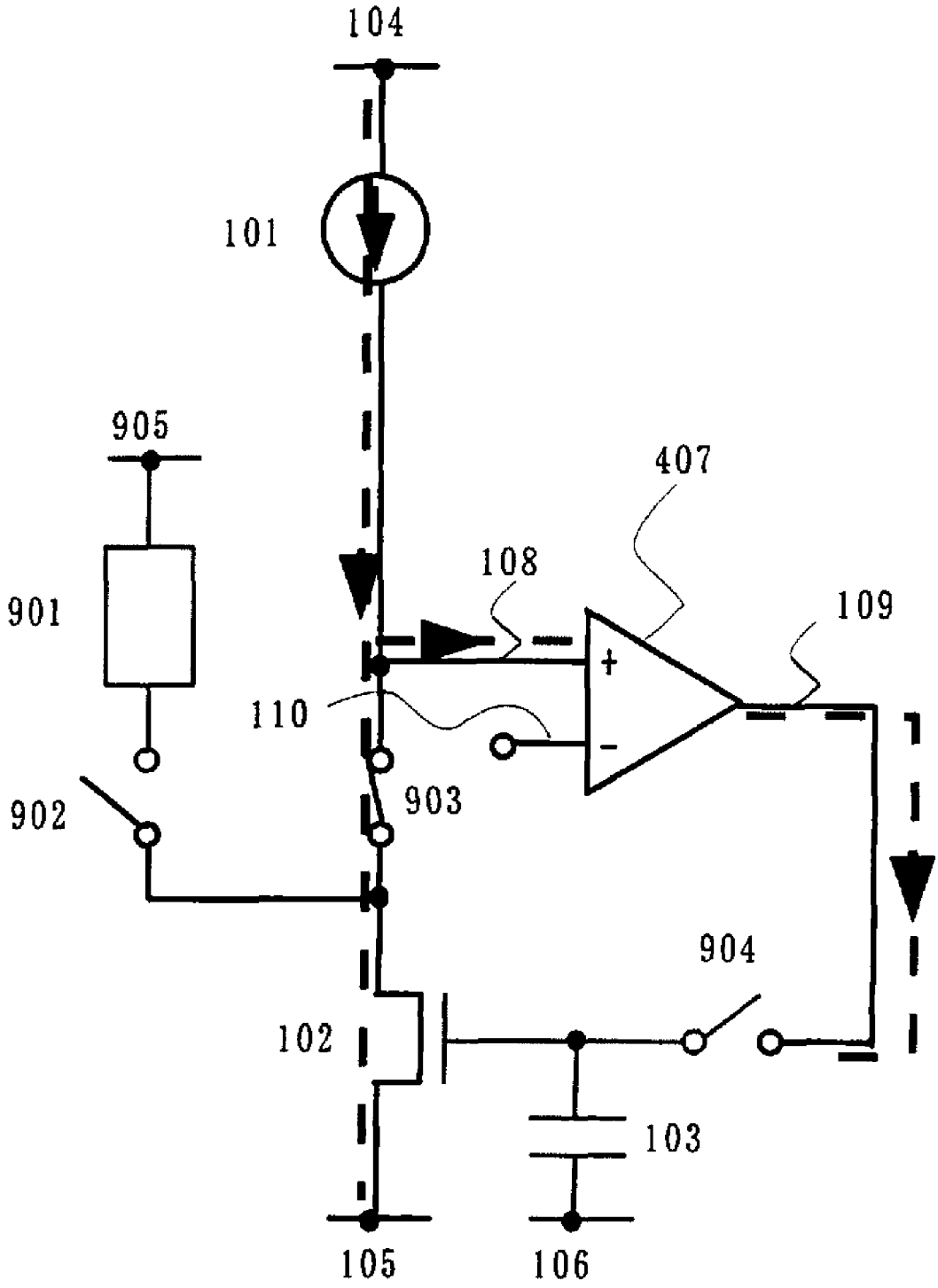
FIG. 11 is a diagram showing an operation of a semiconductor device of the invention.
Figure 12:
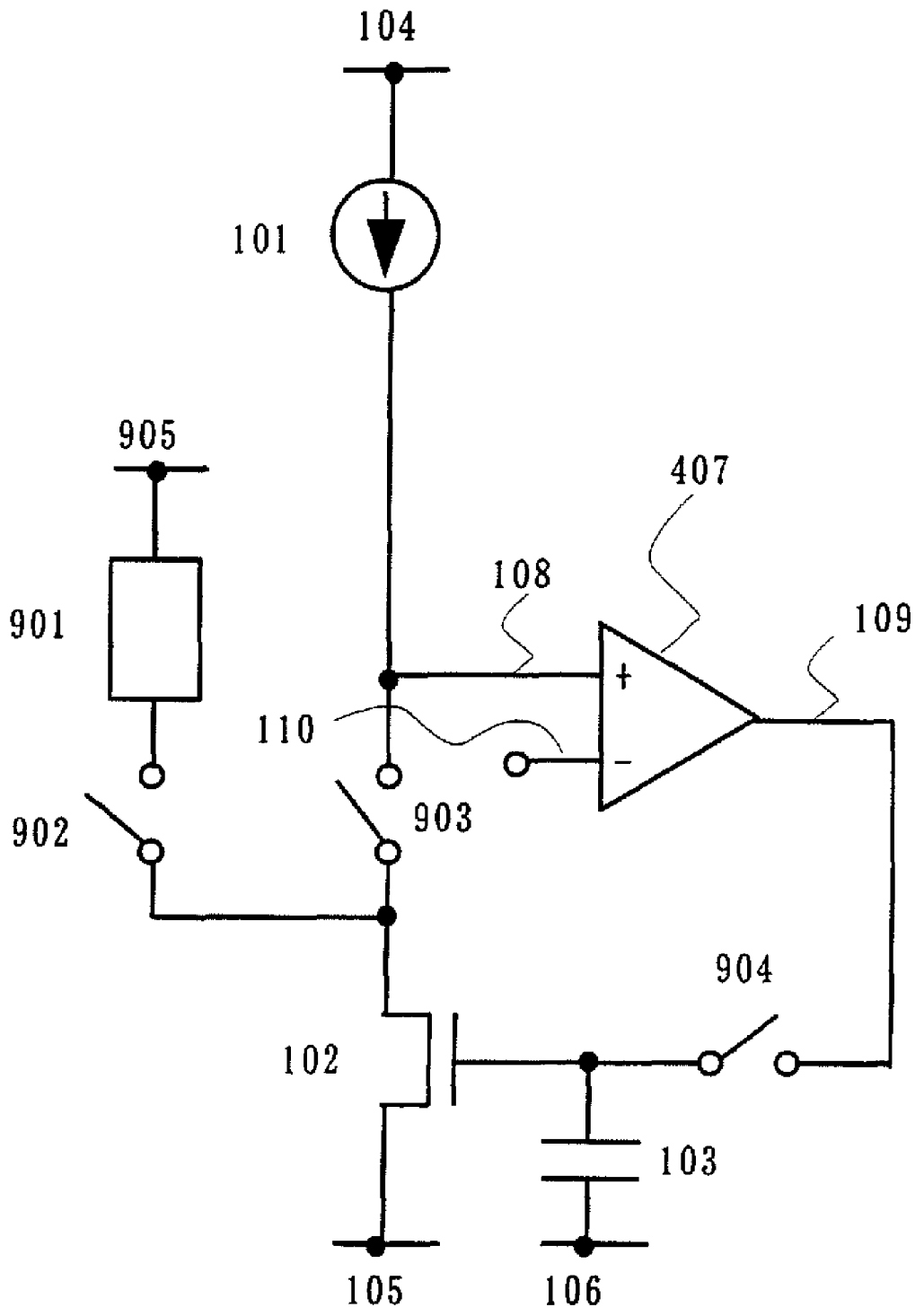
FIG. 12 is a diagram showing a configuration of a semiconductor device of the invention.
Figure 13:
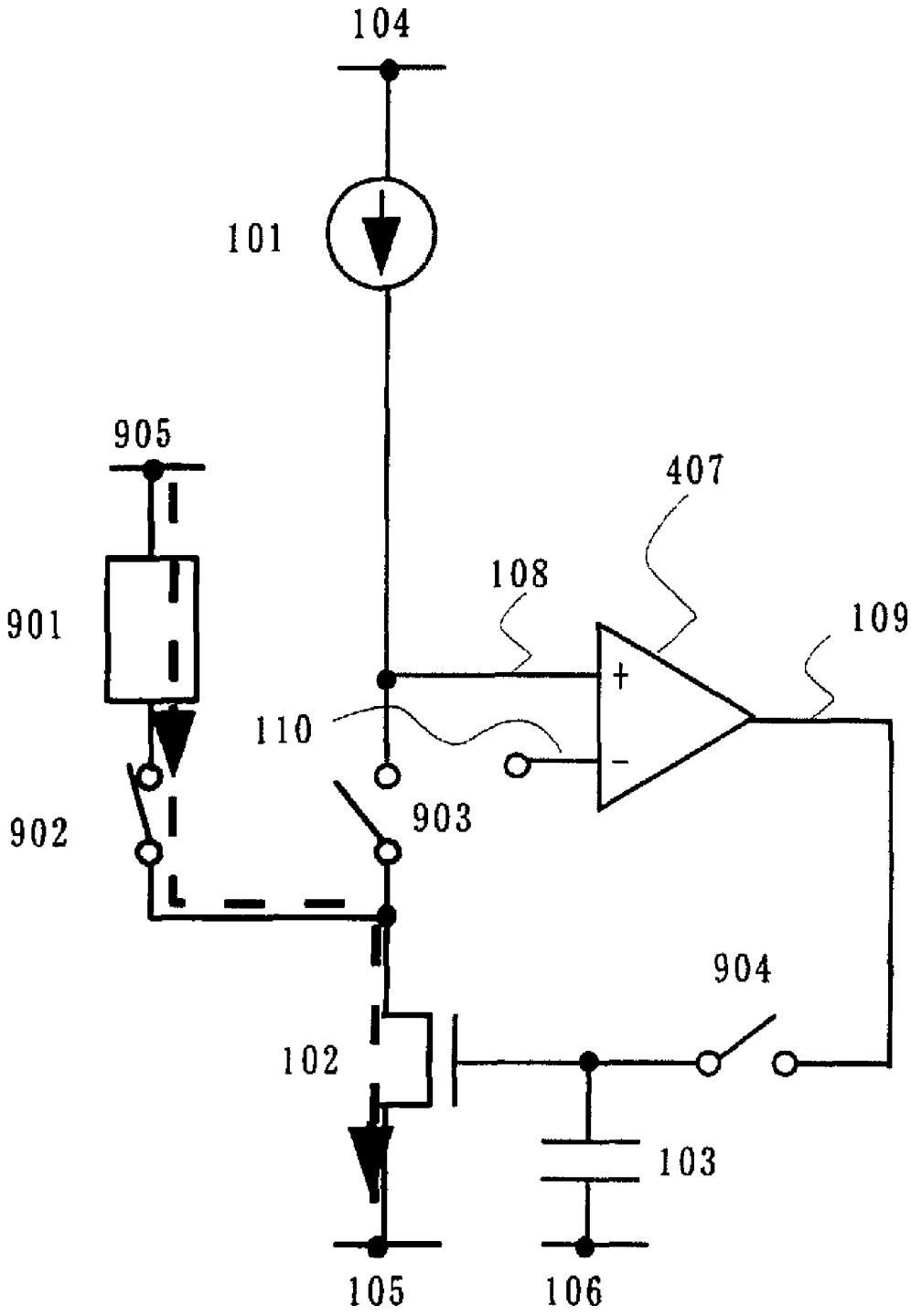
FIG. 13 is a diagram showing an operation of a semiconductor device of the invention.
Figure 14:
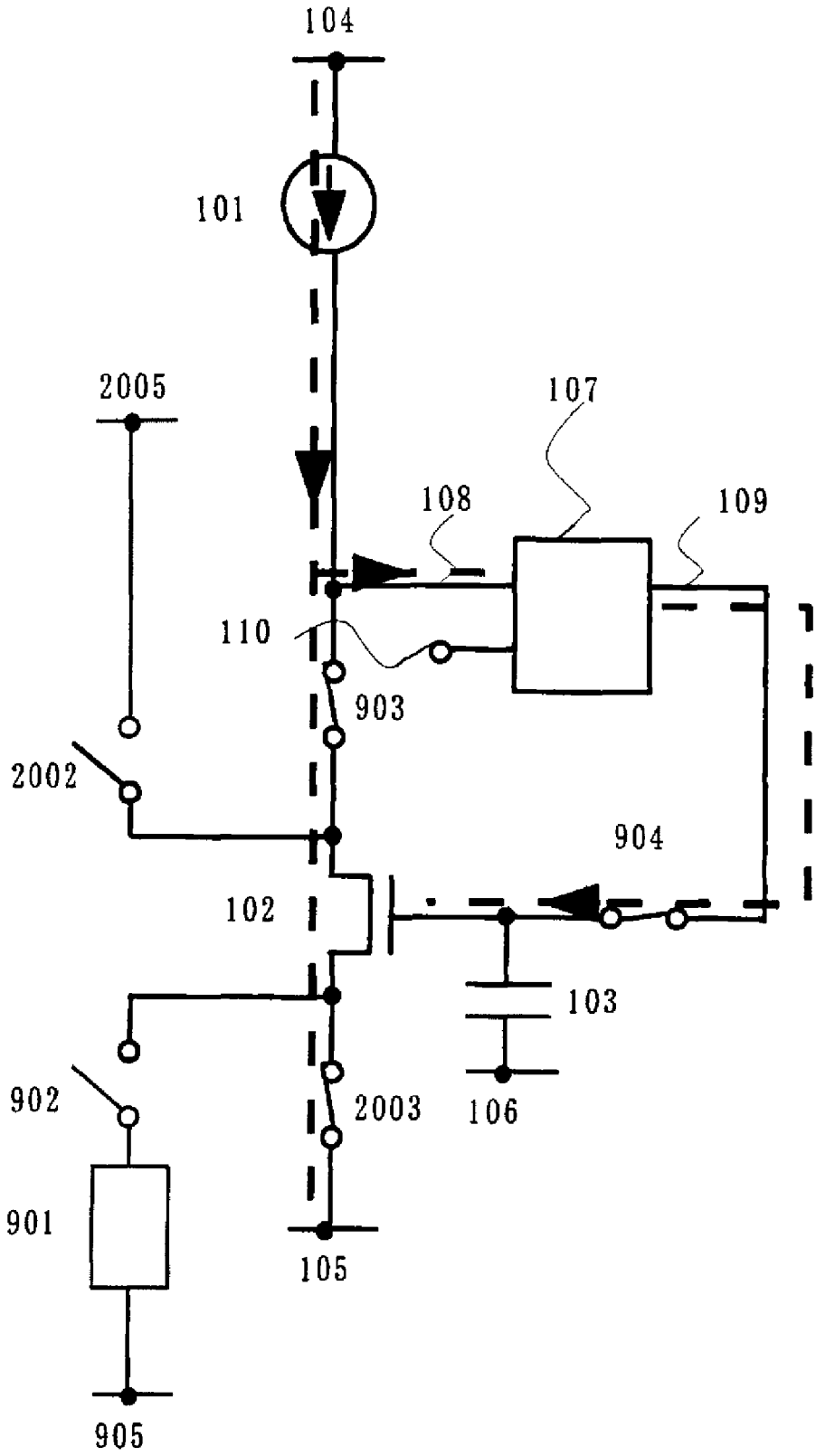
FIG. 14 is a diagram showing an operation of a semiconductor device of the invention.

Hereinafter described is the case of using an operational amplifier as an amplifier circuit as for an operating method of FIG. 9. First, a switch 903 and a switch 904 are turned ON as shown in FIG. 10. Then, an operational amplifier 407 controls the gate potential of the current source transistor 102 and set for flowing the current Idata supplied from the current source circuit. At this time, a write can be performed rapidly as the operational amplifier 407 is used. When the switch 904 is turned OFF as shown in FIG. 11, the gate potential of the current source transistor 102 is held in the capacitor 103. When the switch 903 is turned OFF as shown in FIG. 12, a current supply stops. When a switch 902 is turned ON as shown in FIG. 13, a current is supplied to the load 901.

The size of this current is approximately the same as the current Idata as long as the current source transistor 102 operates in a saturation region when the current Idata is supplied from the current source circuit 101, namely in the set operation, and when a current is supplied to the load 901, namely in the output operation. In the case where the current source transistor 102 shows the kink (Early) effect, the current supplied to the load 901 in the output operation is approximately the same in size as Idata provided that Vds of the current source transistor 102 is approximately equal between the set operation and the output operation. Moreover, in the case where the current source transistor 102 operates in a linear region in the set operation and the output operation, the current supplied to the load 901 in the output operation is the same in size as Idata provided that Vds is approximately equal between the set operation and the output operation. Vds of the current source transistor 102 in the set operation can be controlled by controlling the potential of the inverting input terminal 110 of the operational amplifier.

Note that Vds of the current source transistor 102 at the output operation is determined by voltage-current characteristics of the load 901. Therefore, Vds of the current source transistor 102 in the set operation may be controlled by controlling the potential of the inverting input terminal 110 of the operational amplifier accordingly. Moreover, in the case where the voltage-current characteristics of the load 901 deteriorate with time and the voltage-current characteristics change, the potential of the inverting input terminal 110 of the operational amplifier may be controlled accordingly.

By operating in this manner, even when the current characteristics and the size of the current source transistor 102 vary, an effect thereof can be removed.

In the case where an arbitrary constant potential is applied to the wiring 106, the source potential of the current source transistor 102 changes between when setting by writing a current (FIG. 10) and when outputting a current (FIG. 13) in some cases. In that case, a gate-source voltage of the current source transistor 102 may change as well. When the gate-source voltage changes, a current value changes too. Then, it is required that a gate-source voltage does not change between when setting by writing a current (FIG. 10) and when outputting a current (FIG. 13). In order to realize the aforementioned, the wiring 106 may be connected to the source terminal of the current source transistor 102, for example. Accordingly, even when the source potential of the current source transistor 102 changes, the gate potential thereof changes in accordance with it, therefore, the gate-source voltage does not change consequently.

Note that various wirings (wiring 105, wiring 106, wiring 905, wiring 104 and the like) are used in the circuit of FIG. 9. These wirings may be connected to each other as long as a normal operation can be obtained.

Figure 16:
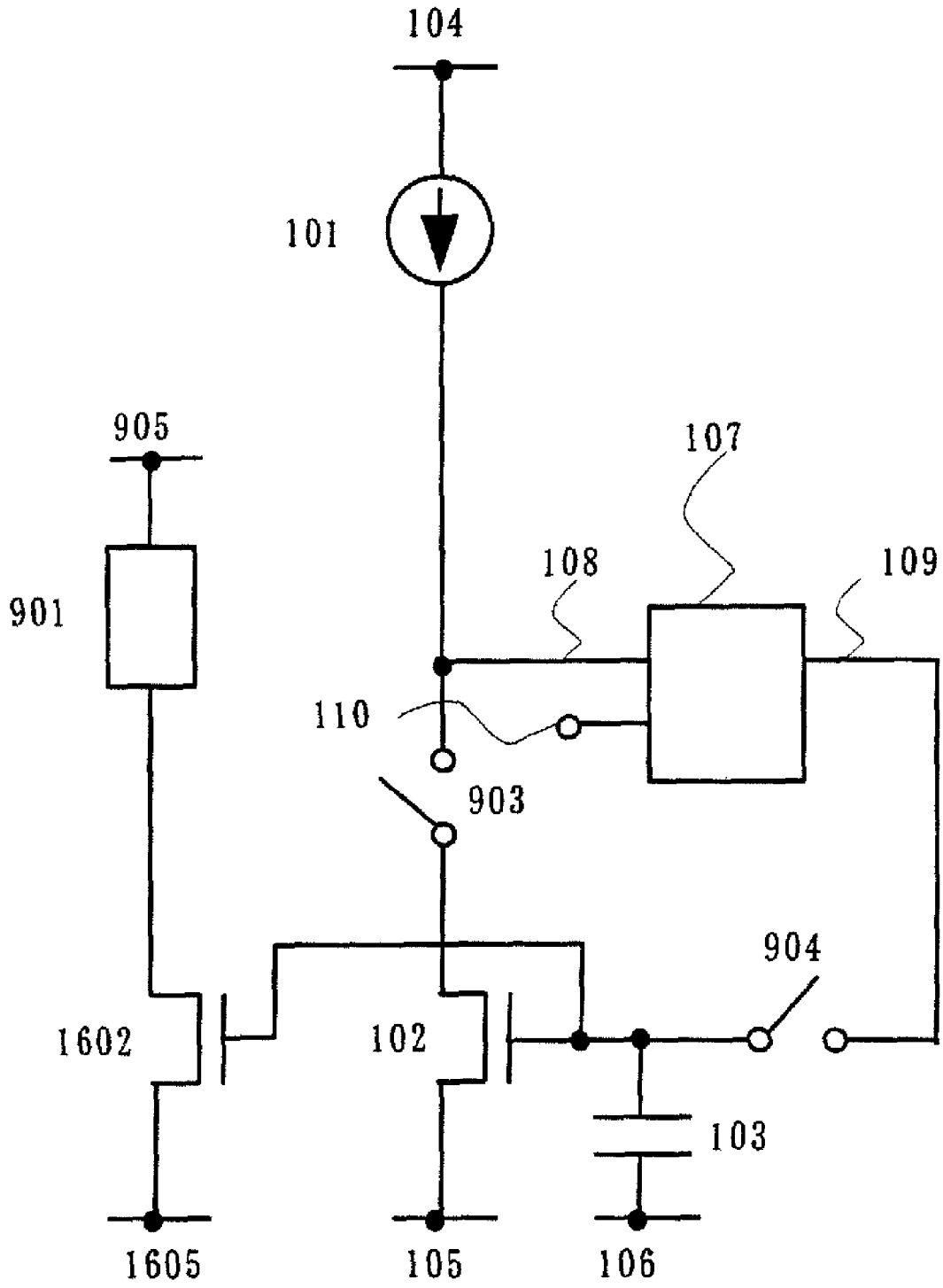
FIG. 16 is a diagram showing a configuration of a semiconductor device of the invention.

Subsequently, FIG. 16 shows a configuration diagram in the case of using different transistor than the current source transistor for supplying a current to a load. A gate terminal of a current transistor 1602 is connected to a gate terminal of the current source transistor 102. Therefore, by controlling W/L of the current source transistor 102 and the current transistor 1602, the amount of current to be supplied to a load can be changed. For example, by making W/L of the current transistor 1602 small, the amount of current to be supplied to a load can be small, thus Idata can be large. As a result, a write of a current can be performed rapidly. However, when current characteristics of the current source transistor 102 and the current transistor 1602 vary, their effects emerge.

As wirings may be connected to each other as long as a normal operation is obtained, the wiring 105 and the wiring 1605 are preferably connected to each other.

Figure 17:
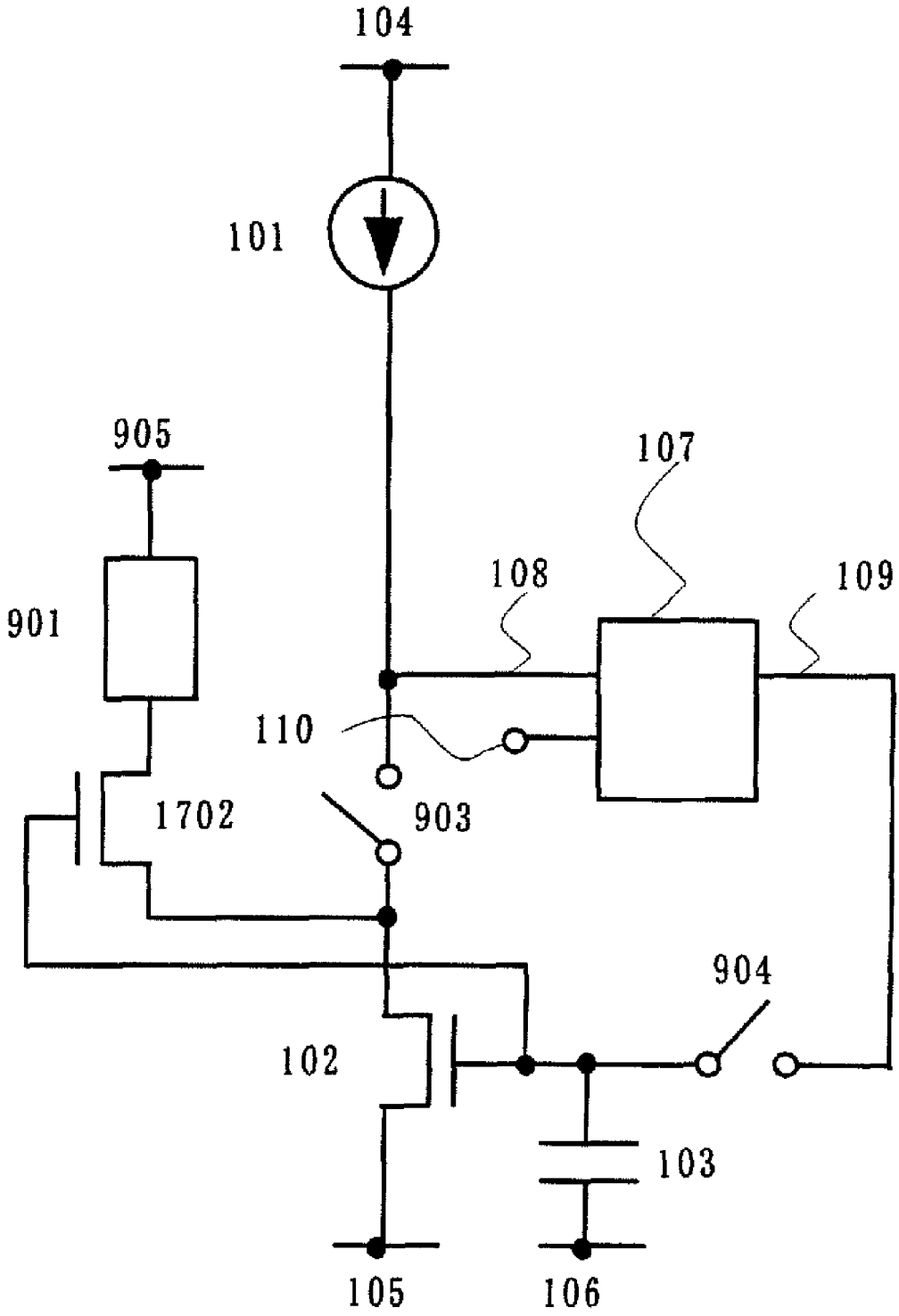
FIG. 17 is a diagram showing a configuration of a semiconductor device of the invention.

Next, FIG. 17 shows a configuration diagram in the case of supplying a current to a load by using another transistor as well as the current source transistor. When supplying the current Idata of the current source circuit 101, in the case where the current leak to the load 901 or from the load 901, the set cannot be performed with an accurate current. In the case of FIG. 9, the switch 902 is used for the control, however, a multi transistor 1702 is used in the case of FIG. 17. A gate terminal of the multi transistor 1702 is connected to the gate terminal of the current source transistor 102. Therefore, with the switches 903 and 904 ON and a gate-source voltage of the multi-transistor 1702 lower than a threshold voltage of the multi-transistor 1702, the multi-transistor 1702 is OFF. Therefore, when supplying the current Idata of the current source circuit 101, it is possible to prevent an adverse effect.

Provided that the multi transistor 1702 is turned ON and a current leaks when a current is set, a switch may be disposed in series with the multi transistor 1702 for controlling so that the current does not leak.

When supplying a current to a load, on the other hand, the gate terminals of the current source transistor 102 and the multi transistor 1702 are connected to each other, they operate as a multi-gate transistor. Therefore, a current smaller than Idata flows to the load 901. Thus, as the amount of current supplied to the load becomes small, the size of Idata can be large on the contrary. As a result, a write of a current can be performed rapidly. However, when the current characteristics of the current source transistor 102 and the multi transistor 1702 vary, an effect thereof emerges. However, when supplying a current to the load 901, the current source transistor 102 is used as well, therefore, an effect of the variation is small.

In the case of disposing a switch in series with the multi transistor 1702, the switch is required to be ON at the output operation, namely when supplying a current to a load.

Figure 18:
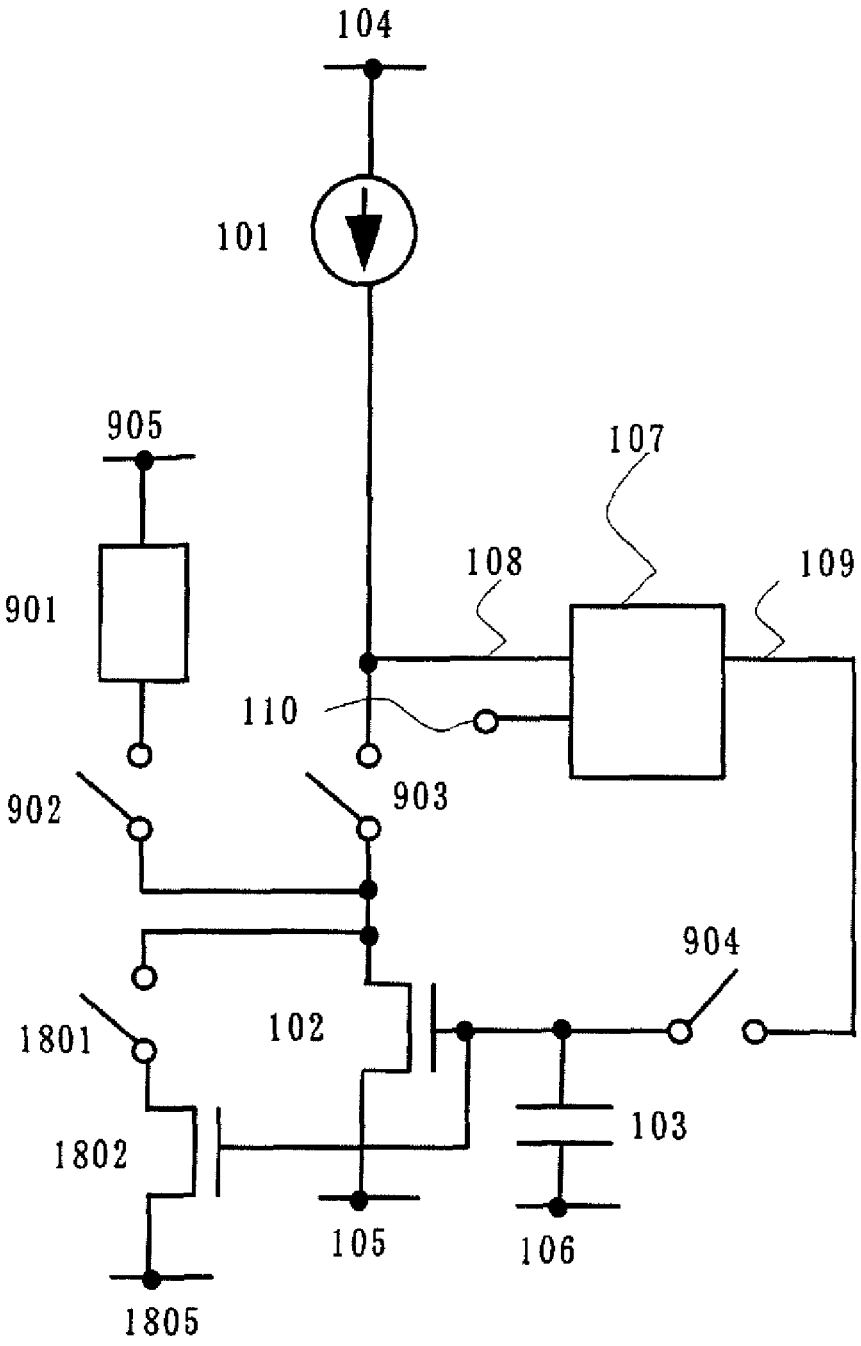
FIG. 18 is a diagram showing a configuration of a semiconductor device of the invention.

Next, FIG. 18 shows a configuration for making the current Idata large which is supplied from the current source circuit 101 by a different way than FIG. 16 and FIG. 17. In FIG. 18, a parallel transistor 1802 is connected in parallel with the current source transistor 102. Therefore, a switch 1801 is turned ON while a current is supplied from the current source circuit 101. In the case of supplying a current to the load 901, the switch 1801 is turned OFF. Then, a current flowing to the load 901 becomes small, thus the current Idata supplied from the current source circuit 101 can be made large.

In this case, however, an effect of a variation of the parallel transistor 1802 emerges in parallel with the current source transistor 102. In the case of supplying a current from the current source circuit 101 in FIG. 18, the size of the current may be changed. That is, a large current is provided at first. At that time, a switch 1801 is turned ON accordingly. Then, a current flows to the parallel transistor 1802 as well and a current can be written rapidly, which corresponds a precharge operation. After that, by supplying a smaller current from the current source circuit 101, the switch 1801 is turned OFF. Then, a current is supplied only to the current source transistor 102 to write. Consequently, an effect of the variation can be removed. After that, the switch 902 is turned ON and a current is supplied to the load 901.

Figure 19:
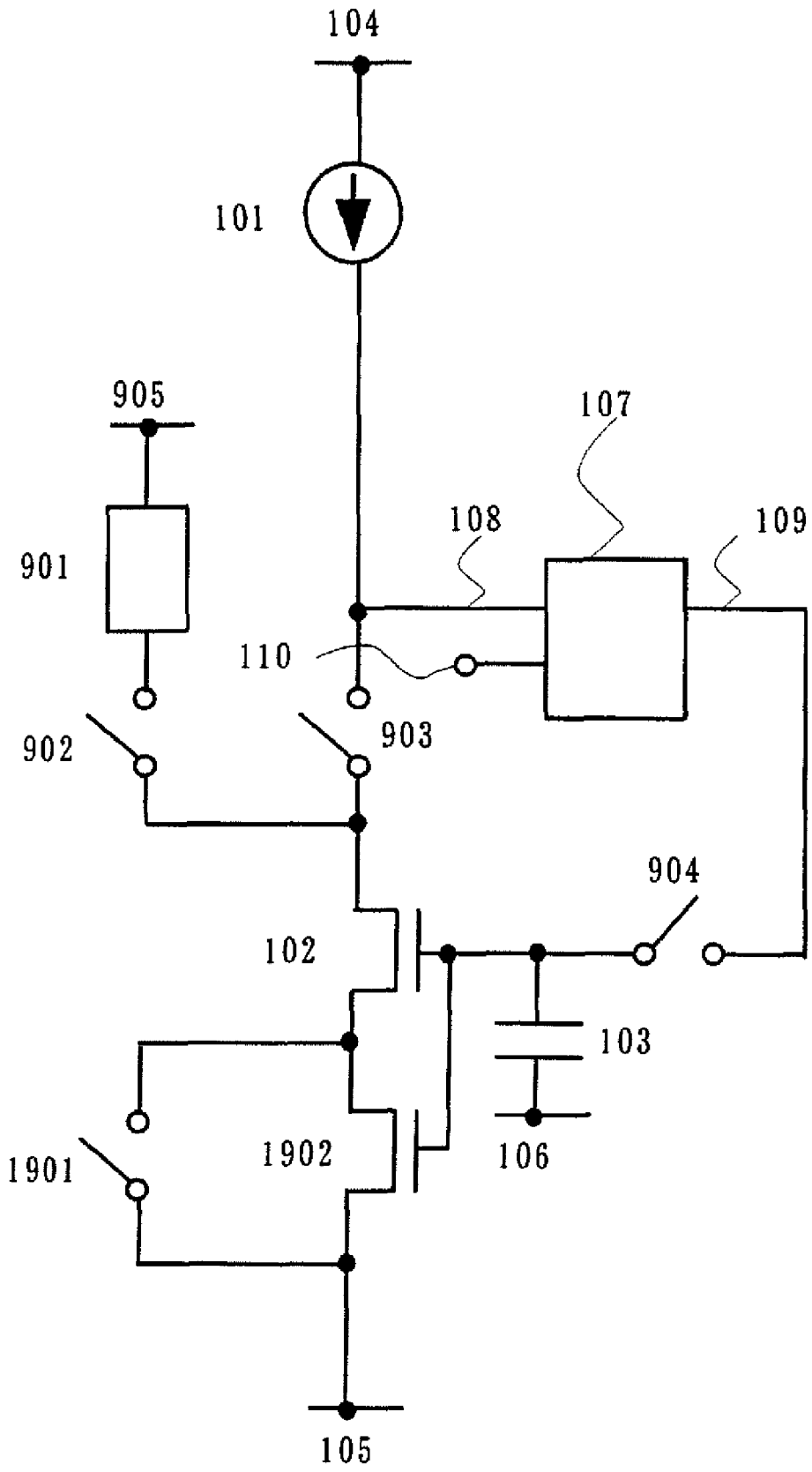
FIG. 19 is a diagram showing a configuration of a semiconductor device of the invention.

In FIG. 18, a transistor is additionally provided in parallel with the current source transistor while FIG. 19 shows a configuration diagram in the case of adding a transistor in series. In FIG. 19, a series transistor 1902 is connected in series with the current source transistor 102. Therefore, while a current is supplied from the current source circuit 101, a switch 1901 is turned ON. Then, a source and a drain of the series transistor 1902 are short-circuited. Then, in the case of supplying a current to the load 901, the switch 1901 is turned OFF. As the gate terminals of the current source transistor 102 and the series transistor 1902 are connected to each other, they operate as a multi-gate transistor. Accordingly, a gate length L is increased, which makes a current flowing to the load 901 small. Thus, the current Idata supplied from the current source circuit 101 can be large.

In this case, however, an effect of a variation of the series transistors 1902 in series with the current source transistor 102 emerges. In the case of supplying a current from the current source circuit 101 in FIG. 19, the size of the current may be changed. That is, a large current is supplied at first. At that time, the switch 1901 is turned ON accordingly. Then, a current flows to the current source transistor 102 and a current can be written rapidly, which corresponds to a precharge operation. After that, by supplying a smaller current from the current source circuit 101, the switch 1901 is turned OFF. Then, a current is supplied to the current source transistor 102 and the series transistor 1902 to write. Consequently, an effect of the variation can be removed. After that, the switch 902 is turned ON and the current source transistor 102 and the series transistor 1902 supplies a current to the load 901 as a multi-gate transistor.

It is to be noted that various configurations shown in FIGS. 9 to 19 may be configured in combination.

Figure 15:
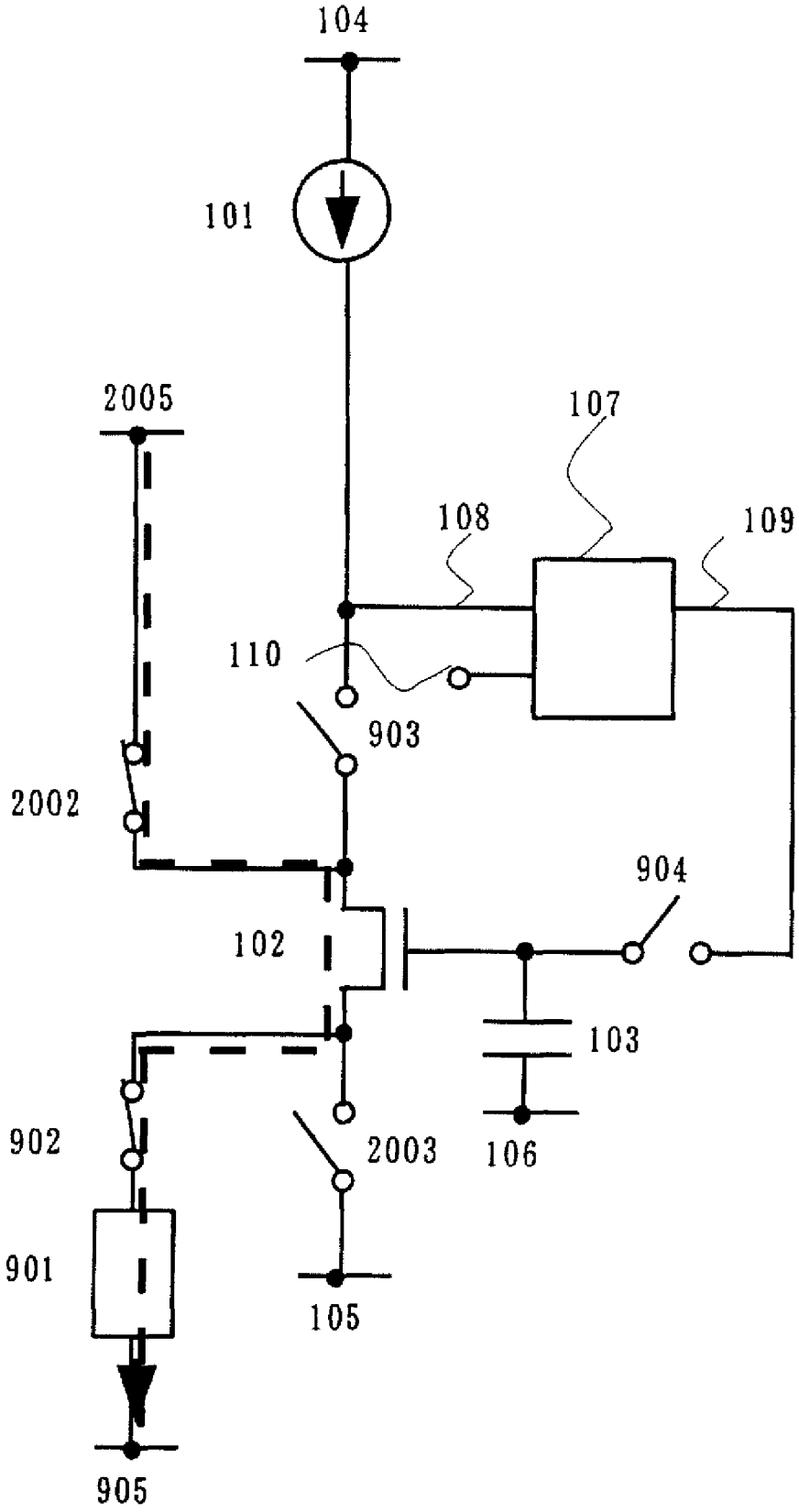
FIG. 15 is a diagram showing an operation of a semiconductor device of the invention.
Figure 20:
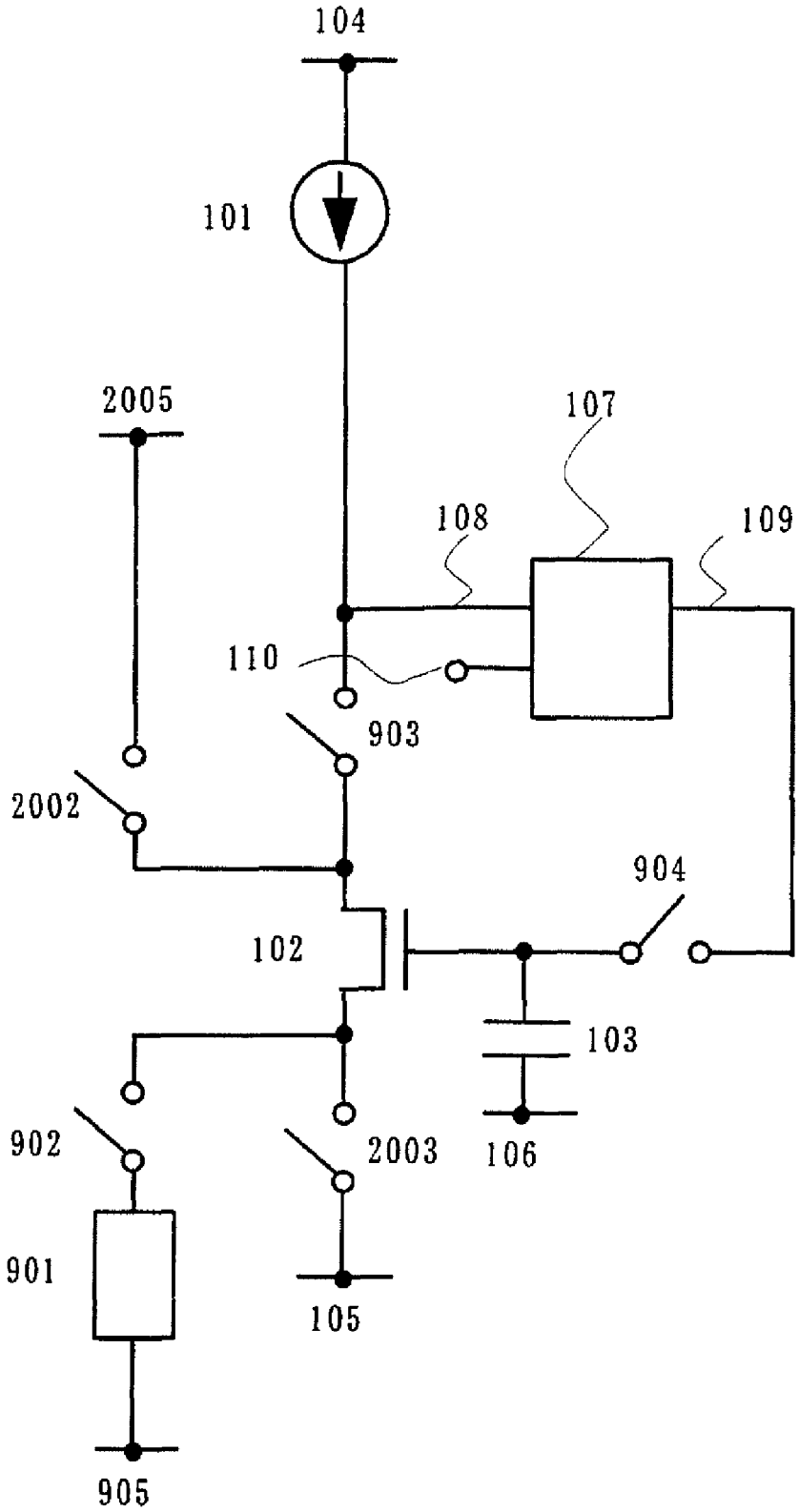
FIG. 20 is a diagram showing a configuration of a semiconductor device of the invention.

Note that the current source circuit 101 and the load 901 are switched in FIGS. 9 to 19, however, the invention is not limited to this. For example, the current source circuit 101 and a wiring may be switched for configuration. FIG. 20 shows a configuration in which the current source circuit 101 and the wiring are changed over in FIG. 9. Next, an operation of FIG. 20 is described. First, in the case of supplying the current Idata from the current source circuit 101 to the current source transistor 102 to set the current, switches 903, 904, and 2003 are turned ON. Then, by operating the current source transistor 102 as a current source circuit, switches 2002 and 902 are turned ON as shown in FIG. 15 in the case of supplying a current to a load. In this manner, switching ON/OFF of the switch 903 and the switch 2002 corresponds to changing over the current source circuit 101 and a wiring 2005.

In the case of supplying the current Idata from the current source circuit 101 to the current source transistor 102, the switch 2003 is turned ON to flow a current to the wiring 105 and the switch 902 is turned OFF, however, the invention is not limited to this. In the case of supplying the current Idata from the current source circuit 101 to the current source transistor 102, a current may flow to the load 901. In that case, the switch 902 can be omitted.

Although the capacitor 103 holds the gate potential of the current source transistor 102, it is preferable that the wiring 106 be connected to the source terminal of the current source transistor in order to hold a gate-source voltage.

FIG. 20 shows a configuration diagram in which the current source circuit 101 and the load 901 are changed over, however, the invention is not limited to this. In various configurations of FIGS. 9 to 19 also, the current source circuit 101 and the load 901 can be changed over as well.

In the aforementioned configurations, a switch is disposed in each portion, however, the disposition thereof is not limited to the described ones. A switch may be disposed at an arbitrary place as long as a normal operation is obtained.

Figure 21:
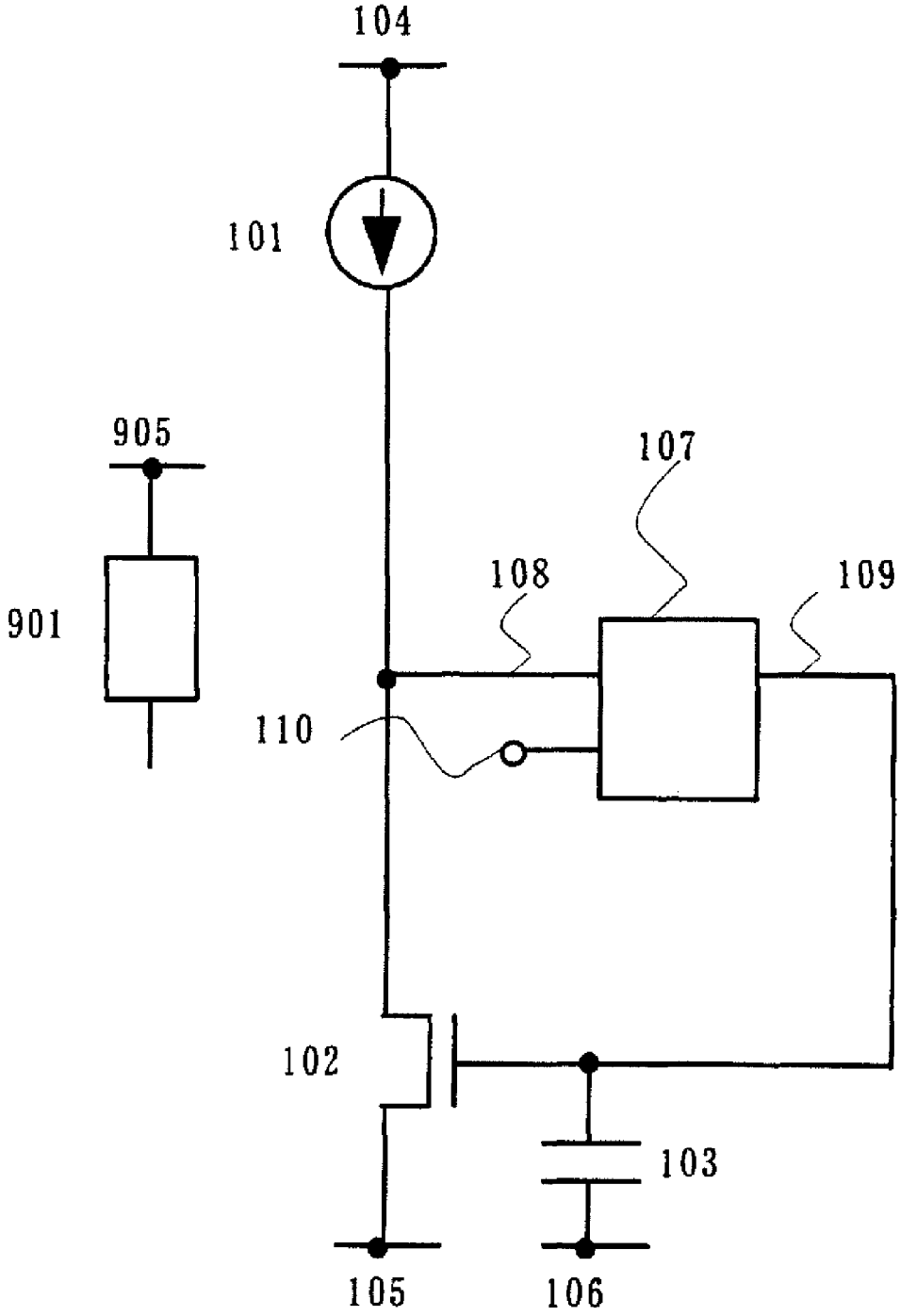
FIG. 21 is a diagram showing a configuration of a semiconductor device of the invention.
Figure 22:
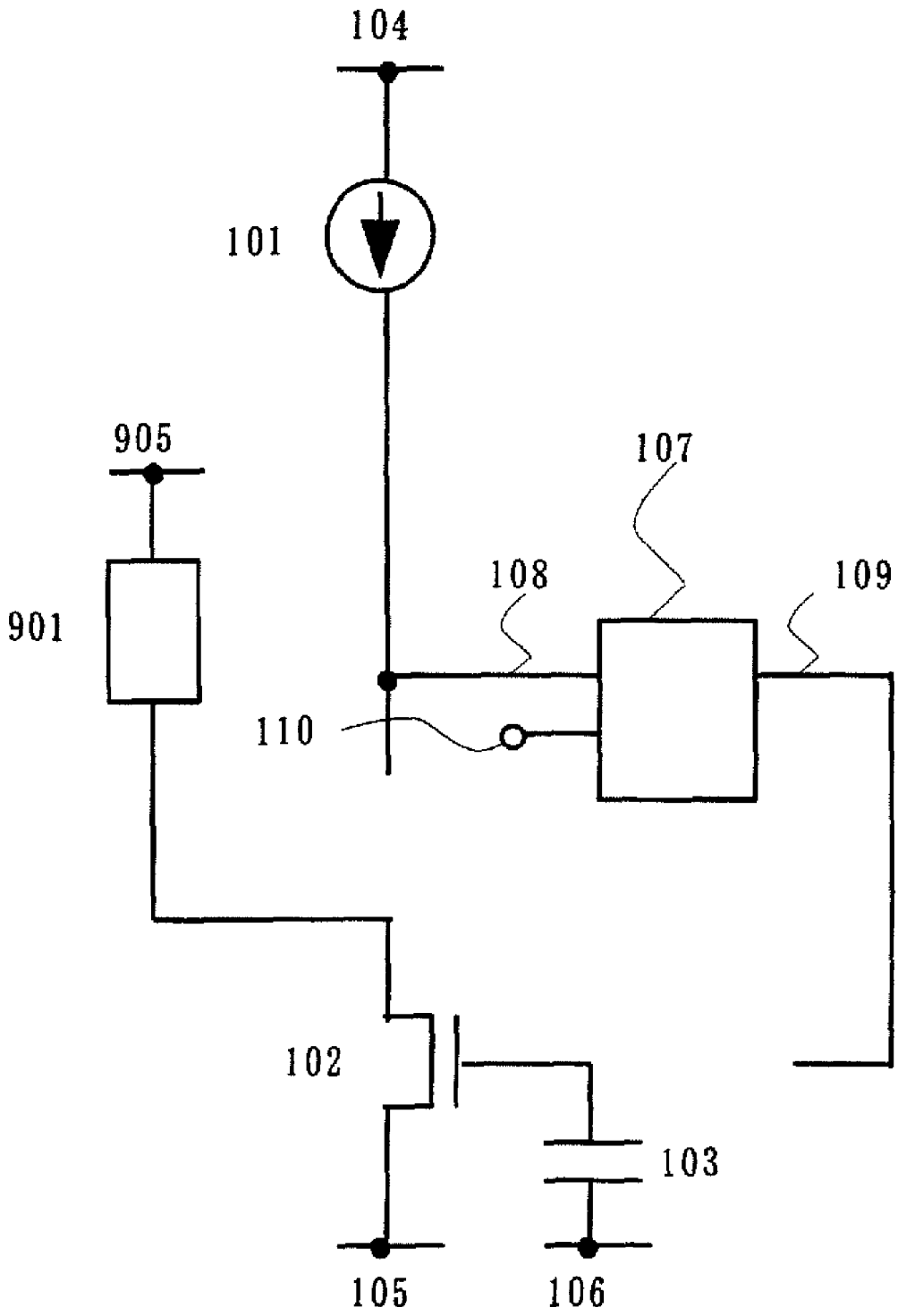
FIG. 22 is a diagram showing a configuration of a semiconductor device of the invention.
Figure 23:
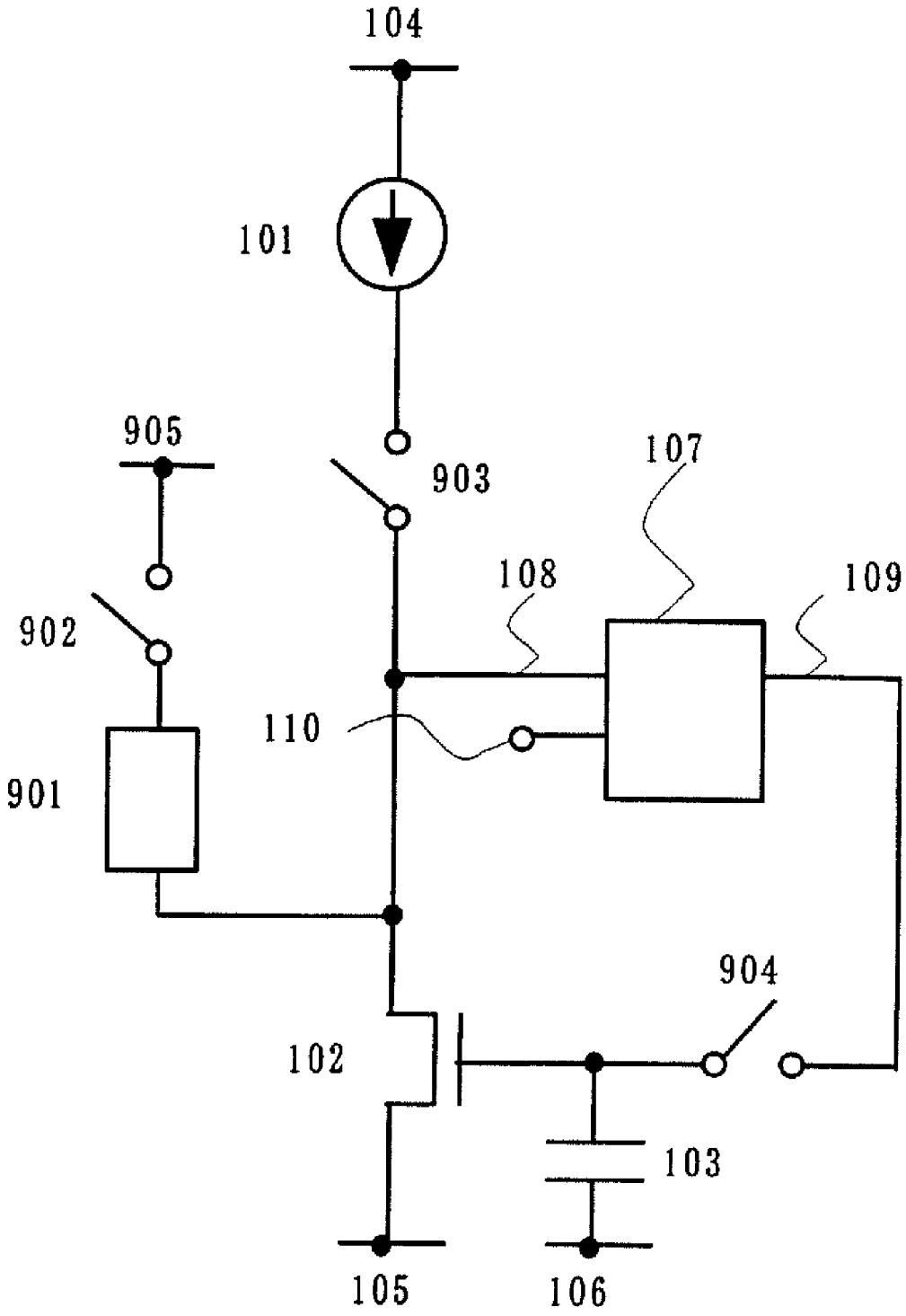
FIG. 23 is a diagram showing a configuration of a semiconductor device of the invention.

For example, components are only required to be connected as in FIG. 21 when supplying the current Idata from the current source circuit 101 to the current source transistor 102 in the case of FIG. 9, and connected as in FIG. 22 when supplying a current to the load 901. Therefore, FIG. 9 may be connected as shown in FIG. 23. In FIG. 23, dispositions of the switches 902 and 903 are changed, however, a normal operation can be obtained.

The switches shown in FIG. 9 and the like may be any switch such as an electrical switch or a mechanical switch. It may be anything as far as it can control a current flow. It may be a transistor, a diode, or a logic circuit configured with them. Therefore, in the case of applying a transistor as a switch, a polarity thereof (conductivity) is not particularly limited because it operates just as a switch. However, when OFF current is preferred to be small, a transistor of a polarity with small OFF current is favorably used. For example, the transistor which provides an LDD region has small OFF current. Further, it is desirable that an N-channel type transistor is employed when a potential of a source terminal of the transistor as a switch is closer to the power source potential on the low potential side (Vss, Vgnd, 0 V and the like), and a P-channel type transistor is desirably employed when the potential of the source terminal is closer to the power source potential on the high potential side (Vdd and the like). This helps the switch operate efficiently as the absolute value of the voltage between the gate and drain of the transistor can be increased. It is also to be noted that a CMOS type switch can be also applied by using both N-channel and P-channel type transistors.

Various examples are shown in this manner, however, the invention is not limited to this. A current source transistor and various transistors which operate as current sources can be disposed in various configurations. Therefore, the invention can be applied to a configuration which operates similarly.

Note that the content described in this embodiment mode corresponds to the one utilizing the configurations described in Embodiment Modes 1 and 2, however, this embodiment is not limited to this and various change can be made as long as the gist thereof is not changed. Therefore, the contents described in Embodiment Modes 1 and 2 can be applied to this embodiment mode as well.

Embodiment Mode 4

In this embodiment mode, a configuration in the case where a plurality of current source transistors and the like are provided is described.

Figure 24:
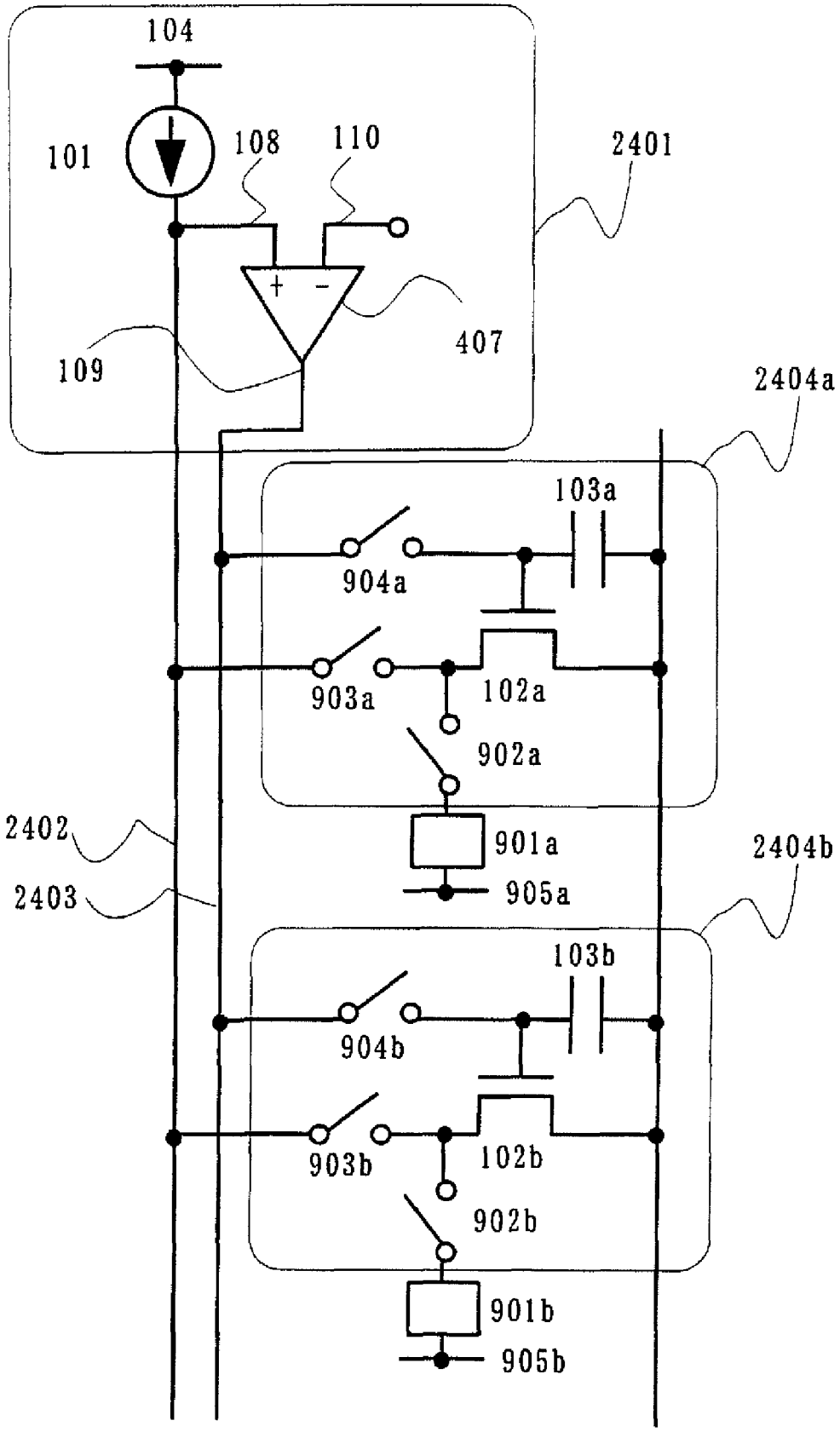
FIG. 24 is a diagram showing a configuration of a semiconductor device of the invention.

FIG. 24 shows a configuration in the case where a plurality of current source transistors are provided in the configuration of FIG. 10. FIG. 24 shows the case where the current source circuit 101 and the operational amplifier 407 are provided one each relatively to the plurality of current source transistors. However, a plurality of current source circuits and a plurality of operational amplifiers may be provided relatively to the plurality of current source transistors. Although, as a circuit scale is enlarged, the current source circuit 101 and the operational amplifier 407 are preferably provided one each.

In FIG. 24, the current source circuit 101 and the operational amplifier 407 are disposed. They are referred to as a resource circuit 2401 collectively. The resource circuit 2401 is connected to a current line 2402 connected to the current source circuit 101 and a voltage line 2403 connected to an output terminal of the operational amplifier 407. A plurality of unit circuits are connected to the current line 2402 and the voltage line 2403. A unit circuit 2404*a* is configured with a current source transistor 102*a*, a capacitor 103*a*, switches 902*a*, 903*a*, and 904*a*, and the like. The unit circuit 2404*a* is connected to the load 901*a*. A unit circuit 2404*b* is configured with a current source transistor 102*b*, a capacitor 103*b*, switches 902*b*, 903*b*, and 904*b*, and the like similarly to the unit circuit 2404*a*. The unit circuit 2404*b* is connected to a load 901*b*. Here, two unit circuits are connected for simplicity, however, the invention is not limited to this. An arbitrary number of unit circuits may be connected.

As an operation, each unit circuit is selected and a current or a voltage are supplied from the resource circuit 2401 through the current line 2402 and the voltage line 2403 since a plurality of unit circuits are connected to one current line 2402 or the voltage line 2403. For example, the switches 903*a* and 904*a* are turned ON to input a current or a voltage to the unit circuit 2404*a*. Next, the switches 903*b* and 904*b* are turned ON to input a current or a voltage to the unit circuit 2404*b*. An operation is performed by repeating the aforementioned operations.

Such switches can be controlled by using a digital circuit such as a shift register, a decoder circuit, a counter circuit, and a latch circuit.

Here, provided that the loads 901*a* and 901*b* are display elements such as an EL element, the unit circuit and the load form one pixel. Also, the resource circuit 2401 corresponds to a signal line driver circuit (a part of it) for supplying a signal to a pixel connected to a signal line (a current line or a voltage line). That is, FIG. 24 shows one column of pixels or a signal line driver circuit (a part of it). In that case, the current outputted from the current source circuit 101 corresponds to an image signal. By changing an image signal current in an analog manner or a digital manner, an appropriate size of current can be supplied to a load (a display element such as an EL element). In this case, the switches 903*a* and 904*a*, and the switches 903*b* and 904*b* are controlled by using a gate line driver circuit.

Provided that the current source circuit 101 in FIG. 24 is a signal line driver circuit or a part of it, the current source circuit 101 is also required to output an accurate current without being affected by a variation in current characteristics and size of transistors. Therefore, the current source circuit 101 in the signal line driver circuit or a part of it is configured with a current source transistor and can supply a current from another current source circuit to the current source transistor. That is, in the case where the loads 901*a*, 901*b* and the like in FIG. 24 are a signal line, a pixel and the like, a unit circuit configures the signal line driver circuit or a part of it. Then, the resource circuit 2401 corresponds to a current source circuit or a part of it which supplies a signal to the current source transistor (current source circuit) in the signal line driver circuit connected to a current line. That is, FIG. 24 shows a plurality of signal lines, the signal line driver circuit or a part of it, and the current source circuit or a part of it which supplies a current to the signal line driver circuit.

In that case, a current outputted from the current source circuit 101 corresponds to a current to be supplied to the signal line or the pixel. Therefore, in the case of supplying a current corresponding to the current outputted from the current source circuit 101 to the signal line or the pixel, the current outputted from the current source circuit 101 corresponds to an image signal. By changing the image signal current in an analog manner or a digital manner, a current of an appropriate size can be supplied to a load (a signal line or a pixel). In this case, the switches 903*a* and 904*a*, the switches 903*b* and 904*b* and the like are controlled by using a circuit (a shift register, a latch circuit and the like) which is a part of the signal line driver circuit.

Note that a circuit (a shift register, a latch circuit and the like) for controlling the switches 903*a* and 904*a*, and the switches 903*b* and 904*b* is described in International Publication WO03/038796, International Publication WO03/038797 and the like, of which contents can be implemented in combination with the invention.

Alternatively, the current outputted from the current source circuit 101 is set to supply an arbitrary constant current and a switch and the like are used for controlling to supply it or not. In the case of supplying a current of corresponding size to a signal line and a pixel, the current outputted from the current source circuit 101 corresponds to a signal current for supplying an arbitrary constant current. Then, the switch for determining to supply a current to a signal line and a pixel or not is controlled in a digital manner to control the amount of current to be supplied to the signal line and the pixel, thereby a current of an appropriate size can be supplied to a load (a signal line or a pixel). In this case, the switches 903*a* and 904*a*, the switches 903*b* and 904*b* and the like are controlled by using a circuit (a shift register, a latch circuit and the like) which is a part of the signal line driver circuit. In this case, however, a driver circuit (a shift register, a latch circuit and the like) is required for controlling the switch which determines to supply a current to the signal line and the pixel or not. Therefore, a driver circuit (a shift register, a latch circuit and the like) for controlling the switch and a driver circuit (a shift register, a latch circuit and the like) for controlling the switches 903*a* and 904*a*, the switches 903*b* and 904*b* are required. Those driver circuits may be provided independently. For example, a shift register for controlling the switches 903*a* and 904*a*, the switches 903*b* and 904*b* and the like may be provided individually. Alternatively. a driver circuit (a shift register, a latch circuit and the like) for controlling the switch and the driver circuit (a shift register, a latch circuit and the like) for controlling the switches 903*a* and 904, the switches 903*b* and 904*b* may be shared partially or as a whole. For example, one shift register may control both switches or an output (an image signal) of a latch circuit and the like may be used for control in a driver circuit (a shift register, a latch circuit and the like) for controlling the switch which determines to supply a current to the signal line or the pixel.

The driver circuit (a shift register, a latch circuit and the like) for controlling the switch which determines to supply a current to the signal line or the pixel and the driver circuit (a shift register, a latch circuit and the like) for controlling the switches 903*a* and 904, the switches 903*b* and 904*b* and the like are described in International Publication WO03/038793, International Publication WO03/038794, International Publication WO03/038795, and the like, of which contents can be implemented in combination with the invention.

Figure 25:
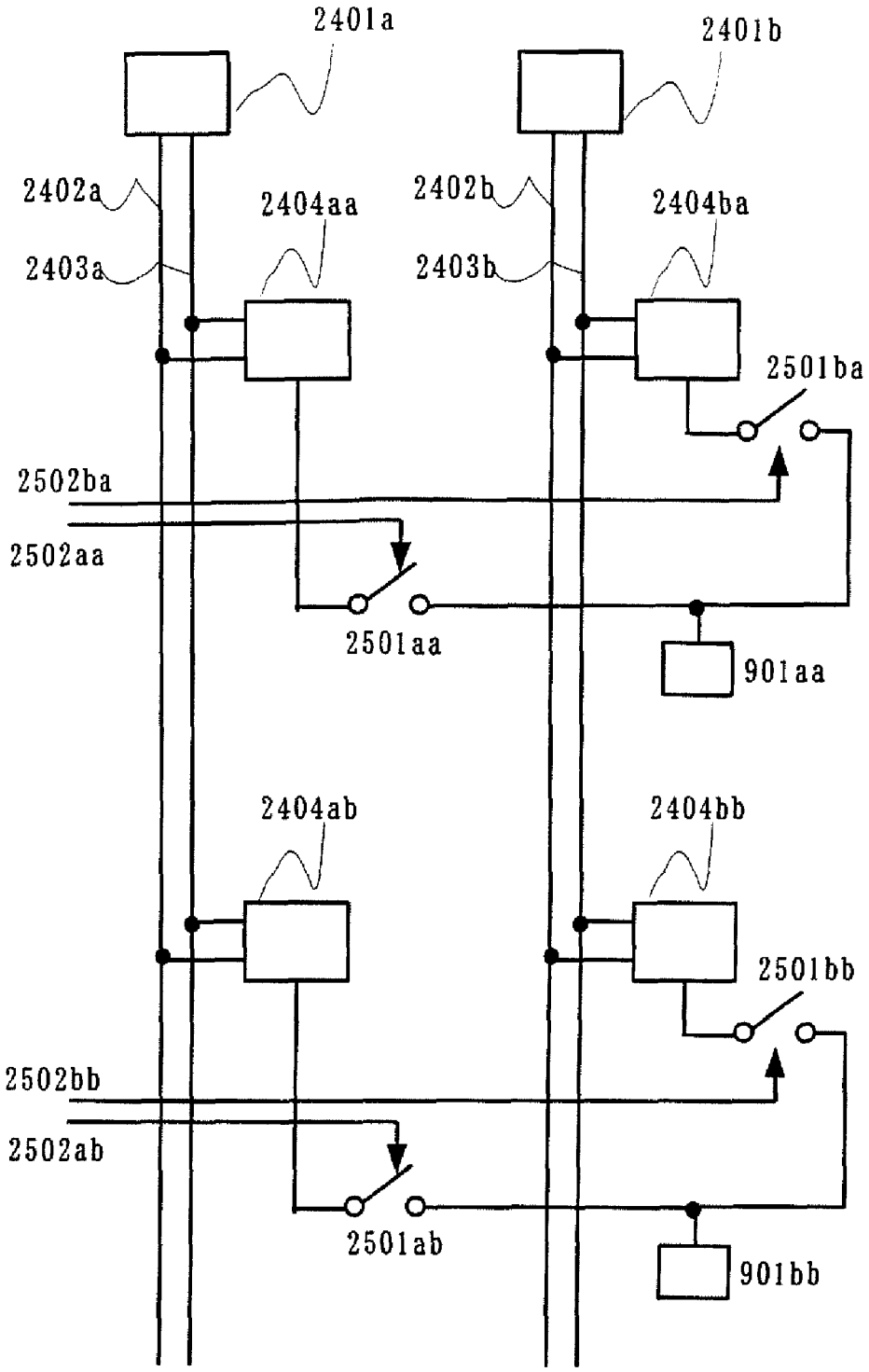
FIG. 25 is a diagram showing a configuration of a semiconductor device of the invention.

FIG. 24 shows the case of disposing a current source transistor and a load one to one. Next, FIG. 25 shows the case where a plurality of current source transistors are disposed to one load. Here shows the case where two unit circuits are connected to one load for simplicity, however, the invention is not limited to this. More unit circuits may be connected as well as only one. Here, 2401*a* and 2401*b* denote resource circuits, 2402*a* and 2403*b* denote current lines, 2403*a* and 2403*b* denote voltage lines, 2404*aa*, 2404*ab*, 2404*ba*, and 2404*bb* denote unit circuits, 2501*aa*, 2501 ab, 2501*ba*, and 2501*bb* denote switches, 2502*aa*, 2502*ab*, 2502*ba*, and 2502*bb* denote wirings, and 901*aa* and 901*bb* denote loads. The amount of current to be supplied to the load 901*aa* can be controlled by ON/OFF of the switches 2501*aa* and 2501*ba*. For example, in the case where a current value (Iaa) outputted from the unit circuit 2404*aa* and a current value (Iba) outputted from the unit circuit 2404*ba* are different in size, the current supplied to the load 901 aa can be controlled into four kinds by each ON/OFF of the switches 2501*aa* and 2501*ba*. In the case where Iba=2×Iaa is satisfied, the size of 2 bits can be controlled. Therefore, in the case where ON/OFF of the switches 2501*aa* and 2501*ba* is controlled by digital data corresponding to each bit, a digital-analog converting function can be realized by using the configuration of FIG. 25. Therefore, in the case where the loads 901*aa* and 901*bb* are signal lines, a signal line driver circuit (a part of it) can be configured by using the configuration of FIG. 25. At that time, a digital image signal can be converted into an analog image signal current. Further, ON/OFF of the switch 2501*aa*, the switch 2501*ba* and the like can be controlled by using an image signal. Therefore, the switch 2501*aa*, the switch 2501*ba* and the like can be controlled by using a circuit (latch circuit) which outputs an image signal.

Furthermore, ON/OFF of the switch 2501*aa* and the switch 2501*ba* may be changed over according to time. For example, the switch 2501*aa* is turned ON while the switch 2501*ba* is turned OFF in a certain period to input a current is inputted from the resource circuit 2401*b* to the unit circuit 2404*ba* to set so that an accurate current can be outputted, and a current is supplied from the unit circuit 2404*aa* to the load 901*aa*. In another period, the switch 2501*aa* is turned OFF while the switch 2501*ba* is turned ON to input a current from the resource circuit 2401*a* to the unit circuit 2404*aa* to set so that an accurate current can be outputted and a current is supplied from the unit circuit 2404*ba* to the load 901*aa*. Thus, operations may be changed over according to time.

Next, the case of supplying a current to a unit circuit by using one resource circuit is described with reference to FIG. 26. Here, 2401 denotes a resource circuit, 2402 denotes a current line, 2403 denotes a voltage line, 2404*ca*, 2404*cb*, 2404*da*, and 2404*db* denote unit circuits, 2601*ca*, 2602*ca*, 2603*ca*, 2601*cb*, 2602*cb*, 2603*cb*, 2601*da*, 2602*da*, 2603*da*, 2601*db*, 2602*db*, and 2603*db* denote switches, 2604*c* and 2604*d* denote wirings, and 901*ca* and 901*da* denote loads.

Figure 26:
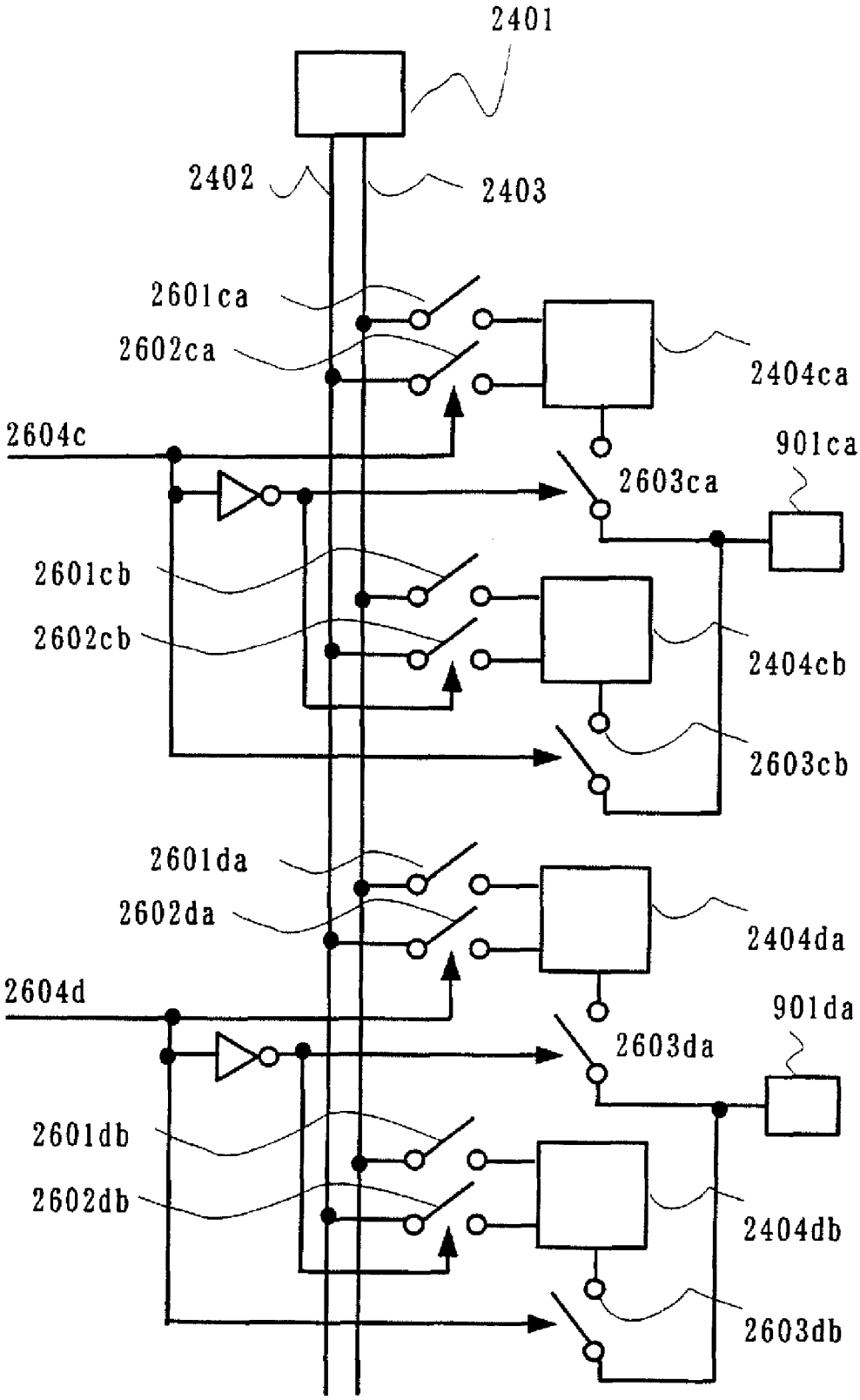
FIG. 26 is a diagram showing a configuration of a semiconductor device of the invention.

In FIG. 26, it is assumed that when the wiring 2604*c* sends an H signal, the switches 2601*ca*, 2602*ca*, and 2603*cb* are turned ON and the switches 2603*ca*, 2601*cb*, and 2602*cb* are turned OFF. Then, the unit circuit 2404*ca* becomes capable of being supplied with a current from the resource circuit 2401 and the unit circuit 2404*cb* becomes capable of supplying a current to the load 901*ca*. On the contrary, when the wiring 2604*c* sends an L signal, the unit circuit 2404*cb* becomes capable of being supplied with a current from the resource circuit 2401 and the unit circuit 2404*ca* becomes capable of supplying a current to the load 901*ca*. Further, the wiring 2604*c*, the wiring 2604*d* and the like may be inputted with signals for selecting sequentially. In this manner, the operations of unit circuits may be changed over according to time.

Further, in the case where the loads 901*ca* and 901*da* are signal lines, a signal line driver circuit (a part of it) can be configured by using the configuration of FIG. 26. Moreover, the wiring 2604*c*, the wiring 2604*d* and the like may be controlled by using a shift register and the like.

Note that a configuration of FIG. 10 shows the case where a plurality of current source transistors are provided is described in the configuration of FIG. 10, however, the invention is not limited to this. For example, the configurations (FIG. 17, FIG. 16, FIG. 20, FIG. 19 and the like) described in Embodiment Modes 1 to 3 can be used as well.

Note that the content described in this embodiment mode corresponds to the one utilizing the configurations described in Embodiment Modes 1, 2, and 3, however, the invention is not limited to this and various changes can be made as long as the gist thereof is not changed.

Note that the configuration in the case where a plurality of current source transistor are provided, which is described in this embodiment mode can be implemented in combination with Embodiment Modes 1 to 3.

Embodiment Mode 5

In this embodiment mode, an example in the case of applying the invention to a pixel having a display element is described.

Figure 27:
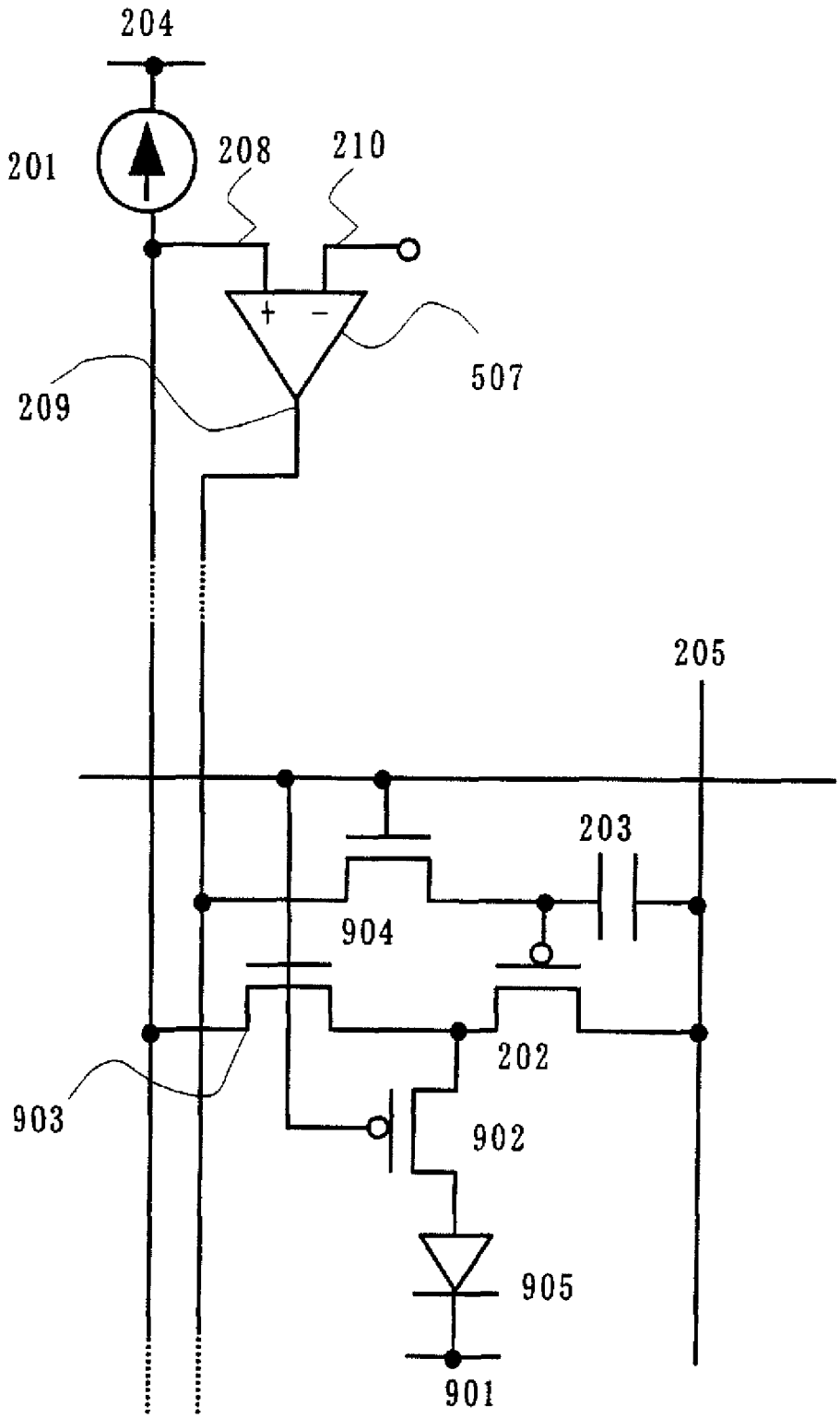
FIG. 27 is a diagram showing a configuration of a semiconductor device of the invention.
Figure 28:
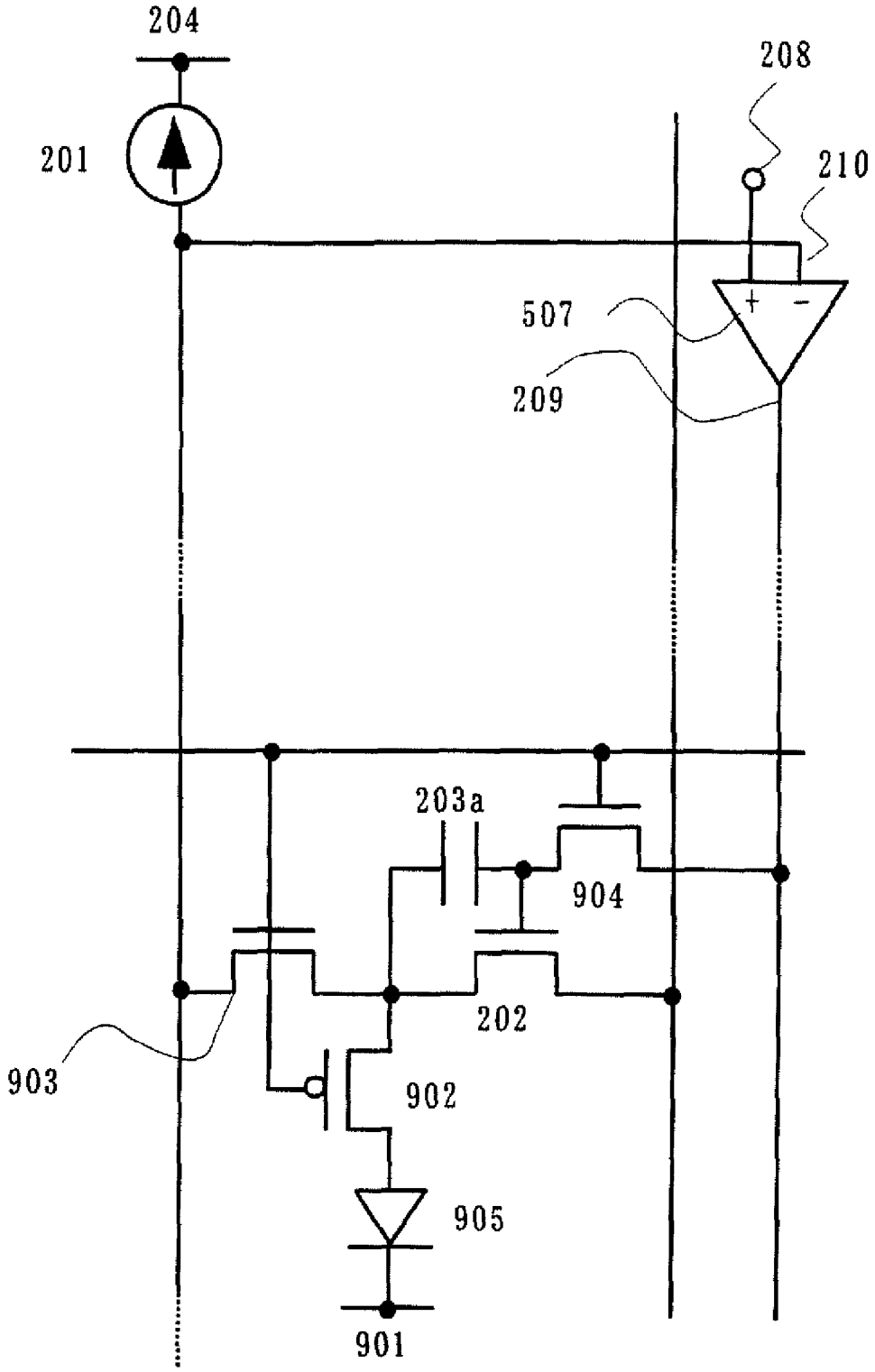
FIG. 28 is a diagram showing a configuration of a semiconductor device of the invention.

First, FIGS. 27 and 28 show the case of a configuration in which the current source circuit 201 supplies a signal current as an image signal. In FIGS. 27 and 28, a direction of current flow is the same, however, polarity of the current source transistor differs. Therefore, a connecting structures are different. Note that an EL element is shown as an example of a load.

In the case where a signal current supplied as an image signal from the current source circuit 201 has an analog value, an image can be displayed in an analog gray scale. In the case where the signal current has a digital value, an image can be displayed in a digital gray scale. In the case where a multi gray scale is to be displayed, a time gray scale method and an area gray scale method are to be combined.

Note that a detailed description of the time gray scale is omitted here, however, a method described in Japanese Patent Application No. 2001-5426 and Japanese Patent Application No. 2000-86968 may be referred to.

Further, a gate line for controlling each switch is shared by controlling polarity of a transistor. Accordingly, an aperture ratio can be improved. However, another gate line may be disposed as well. In the case of using the time gray scale method, in particular, an operation which does not supply a current to a load (EL element) in a certain period is required in some cases. In that case, a gate line for controlling a switch which can stop a current supply to the load (EL element) may be provided as another wiring.

Figure 29:
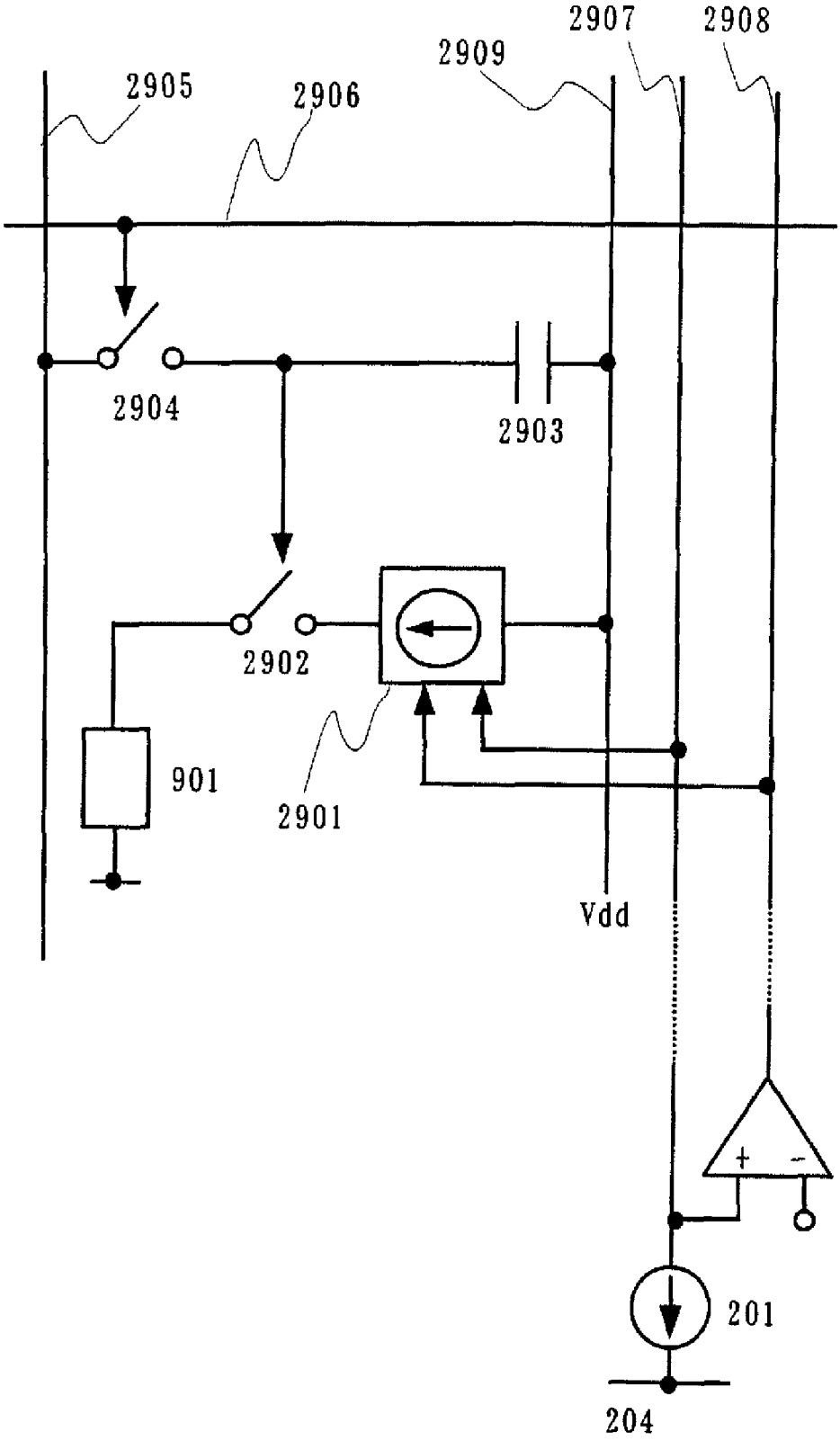
FIG. 29 is a diagram showing a configuration of a semiconductor device of the invention.

Next, FIG. 29 shows a pixel configuration which has a current source circuit in the pixel and displays an image by controlling to supply a current from the current source circuit or not. Here, 2901 denotes a current source circuit, 2902 and 2904 denote switches, 2903 denotes a capacitor, 2905 denotes a signal line, 2906 denotes a selection gate line, and 2907, 2908, and 2909 denote wirings. When the selection gate line 2906 is selected, a digital image signal (normally a voltage value) is inputted from the signal line 2905 to the capacitor 2903. Note that the capacitor 2903 can be omitted by utilizing a gate capacitance of a transistor and the like. The switch 2902 is turned ON/OFF by using a stored digital image signal. The switch 2902 controls if a current supplied from the current source circuit 2901 flows to the load 901 or not. Accordingly, an image can be displayed.

Note that in the case where a multi gray scale is to be displayed, the time gray scale method and the area gray scale method are to be combined.

Further, in FIG. 29, the current source circuit 2901 and the switch 2902 are provided one each, however, the invention is not limited to this. A plurality of pairs thereof may be disposed to control if a current flows from each current source circuit to allow the sum of the currents flows to the load 901.

Figure 30:
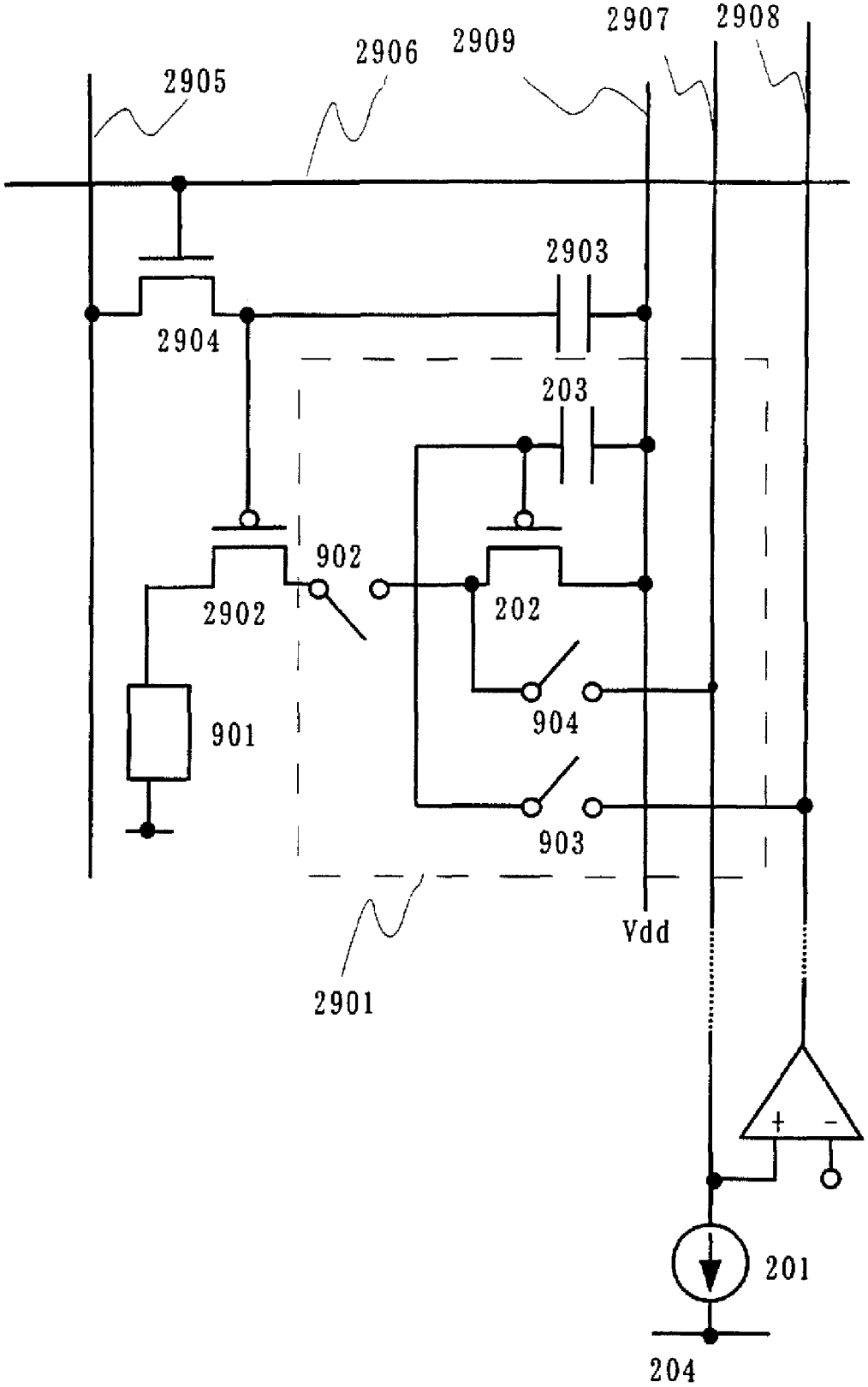
FIG. 30 is a diagram showing a configuration of a semiconductor device of the invention.

Next, FIG. 30 shows a specific configuration example of FIG. 29. Here, a configuration shown in FIG. 1 (FIGS. 9, 2, and 5) is applied as the configuration of a current source transistor. A current is supplied from the current source circuit 201 to the current source transistor 202 to set an appropriate voltage at the gate terminal of the current source transistor. Then, the switch 2902 is turned ON/OFF according to an image signal inputted from the signal line 2905 to supply a current to the load 901, thus an image is displayed.

Note that the content described in this embodiment mode corresponds to the one utilizing the configurations described in Embodiment Modes 1 to 4, however, the invention is not limited to this and various changes can be made as long as the gist thereof is not changed. Therefore, the contents described in Embodiment Modes 1 to 4 can be applied to this embodiment mode as well.

Embodiment Mode 6

In this embodiment mode, a supplying method of a potential to any one of input terminals of an amplifier circuit such as an operational amplifier is described.

The simplest method is to supply a constant potential constantly independently of the size of the current Idata supplied from the current source circuit 101 in FIG. 1, the current source circuit 201 in FIG. 2 and the like. In this case, a voltage source may be connected to any one of input terminals of an amplifier circuit such as an operational amplifier (the second input terminal 110 of the amplifier circuit 107 in FIG. 1, the inverting input terminal 110 of the operational amplifier 407 in FIG. 4, or the first input terminal 108 of the amplifier circuit 107 in FIG. 3, a non-inverting (positive) input terminal 108 of the operational amplifier 407 in FIG. 8 and the like).

In this case, by setting a drain-source voltage of the current source transistor 102 and the like sufficiently high when the size of the current Idata supplied from the current source circuit 201 and the like in FIG. 2 is small, the kink (Early) effect can be reduced. That is, in the case of supplying a small current to a load, it can be prevented that a current flows too much.

Alternatively, an appropriate potential may be supplied to any one of input terminals of an amplifier circuit such as an operational amplifier corresponding to the size of the current Idata so that a drain-source voltage of the current source transistor become approximately equal between when setting a current (set operation) and when outputting a current to a load (output operation). In this case, a voltage source which changes in an analog manner and the like may be connected to the terminal as well as a voltage source which changes in a digital manner.

Otherwise, a potential which is generated by using a different circuit may be supplied to any one of input terminals of an amplifier circuit such as an operational amplifier.

Figure 31:
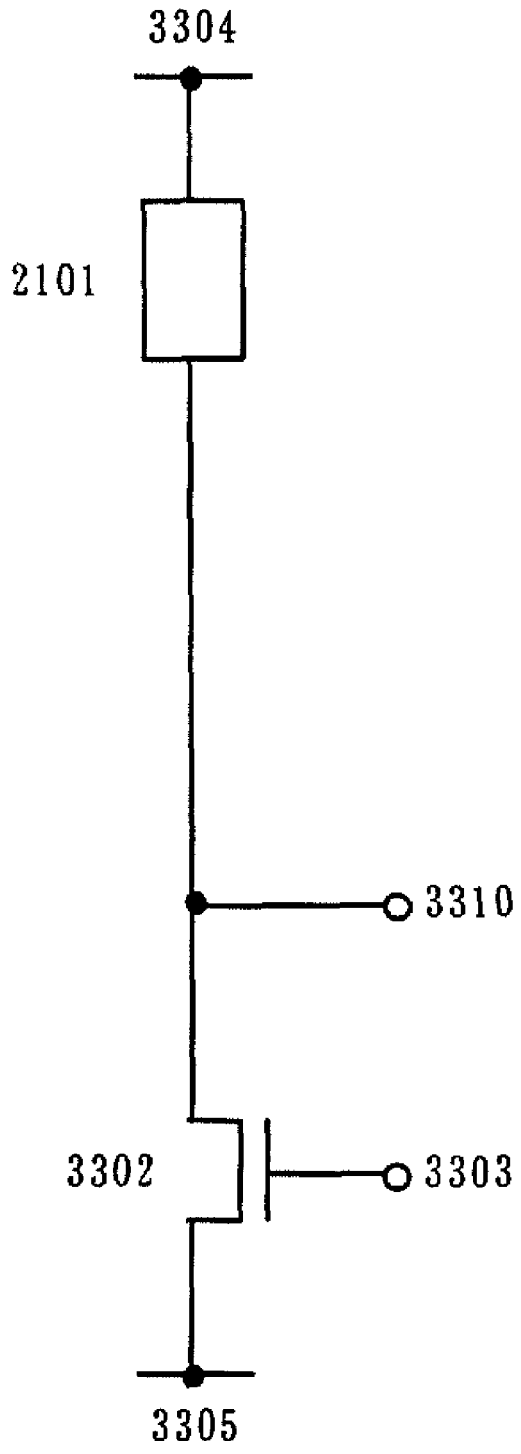
FIG. 31 is a diagram showing a configuration of a semiconductor device of the invention.
Figure 32:
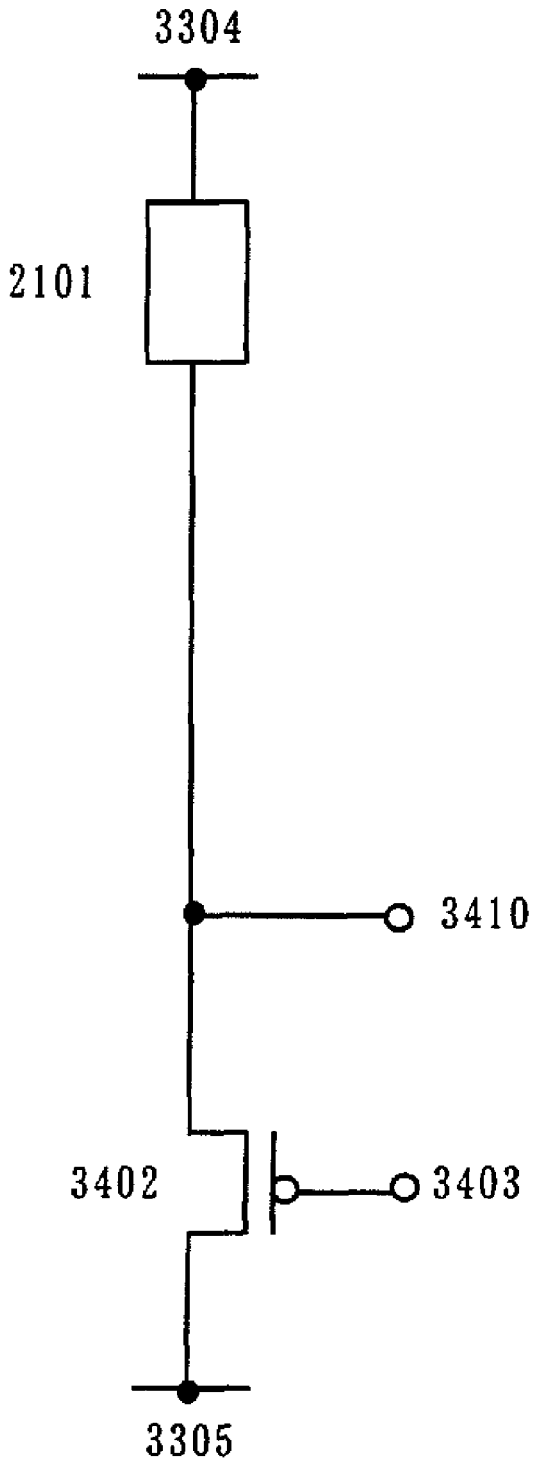
FIG. 32 is a diagram showing a configuration of a semiconductor device of the invention.

FIGS. 31 and 32 show examples of a circuit which generates a potential. Potentials which are generated at terminals 3310 and 3410 by a circuit 2101 and transistors 3302 and 3402 respectively may be supplied to any one of input terminals of an amplifier circuit such as an operational amplifier. Note that the terminal 3310 or the terminal 3410 may be directly connected to any one of input terminals of an amplifier circuit such as an operational amplifier or through an element, a circuit and the like.

Moreover, potentials of the terminals 3310 and 3410 may be controlled by controlling potentials of gate terminals 3303 and 3404 of the transistors 3302 and 3402 and controlling characteristics of the circuit 2101.

For example, the gate terminals 3303 and 3403 of the transistors 3302 and 3402 may be connected to drain terminals and source terminals of the transistors 3302 and 3402 respectively or to a gate terminal of a current source transistor (corresponds to the current source transistor 102 in the case of FIG. 1) and the like.

Further, the transistors 3302 and 3402 may be shared as transistors for other uses.

Figure 33:
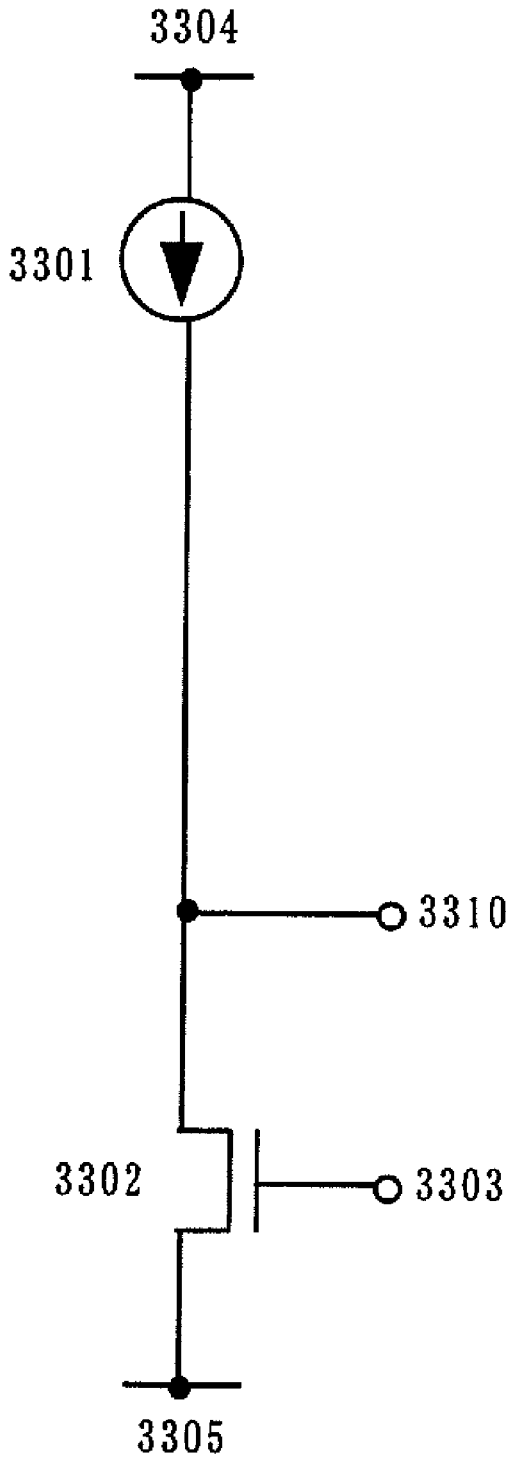
FIG. 33 is a diagram showing a configuration of a semiconductor device of the invention.
Figure 34:
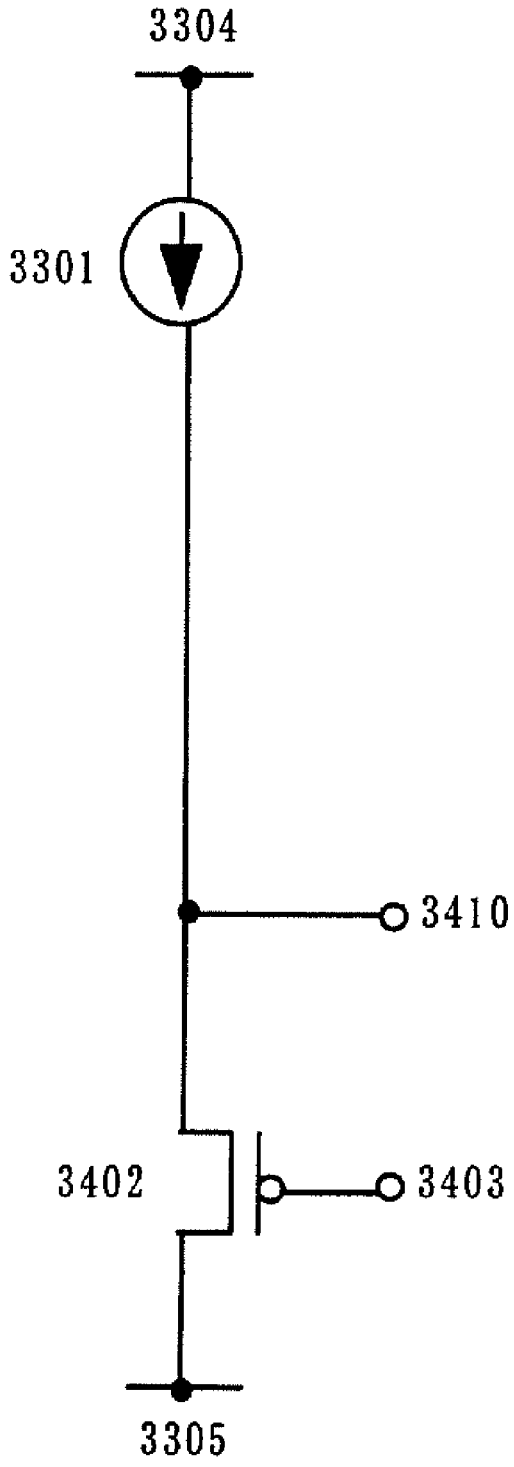
FIG. 34 is a diagram showing a configuration of a semiconductor device of the invention.

Further, the circuit 2101 may be a current source circuit as shown in FIGS. 33 and 34. In that case, the current source circuit may be a current source circuit (corresponds to the current source circuit 101 in FIG. 1) which supplies a current Idata to a current source transistor (corresponds to the current source transistor 102 in FIG. 1) or other current source circuits. In that case, the current source circuit which supplies the current Idata and the size of a current to be supplied may be the same or in proportion to each other.

Figure 35:
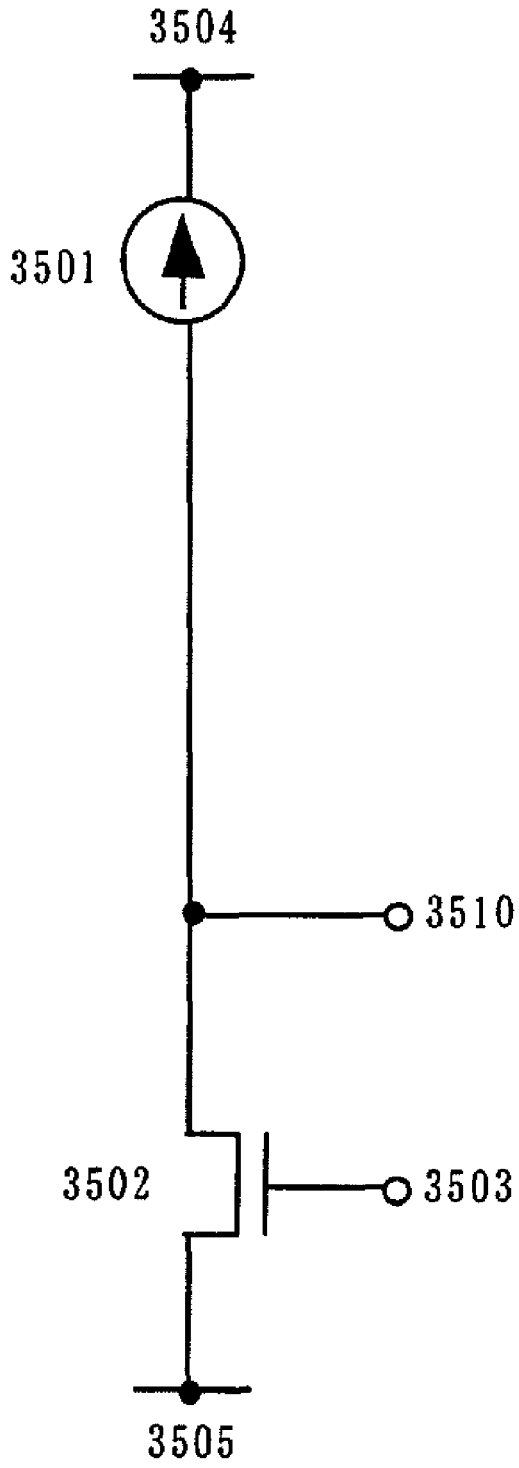
FIG. 35 is a diagram showing a configuration of a semiconductor device of the invention.

Further, a direction of current flow may be opposite as shown in FIG. 35. Here, 3501 denotes a current source circuit, 3502 denotes a current source transistor, 3503 denotes a gate terminal of 3502, and 3510 denotes a terminal.

Further, the circuit 2101 may be a load. Note that the load may be an element such as a resistor, a transistor, an EL element, other light emitting elements, a current source circuit configured with a transistor, a capacitor, a switch and the like, a wiring connected to an arbitrary circuit, a signal line, or a signal line and a pixel connected to it. The pixel may include an EL element, an element used in an FED, or other elements driven by a current flowing therethrough.

Note that the load may be a load (corresponds to the load 901 in FIG. 1) to which a current source transistor (corresponds to the current source transistor 102 in FIG. 1) supplies a current in the output operation, or a different load as well. In that case, the different load may be the same or in proportion to each other in voltage-current characteristics to the load to which a current is supplied in the output operation.

A supplying method of a potential to any one of input terminals of an amplifier circuit such as an operational amplifier described in this embodiment mode can be implemented in combination with Embodiment Modes 1 to 5.

Embodiment Mode 7

In this embodiment mode, a specific preferred example of the configuration described in Embodiment Mode 6 is described.

Figure 36:
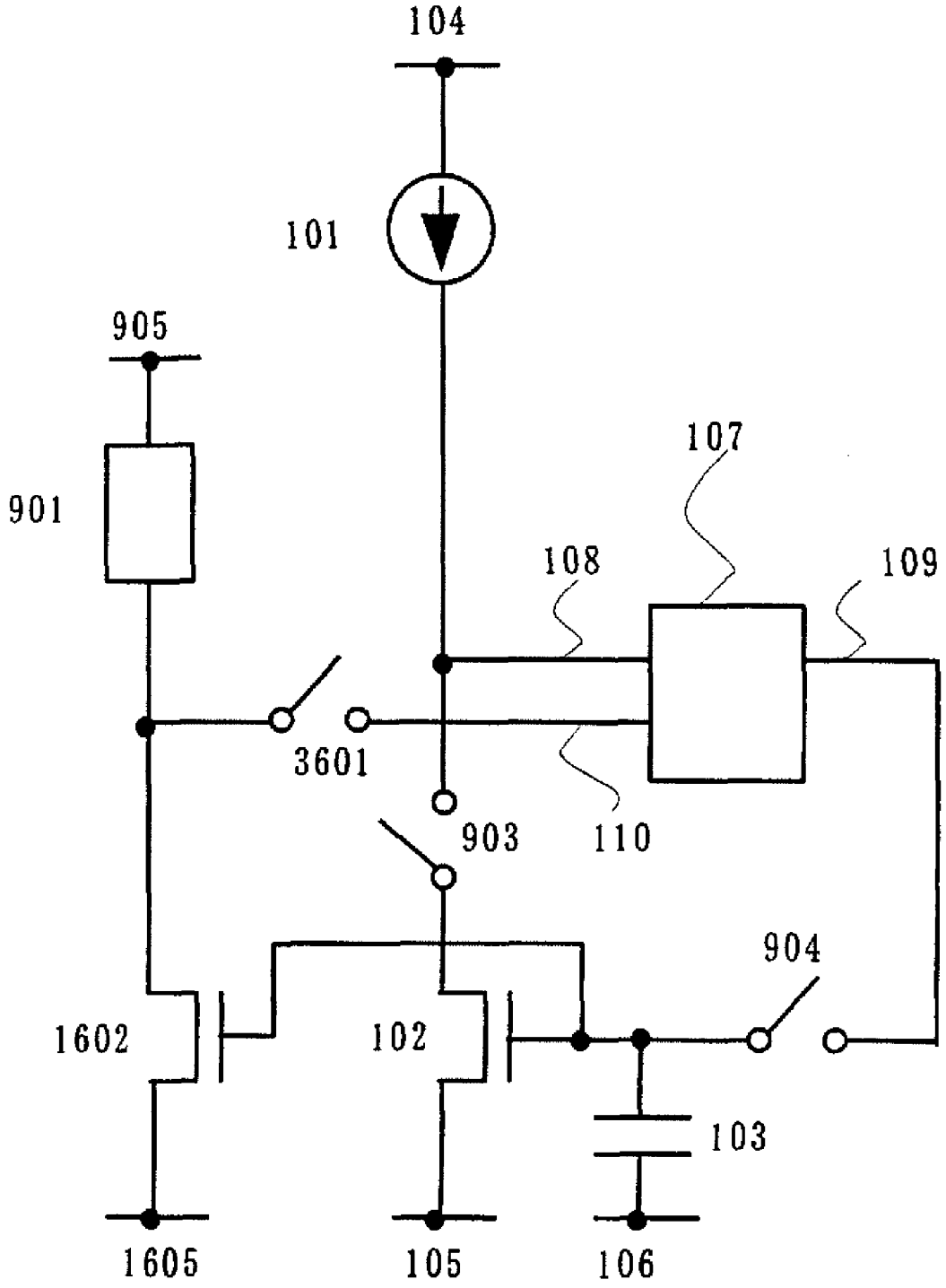
FIG. 36 is a diagram showing a configuration of a semiconductor device of the invention.

FIG. 36 shows a configuration in the case of combining FIG. 31 and FIG. 16. In FIG. 36, a load is the load 901 to which a current is supplied in the output operation. The transistor 3302 in FIG. 31 is shared with the current transistor 1602 in FIG. 16. The second input terminal 110 of the amplifier circuit 107 is connected to the terminal 3310 (a drain terminal of the transistor 1602) through a switch 3601. However, the invention is not limited to this and the switch 3601 may be removed as long as an operation is not disturbed.

Figure 37:
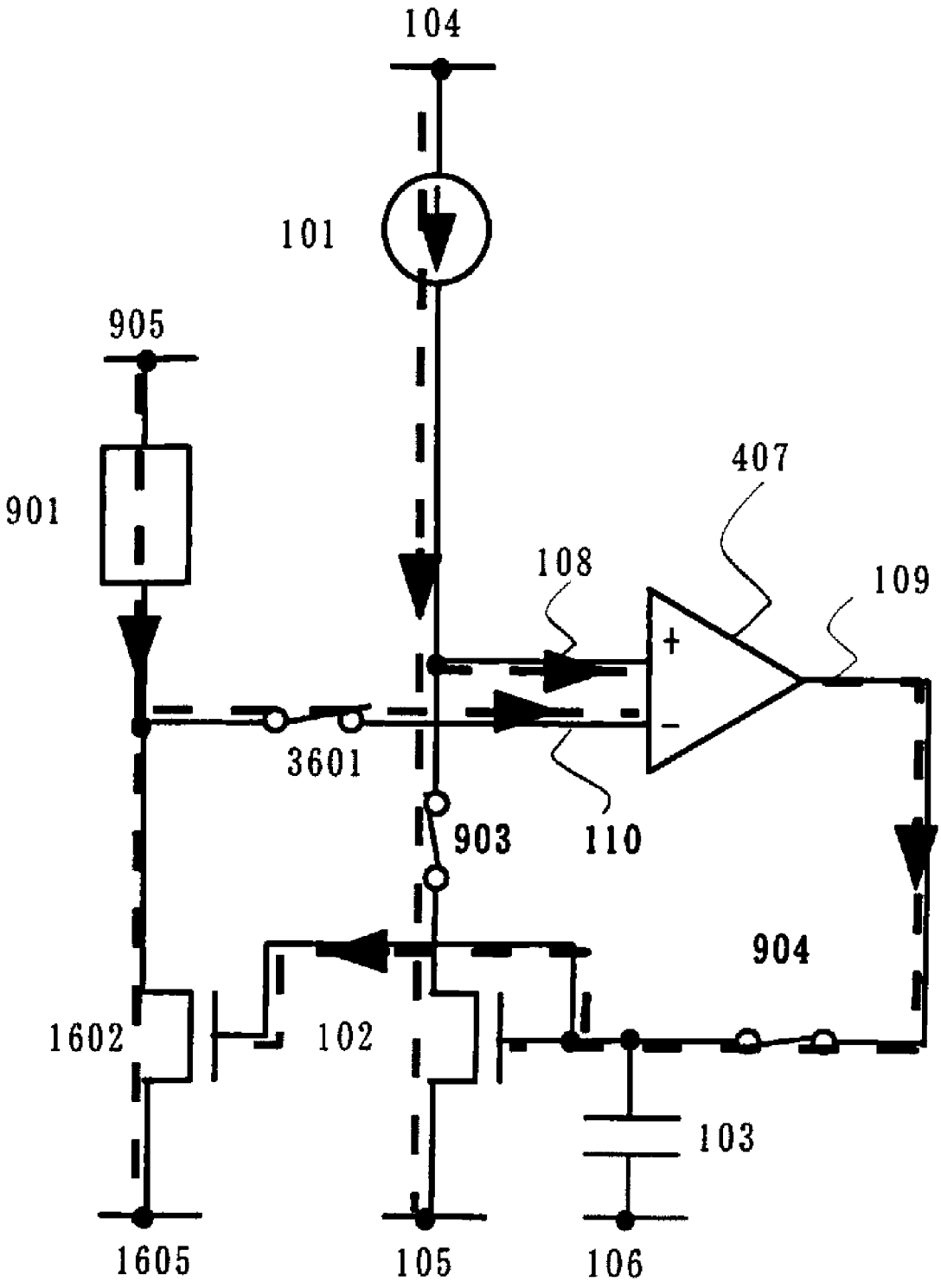
FIG. 37 is a diagram showing an operation of a semiconductor device of the invention.
Figure 38:
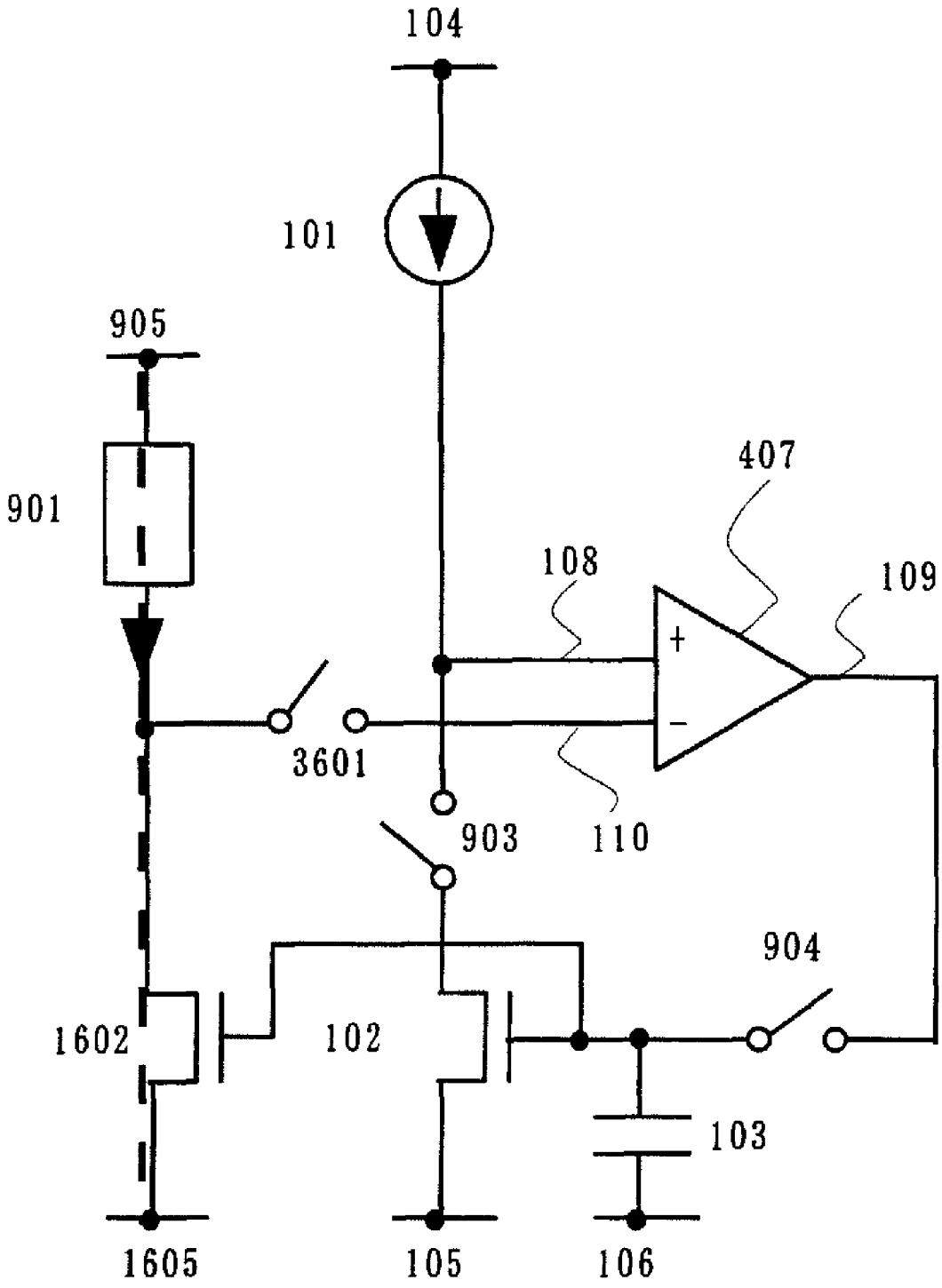
FIG. 38 is a diagram showing an operation of a semiconductor device of the invention.

Next, an operation of the configuration of FIG. 36 is described. First, the switches 903, 904, and 3601 are turned ON as shown in FIG. 37 to perform the set operation. At this time, the operation is performed so that potentials of drain terminals of the transistor 1602 and 102 become approximately the same by an operation of the operational amplifier 407. Next, the switches 903, 904, and 3601 are turned OFF to perform the output operation as shown in FIG. 38. By operating as described above, Vgs and Vds can be approximately the same between the set operation and the output operation.

Figure 39:
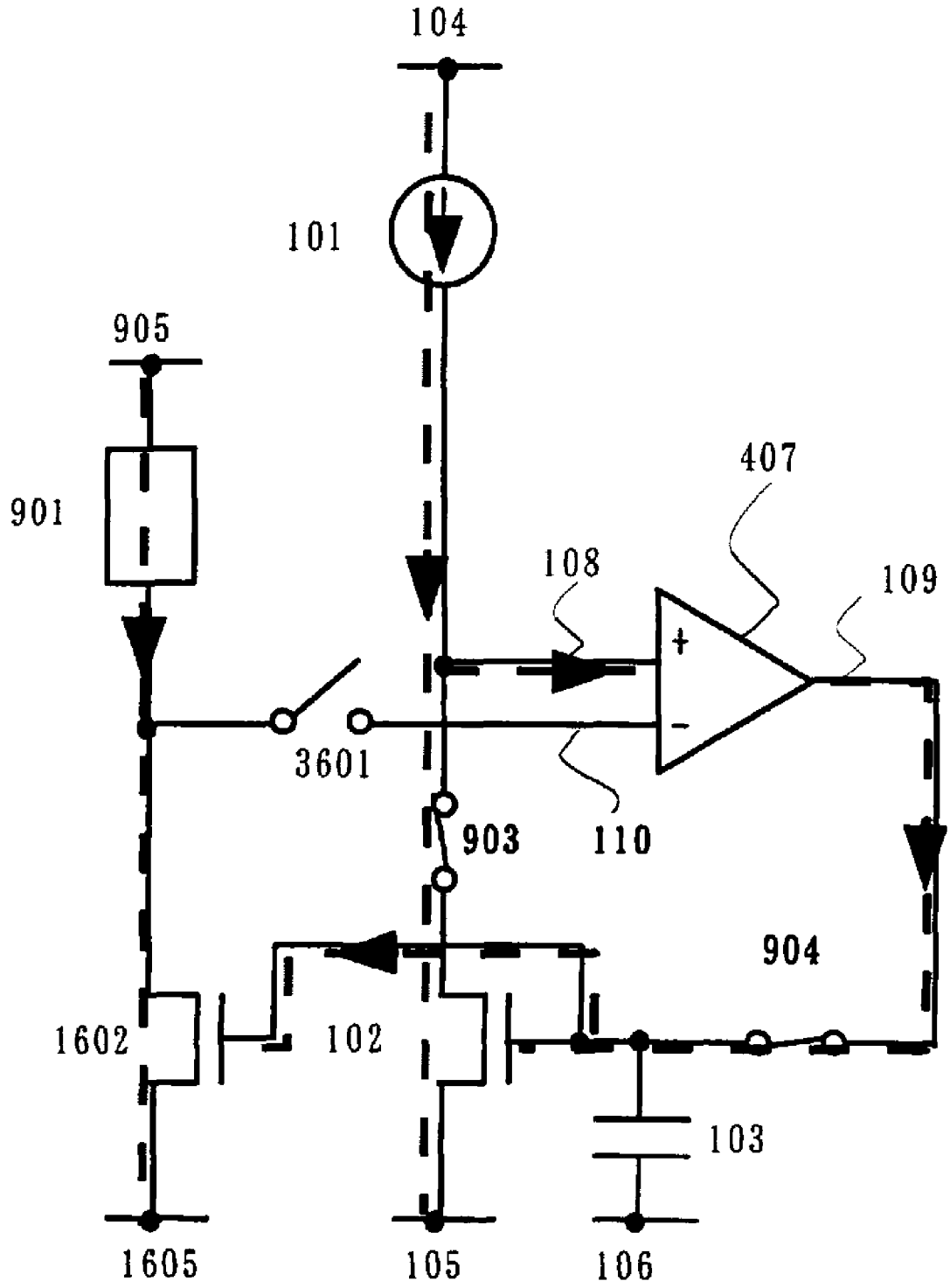
FIG. 39 is a diagram showing an operation of a semiconductor device of the invention.

An operation as shown in FIG. 39 may be provided between FIG. 37 and FIG. 38. That is, the switch 3601 is turned OFF after FIG. 37 to obtain the state in which a potential of the second input terminal 110 does not change, thus the set operation may be continued.

Figure 40:
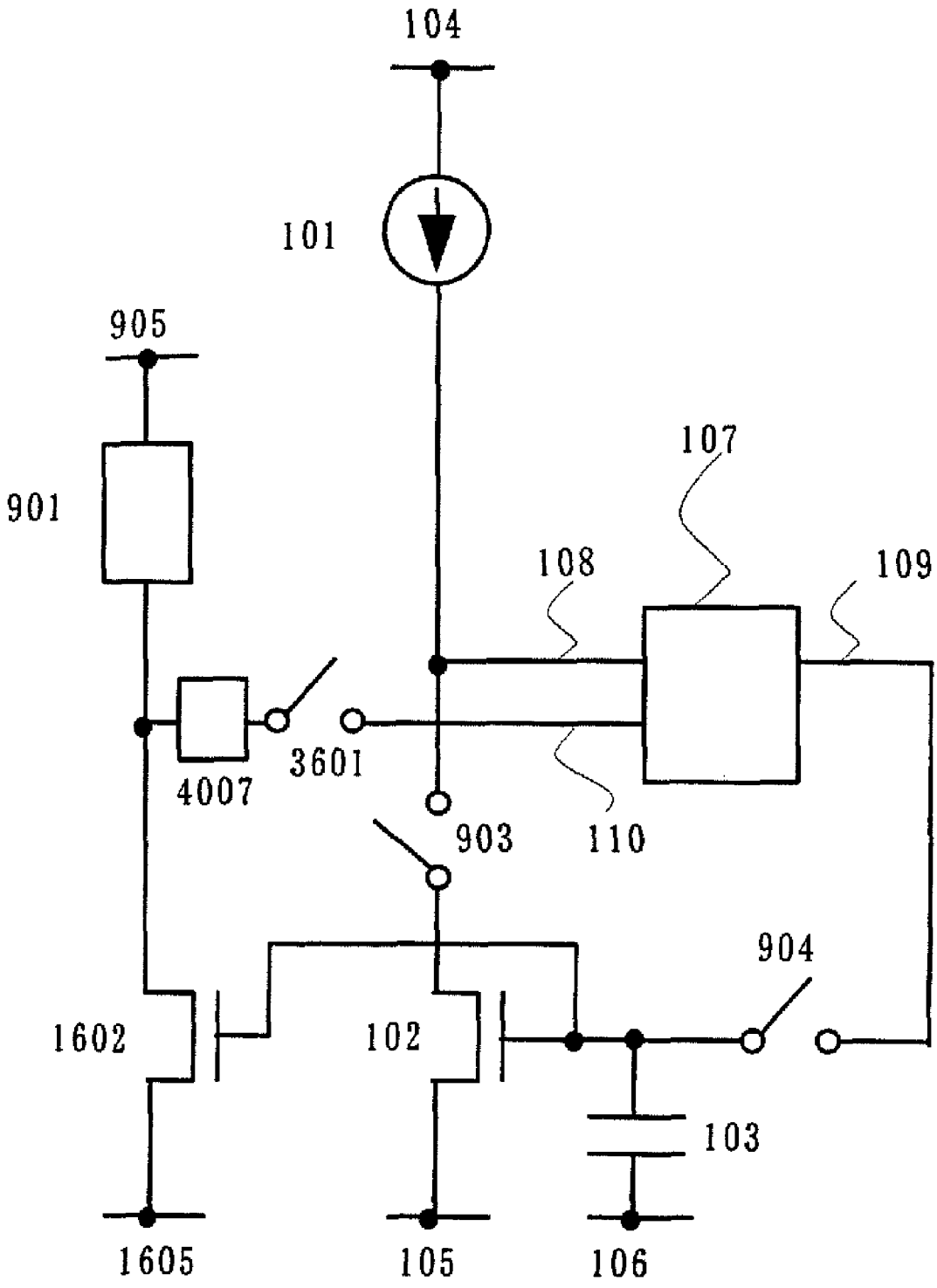
FIG. 40 is a diagram showing a configuration of a semiconductor device of the invention.

Note that the second input terminal 110 of the amplifier circuit 107 is connected to the terminal 3310 (a drain terminal of the transistor 1602) through the switch 3601, however, the invention is not limited to this and an amplifier circuit 4007 may be connected therebetween as shown in FIG. 40. Various circuits such as a voltage follower circuit, a source follower circuit, and an operational amplifier may be used as an amplifier circuit. Further, a circuit of which output potential rises when an input potential thereof rises, or a circuit of which output potential falls may be used as well. A feedback circuit may be formed so that a circuit as a whole is stabilized.

Figure 41:
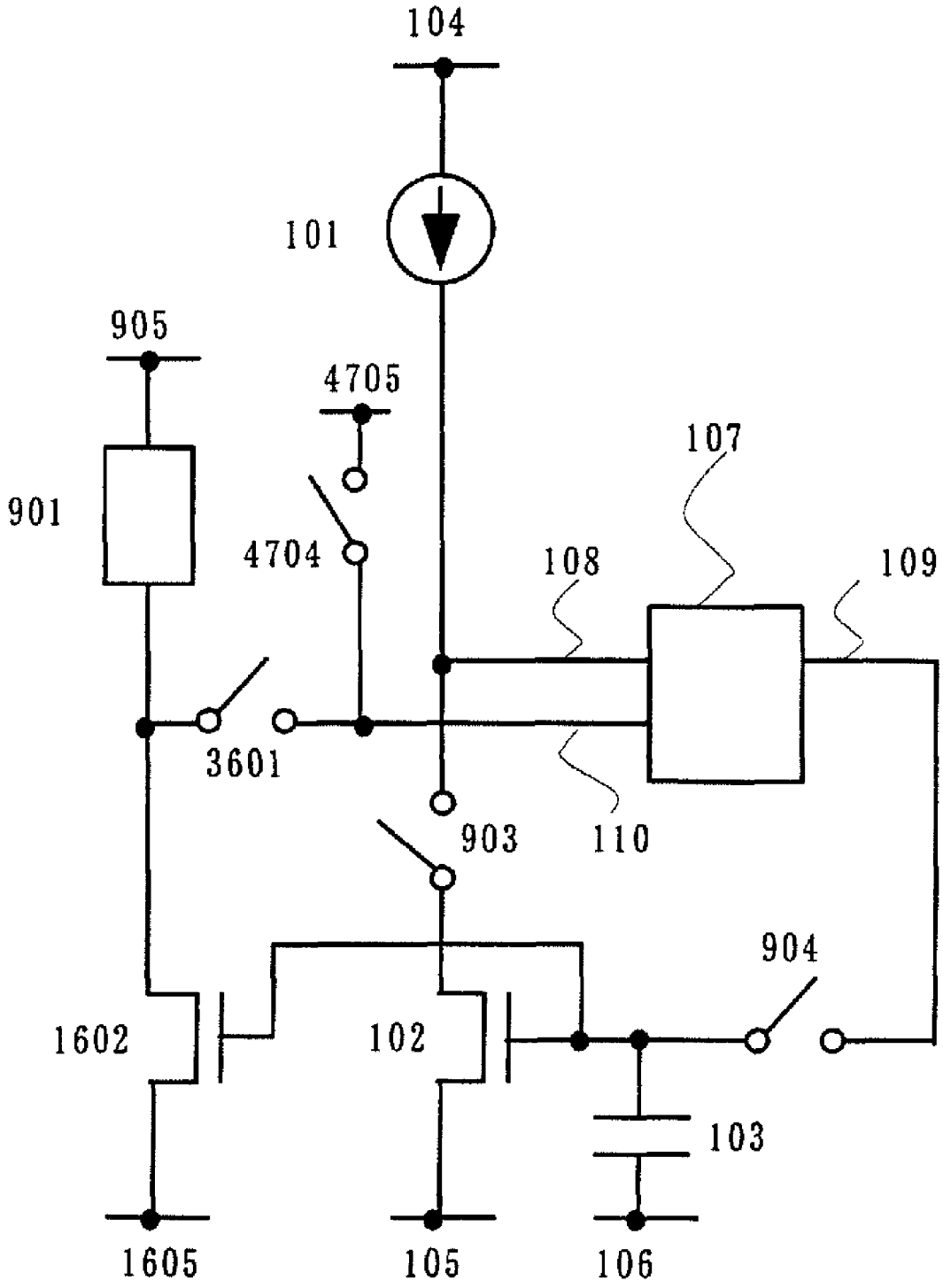
FIG. 41 is a diagram showing a configuration of a semiconductor device of the invention.
Figure 42:
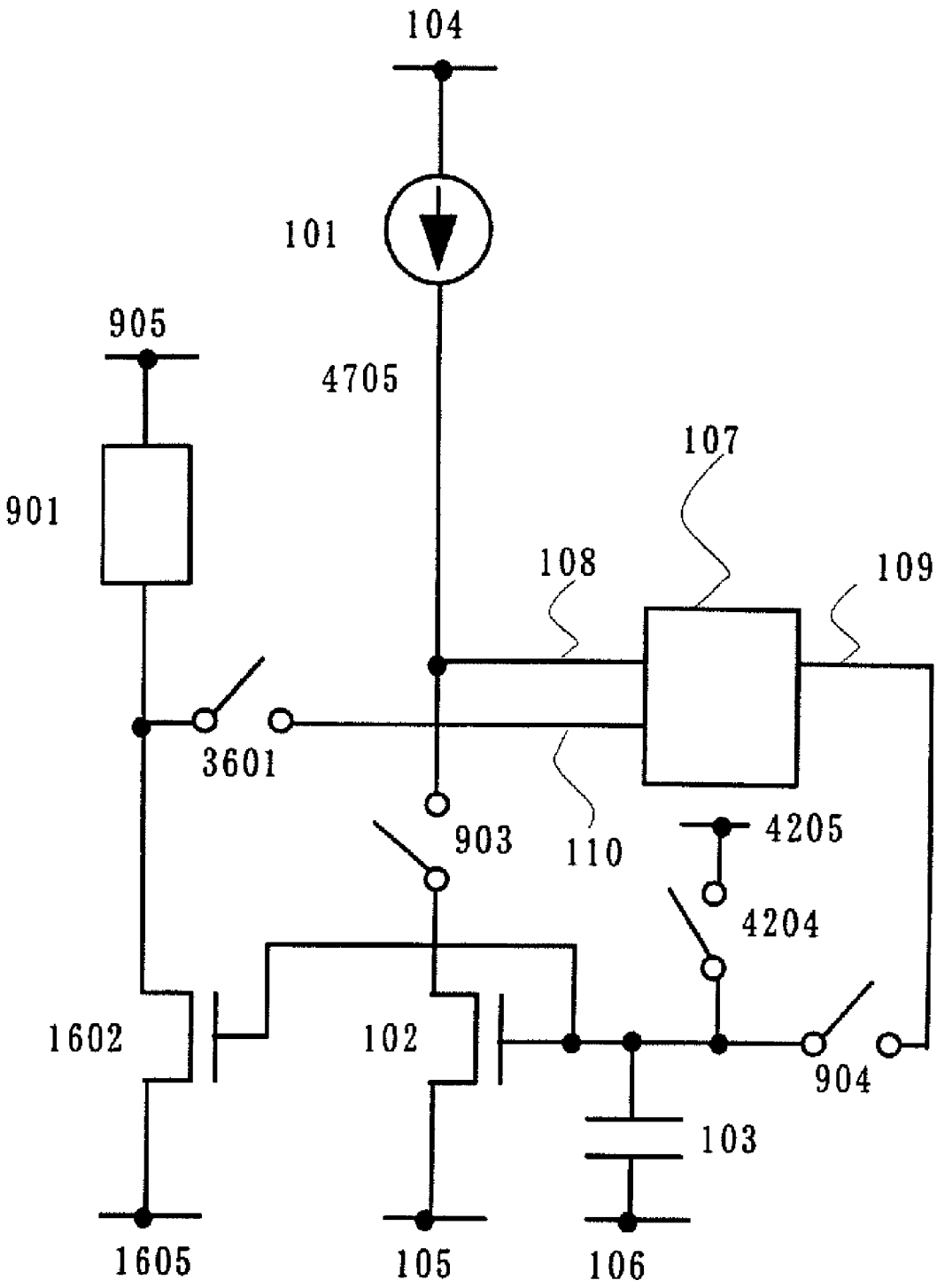
FIG. 42 is a diagram showing a configuration of a semiconductor device of the invention.
Figure 43:
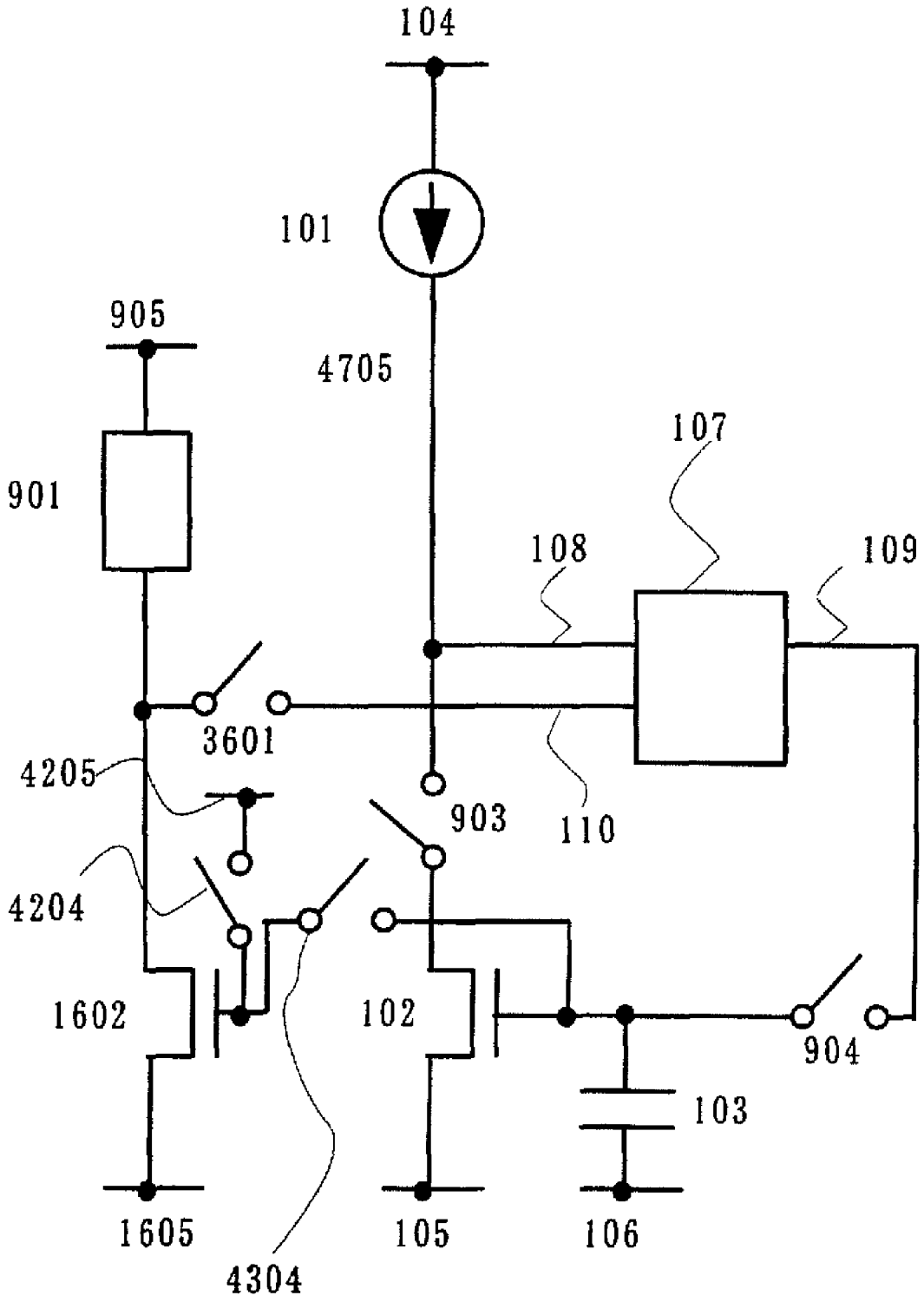
FIG. 43 is a diagram showing a configuration of a semiconductor device of the invention.

Note that an initial condition may be set in FIG. 36 and FIG. 40. That is, a certain terminal, a wiring, a connection node and the like are initialized to a certain potential as shown in FIGS. 41 to 43. After operating once with such a condition, a normal set operation may be performed.

Figure 44:
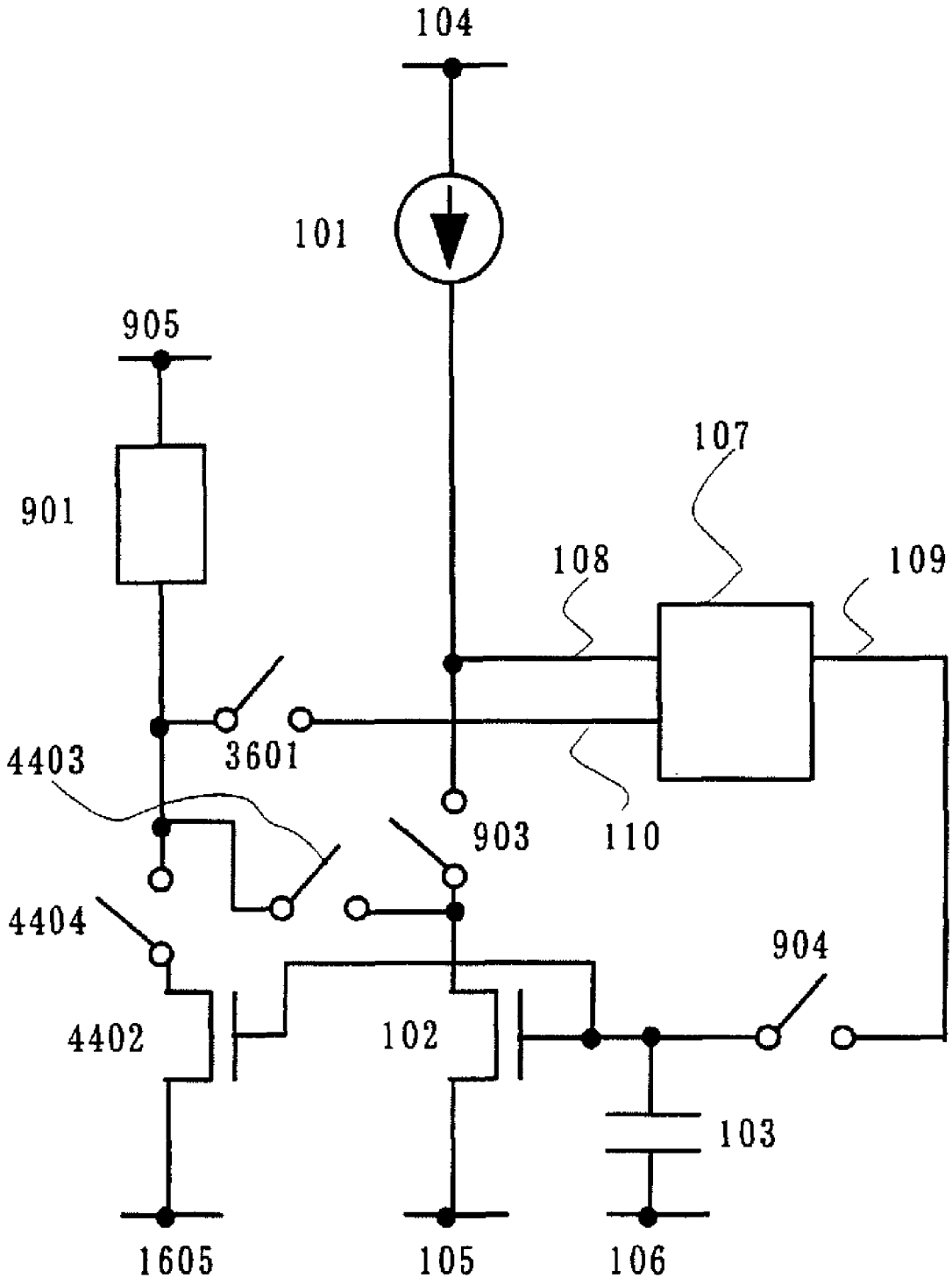
FIG. 44 is a diagram showing a configuration of a semiconductor device of the invention.
Figure 45:
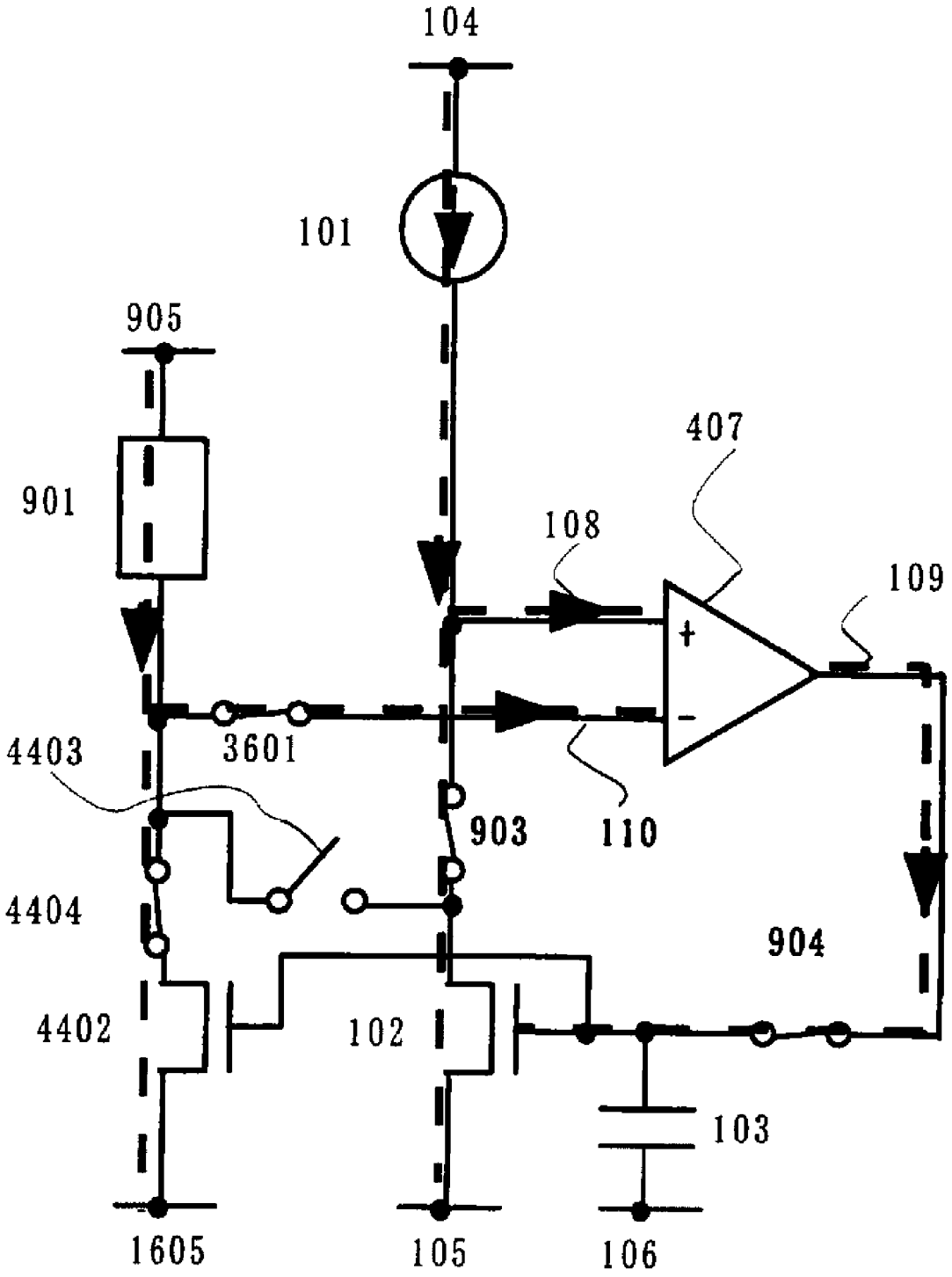
FIG. 45 is a diagram showing an operation of a semiconductor device of the invention.
Figure 46:
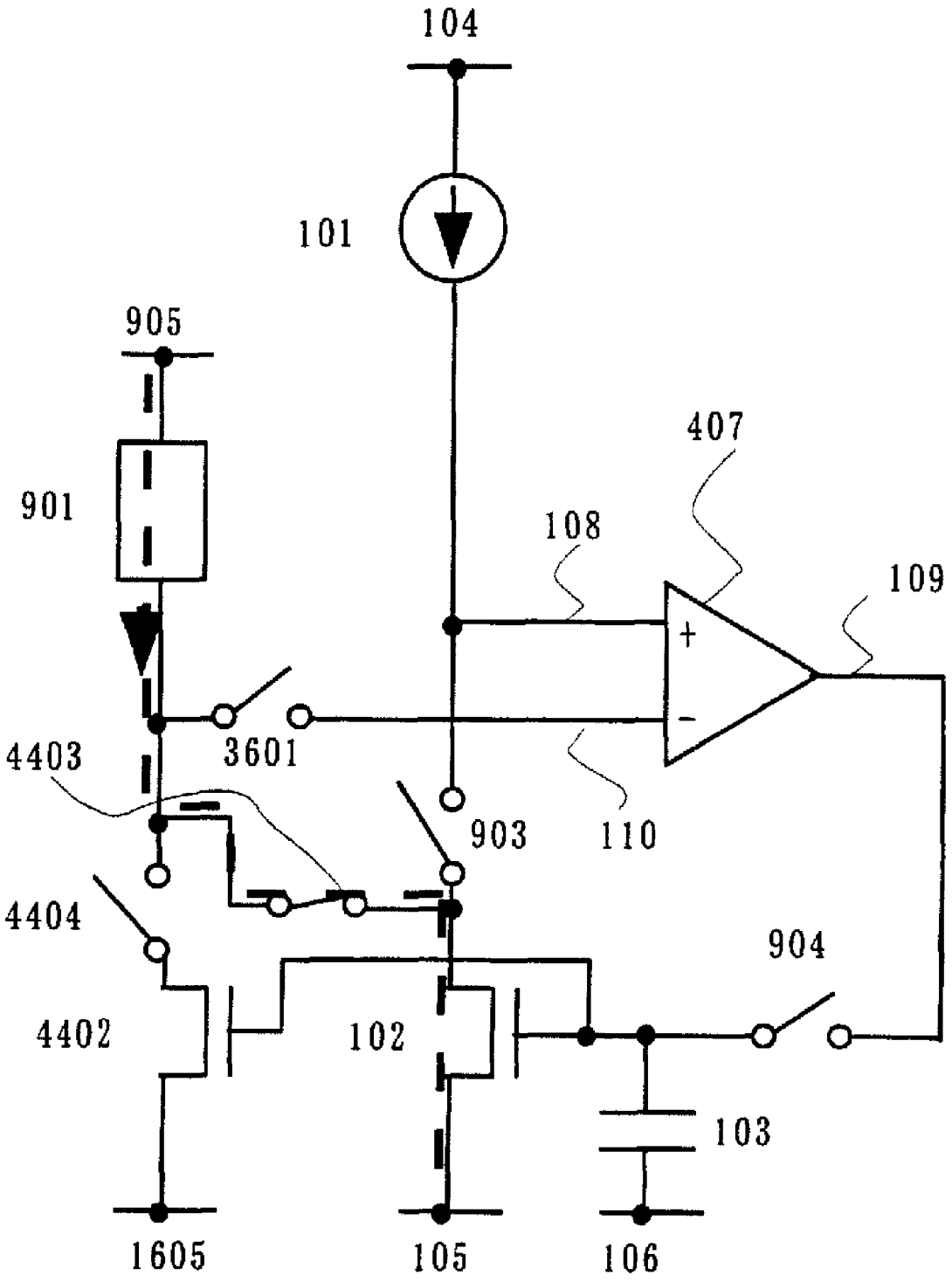
FIG. 46 is a diagram showing an operation of a semiconductor device of the invention.

In the case of the configuration of FIG. 36 and the like, a transistor to which a current is supplied in the set operation (the transistor 102 in FIG. 36) and a transistor to which a current is supplied in the output operation (the transistor 1602 in FIG. 36) are not the same transistor. Therefore, current characteristics of those transistors varying, a current supplied to the load 901 also varies. Then, FIG. 44 shows the case of sharing the same transistor in the set operation and the output operation. First, the switches 3601, 4404, 903, and 904 are turned ON and a switch 4403 is turned OFF in the set operation as shown in FIG. 45. Then, the second input terminal 110 of the amplifier circuit 107 is connected to a drain terminal of the transistor 1802 through the switch 3601. Then, the switches 3601, 4404, 903, and 904 are turned OFF and the switch 4403 is turned ON in the output operation as shown in FIG. 46. Then, a current is supplied to the load 901 by using the transistor 102.

Accordingly, a current is supplied by using the same transistor with the same Vgs in the set operation and the output operation. However, Vds is affected by the variation since the same transistor is not used. However, effect of variation is small in the case of operating the transistor in a saturation region in the set operation and the output operation.

Figure 47:
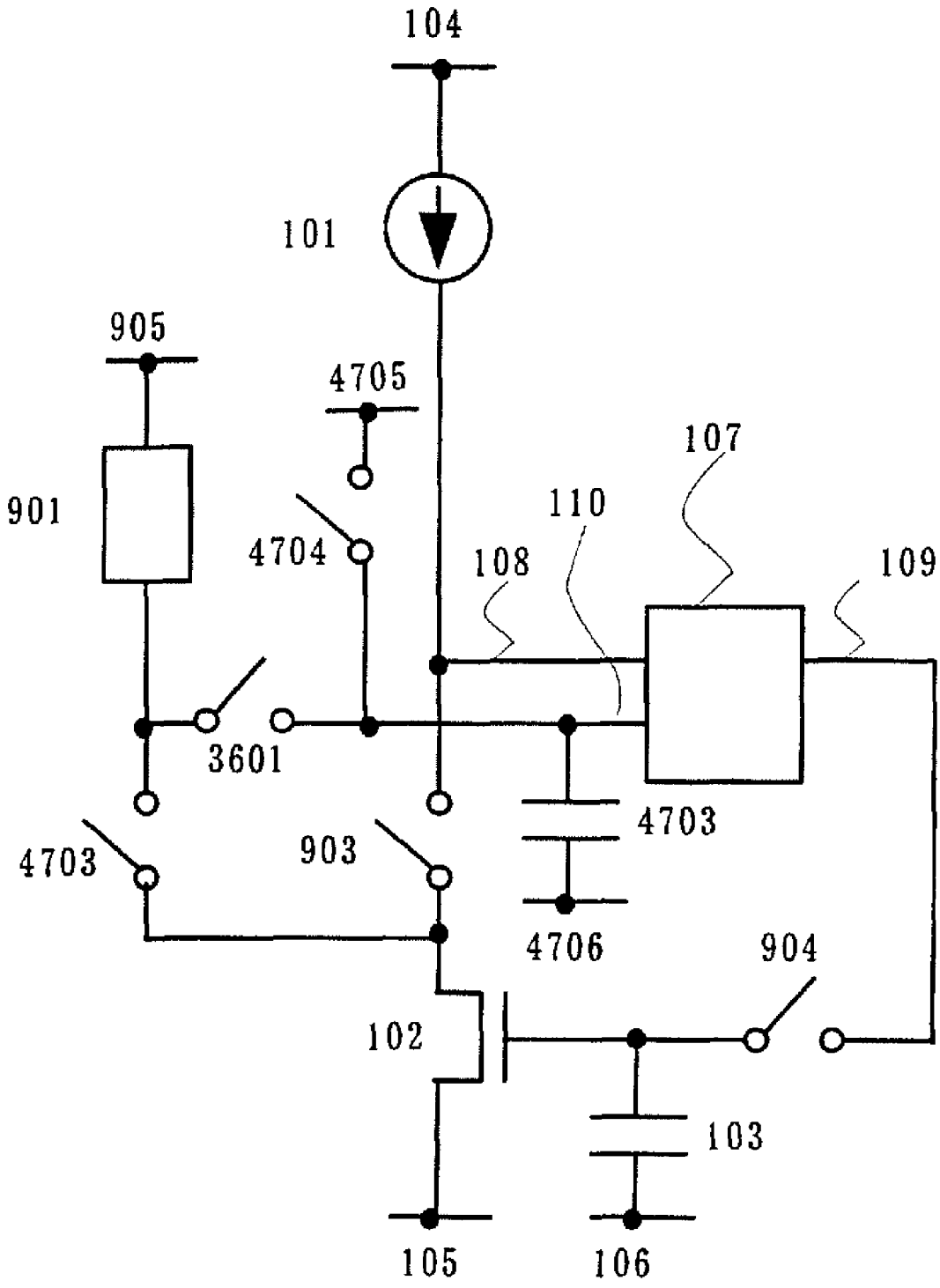
FIG. 47 is a diagram showing a configuration of a semiconductor device of the invention.

Next, the case where the same transistor is used in the set operation and the output operation with the same Vgs and the same Vds is described. FIG. 47 shows a configuration at that time. In that case, a similar operation is required to be repeated arbitrary times in order to make Vgs and Vds approximately the same in the set operation and the output operation.

Figure 48:
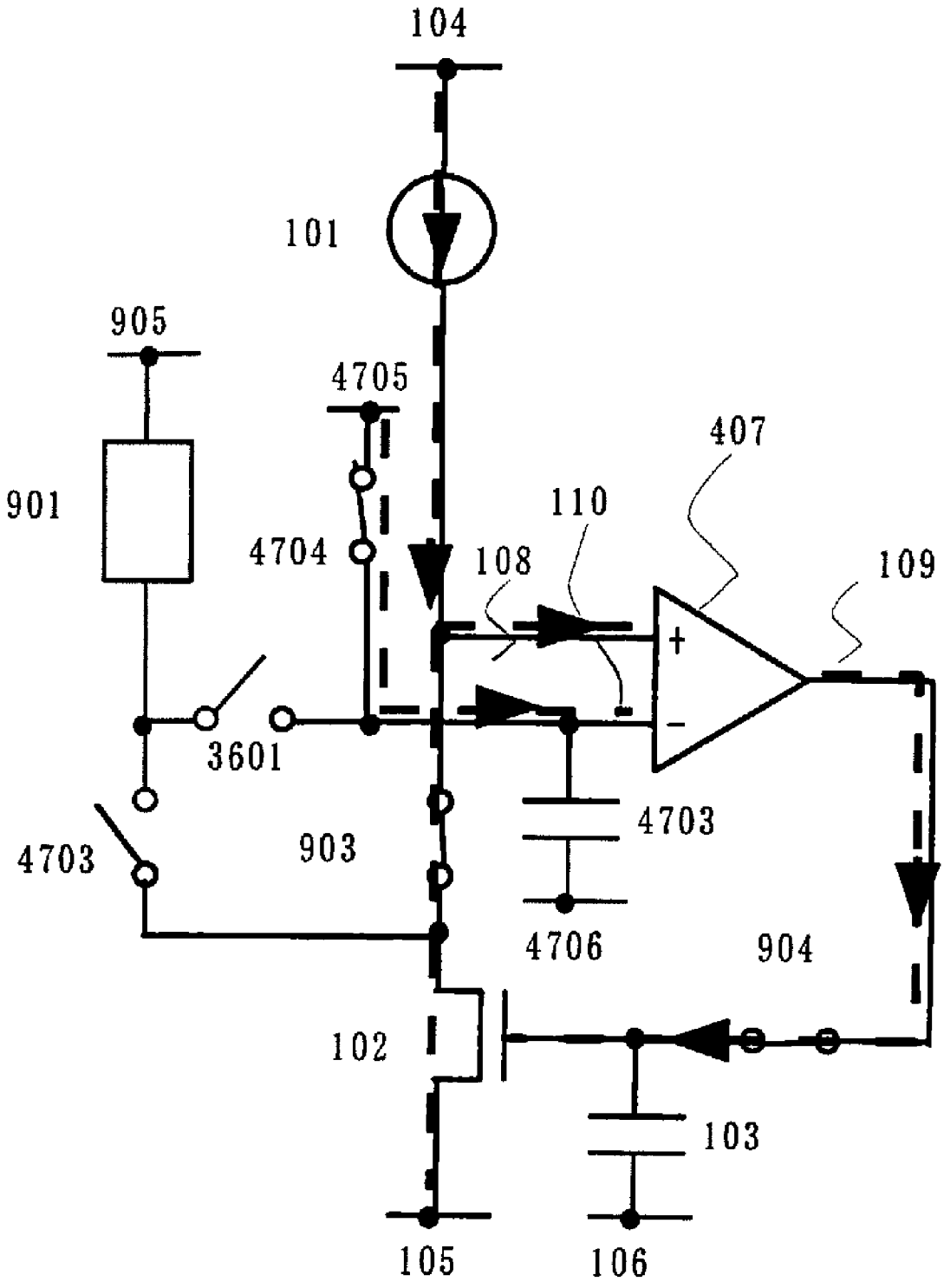
FIG. 48 is a diagram showing an operation of a semiconductor device of the invention.
Figure 49:
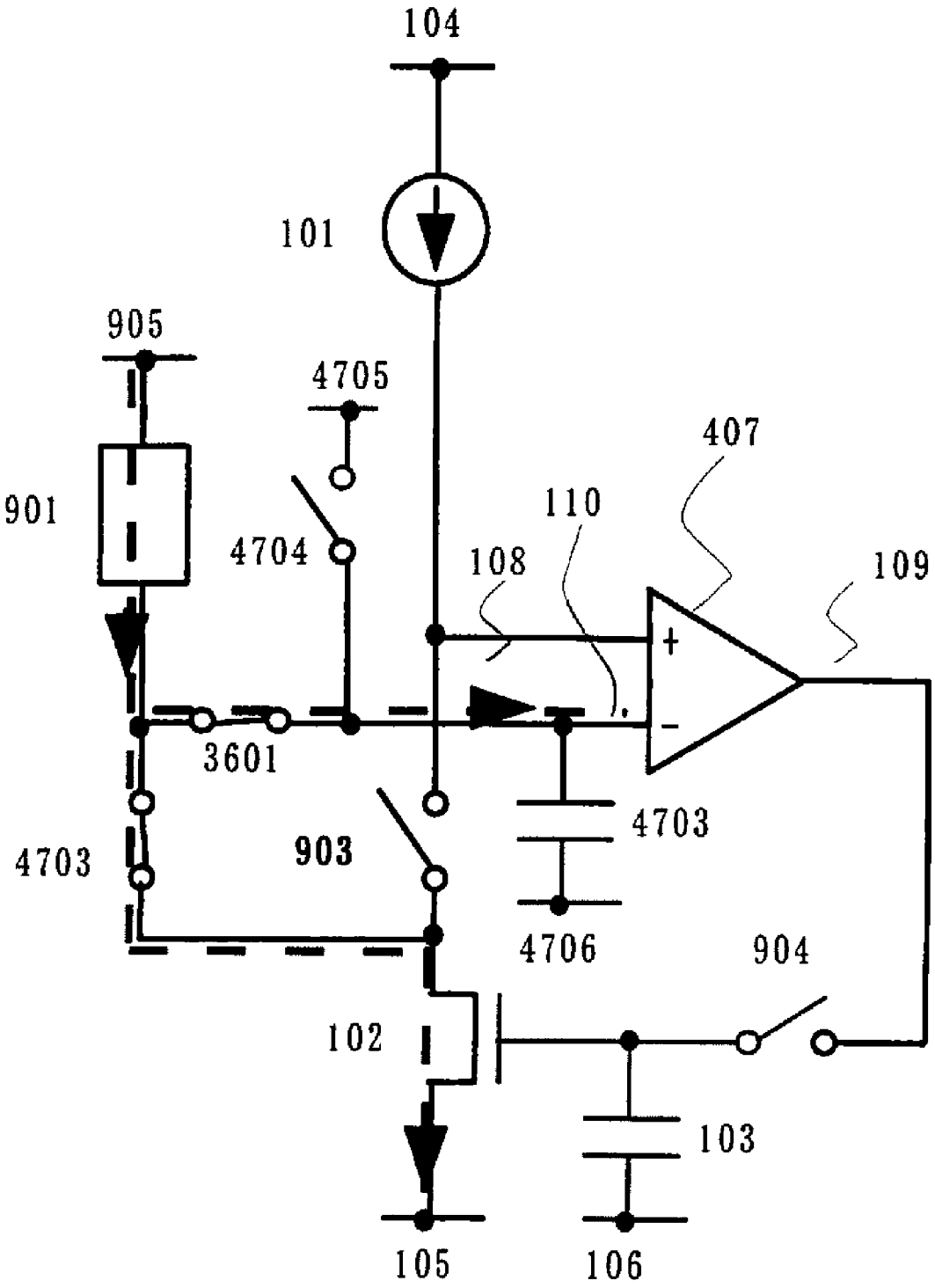
FIG. 49 is a diagram showing an operation of a semiconductor device of the invention.
Figure 50:
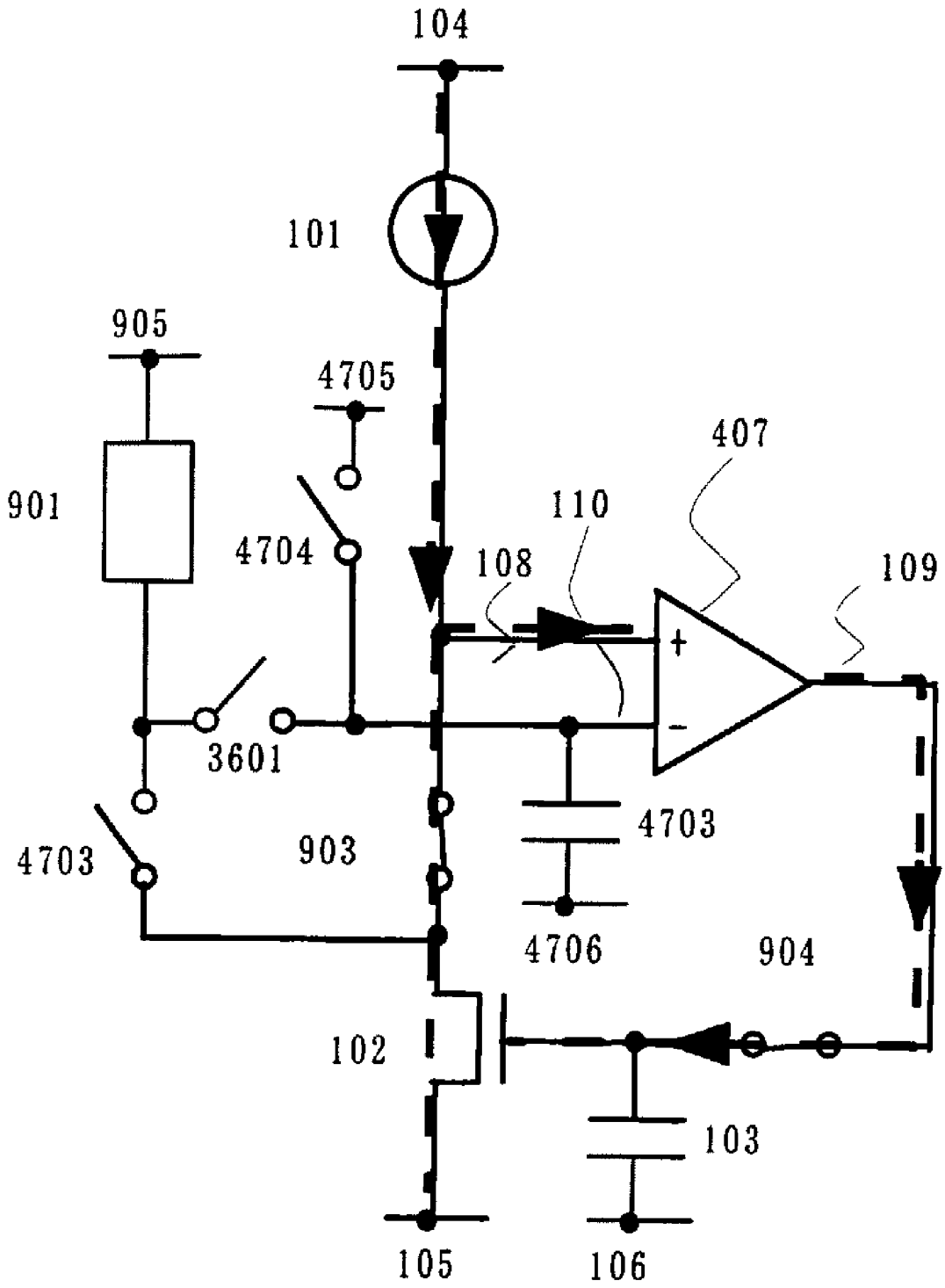
FIG. 50 is a diagram showing an operation of a semiconductor device of the invention.

First, the switches 4704, 903, and 904 are turned ON as shown in FIG. 48. This corresponds to an initialization operation. That is, a potential is supplied from a wiring 4705 and inputted to the terminal 110 to perform the set operation. According to this set operation, a gate potential of the transistor 102 is set, based on which a current is supplied to the load 901 as shown in FIG. 49. This is a similar operation to the output operation, in which a drain potential of the transistor 102 is stored in a capacitor 4703. Subsequently, the set operation is performed again by using the potential stored in the capacitor 4703 as shown in FIG. 50. At this time, a potential approximately equal to that in the output operation is stored in the capacitor 4703. Therefore, in the set operation in FIG. 50, Vds of the transistor 102 is approximately equal to Vds in the output operation. After that, a current is supplied to the load 901 to perform the output operation as shown in FIG. 51.

Figure 51:
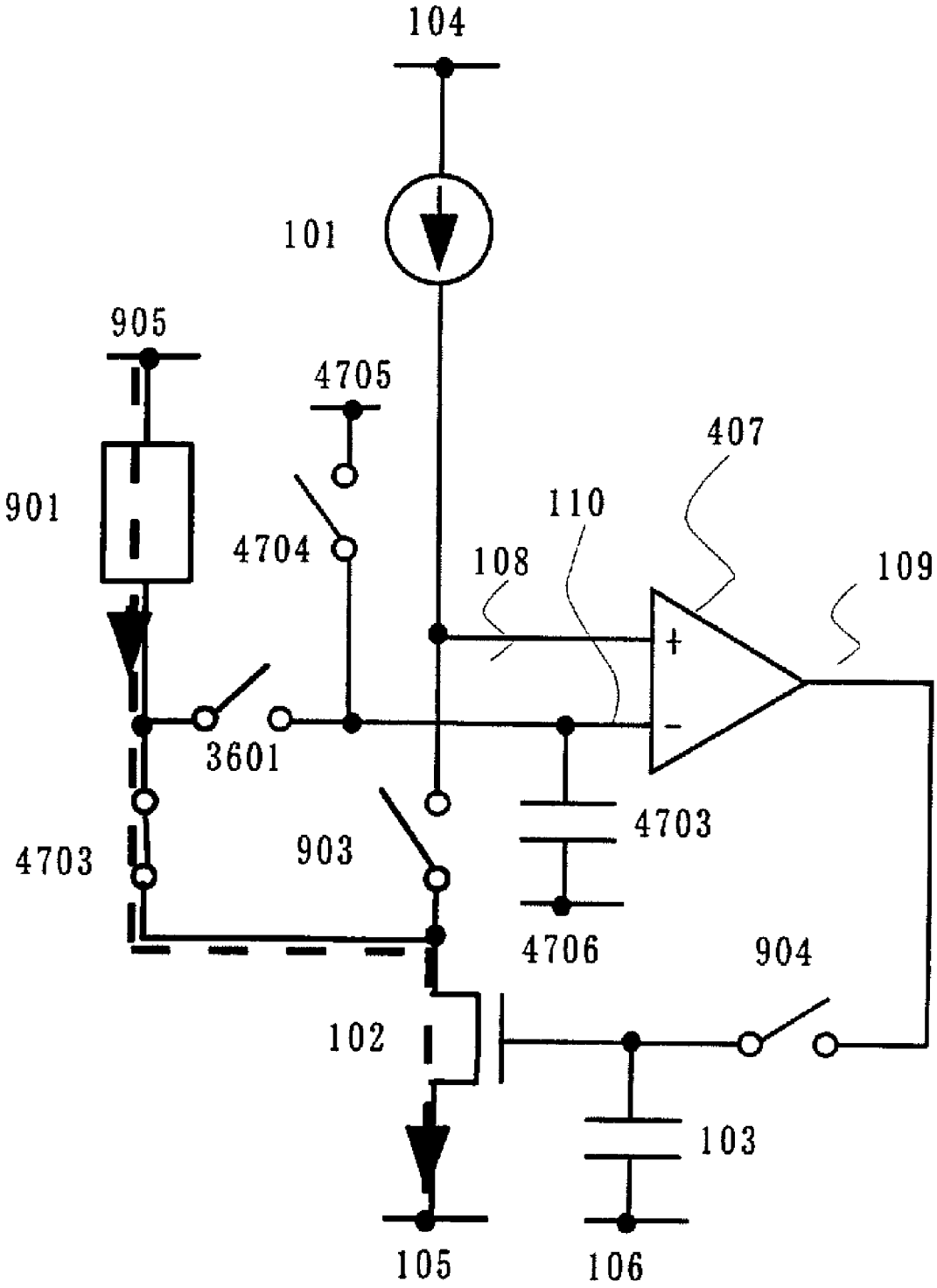
FIG. 51 is a diagram showing an operation of a semiconductor device of the invention.

Note that the output operation is performed as shown in FIG. 51 after the operation of FIG. 50, however, the invention is not limited to this. A potential may again be stored in the capacitor 4703 as shown in FIG. 49 and the set operation may be performed as shown in FIG. 50. Moreover, the operations of FIGS. 49 and 50 may be repeated arbitrary times. By repeating like this, the values of Vgs and Vds of the transistor 102 in the output operation and the values of Vgs and Vds of the transistor 102 in the set operation approach each other respectively.

Figure 64:
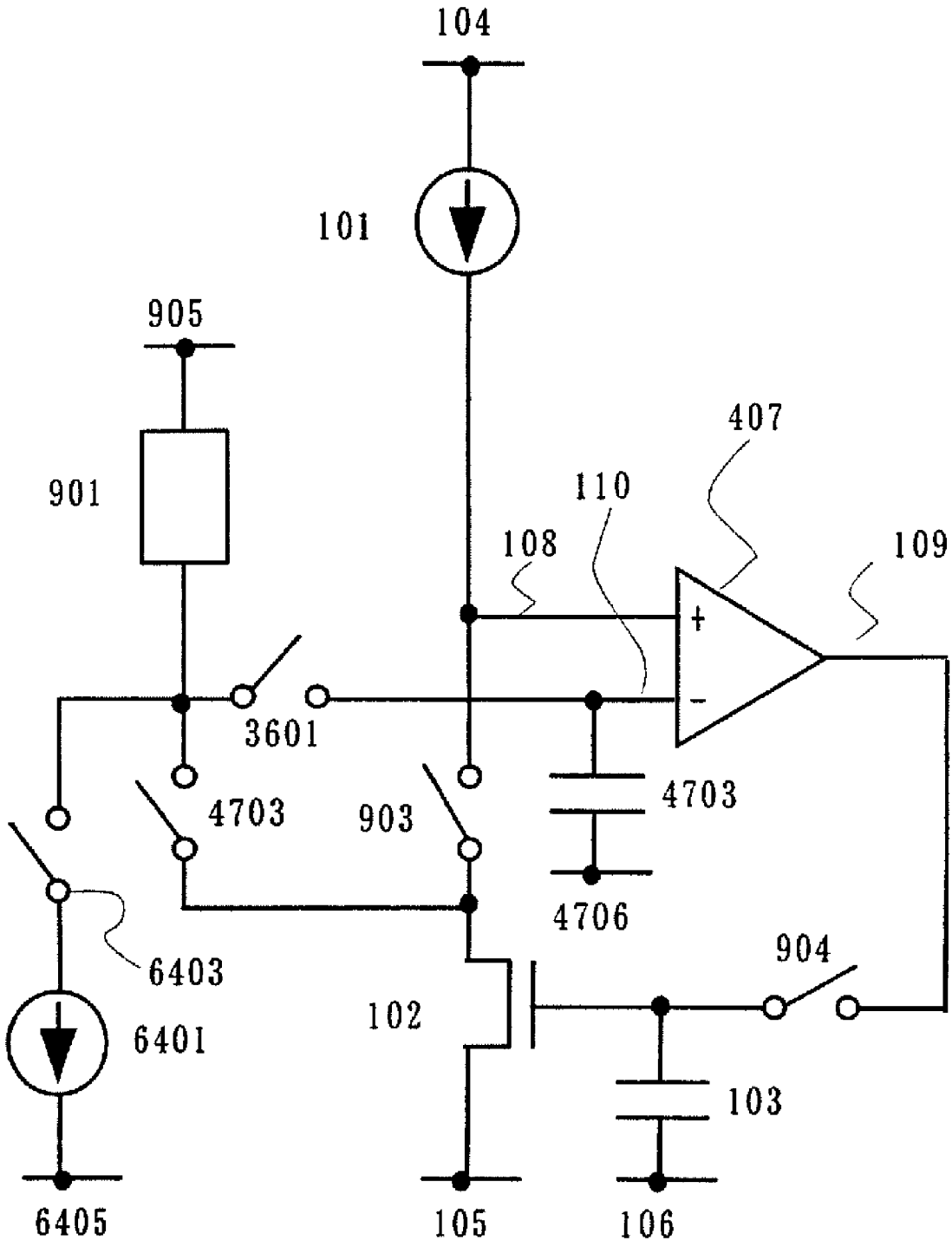
FIG. 64 is a diagram showing a configuration of a semiconductor device of the invention.
Figure 65:
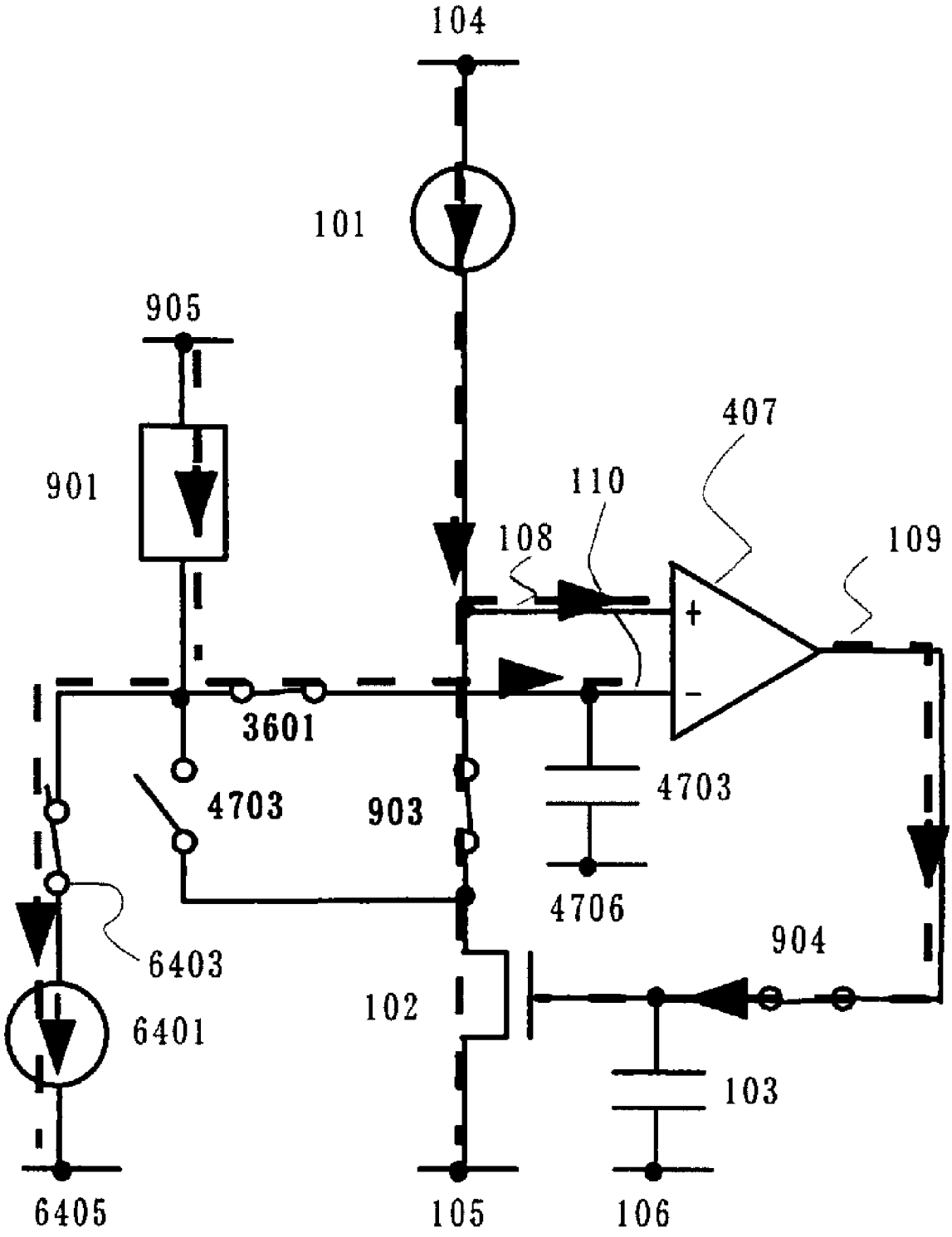
FIG. 65 is a diagram showing an operation of a semiconductor device of the invention.
Figure 66:
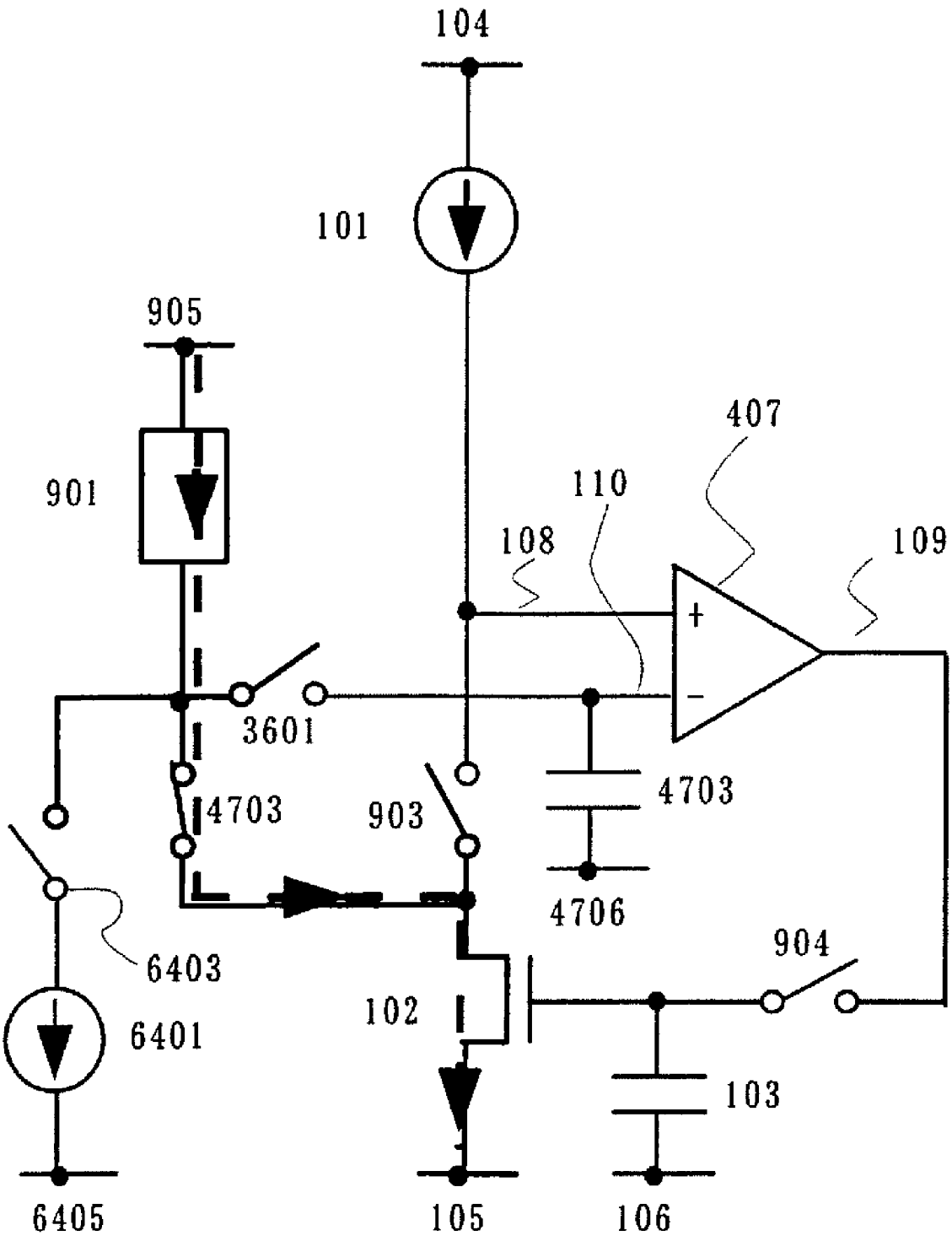
FIG. 66 is a diagram showing an operation of a semiconductor device of the invention.

Next, FIG. 64 shows a configuration example in the case of using another current source circuit 6401. First, switches 6403, 3601, 903, and 904 are turned ON as shown in FIG. 65 to perform the set operation. In the configuration of FIG. 64, the same transistor 102 is used in the set operation and the output operation, therefore, it is preferable that the size of a current of the current source circuit 6401 and the size of the current of the current source circuit 101 be equal to each other. In this manner, a potential when a current is supplied to the load 901 is inputted to the second input terminal 110 of the amplifier circuit 107. As a result, the drain potential of the current source transistor 102 in the set operation can become approximately equal to the drain potential in the output operation. Then, the output operation is performed by turning ON the switch 4703 as shown in FIG. 66. According to the aforementioned operation, Vgs and Vds of the transistor 102 become approximately equal in the output operation and the set operation.

The amplifier circuit 4007 may be provided between the second input terminal 110 of the amplifier circuit 107 and the terminal 3310 (the drain terminal of the transistor 1602) in FIGS. 41 to 43, 44, 47, 64 and the like as well as FIG. 40.

Heretofore, a potential is generated by using a load, a transistor and the like and supplied to any one of input terminals of an amplifier circuit such as an operational amplifier. Next, a configuration example in the case of connecting a certain terminal in a circuit and any one of input terminals of an amplifier circuit such as an operational amplifier is shown.

Figure 52:
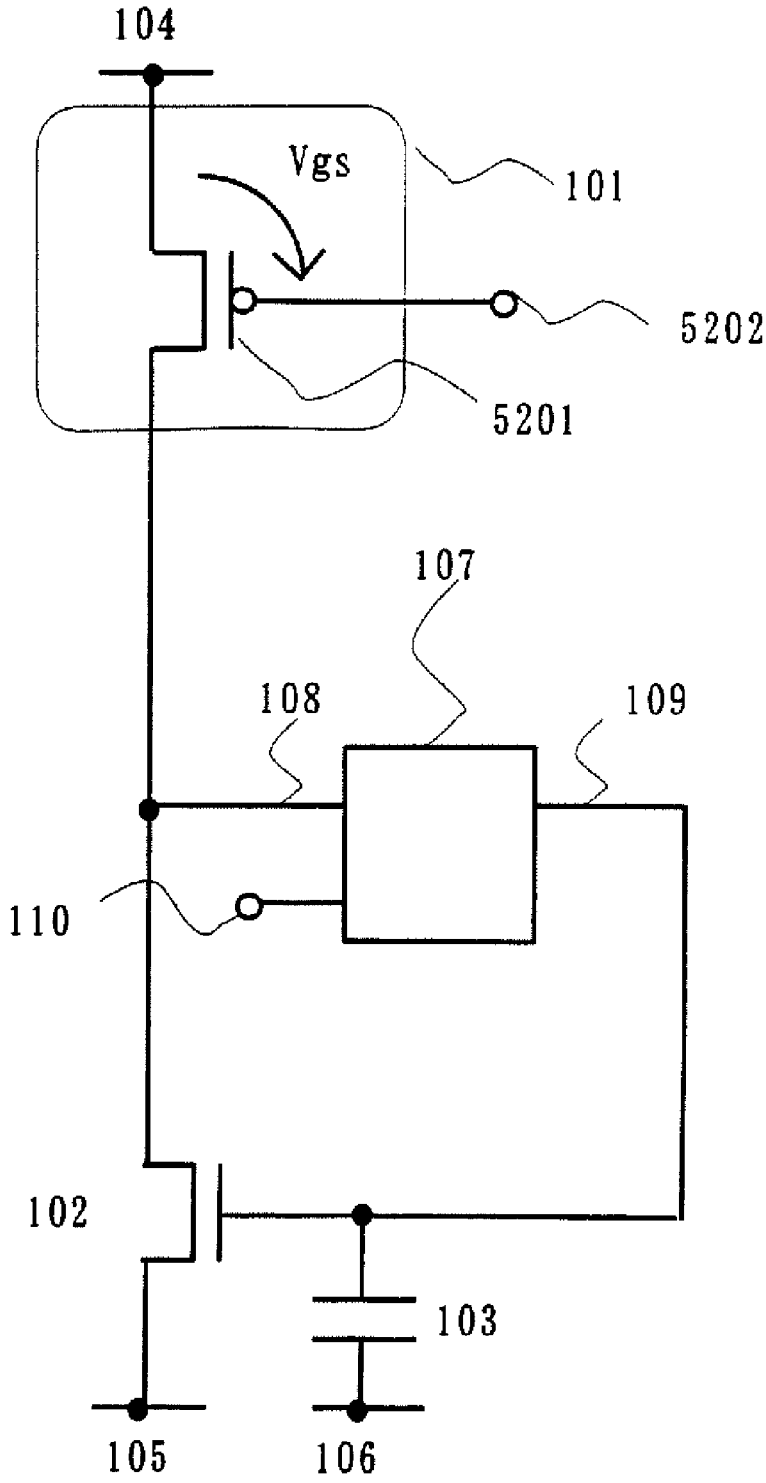
FIG. 52 is a diagram showing a configuration of a semiconductor device of the invention.

First, FIG. 52 shows a configuration diagram in the case where the current source circuit 101 in FIG. 1 is realized by using a transistor. A gate terminal 5202 has a predetermined level of potential by using a transistor 5201. Then, the current source circuit can operate by operating in a saturation region.

Figure 53:
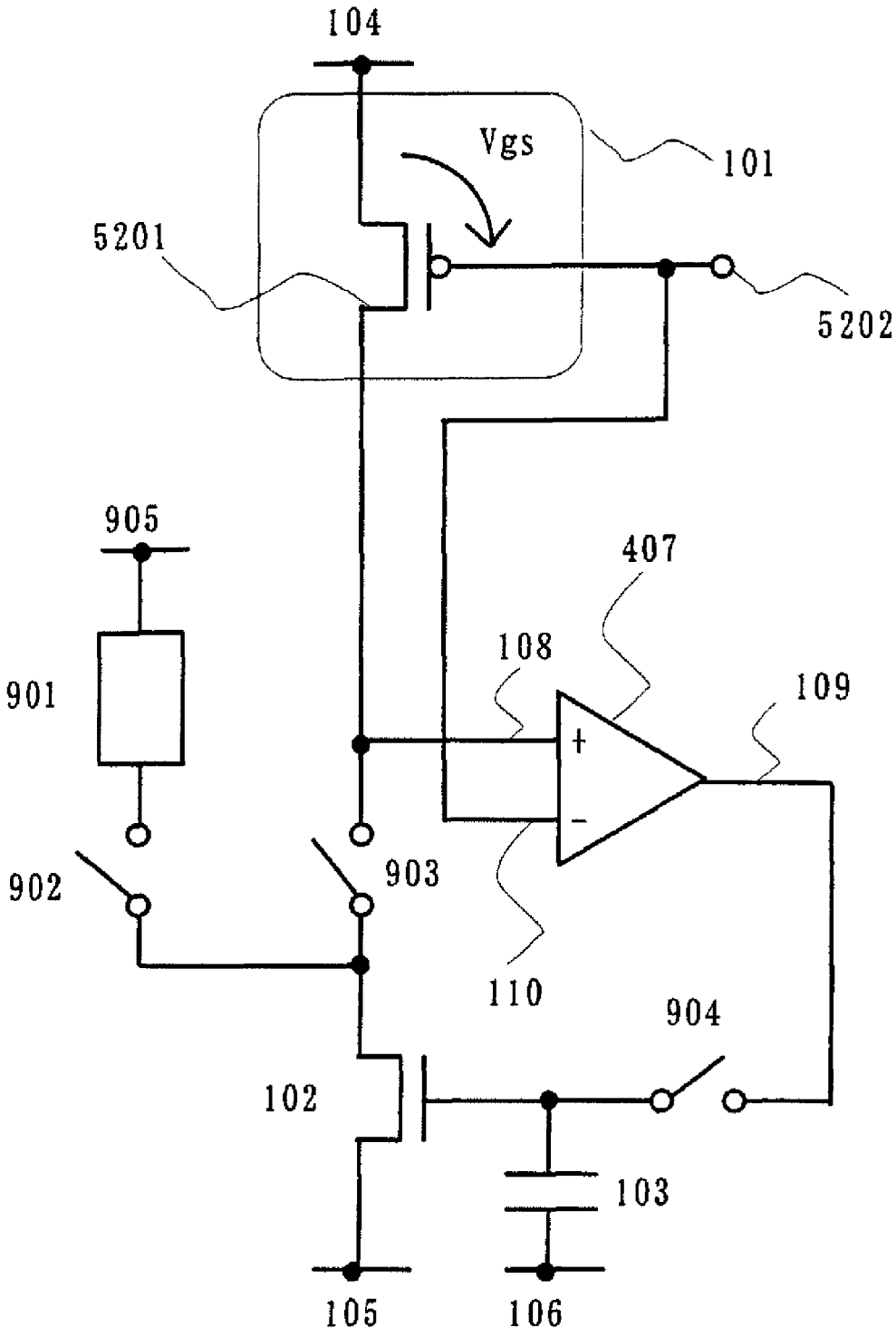
FIG. 53 is a diagram showing a configuration of a semiconductor device of the invention.

FIG. 53 shows a configuration diagram in the case of connecting the gate terminal of the transistor 5201 which forms the current source circuit 101 and any one of the input terminals of an amplifier circuit such as an operational amplifier.

In this case, the case where a current value outputted from the current source circuit 101 is small corresponds to the case where an absolute value of a gate-source voltage of the transistor 5201 is small. Therefore, it corresponds to the case where the gate potential of the transistor 5201 becomes high. In that case, Vds of the transistor 102 becomes high in the case of performing the set operation to the transistor 102. Therefore, Vds of the transistor 102 approaches that in the output operation in which a current is supplied to the load 901. Therefore, the kink (Early) effect can be reduced and it can be prevented that a current flows to the load 905 too much.

Figure 54:
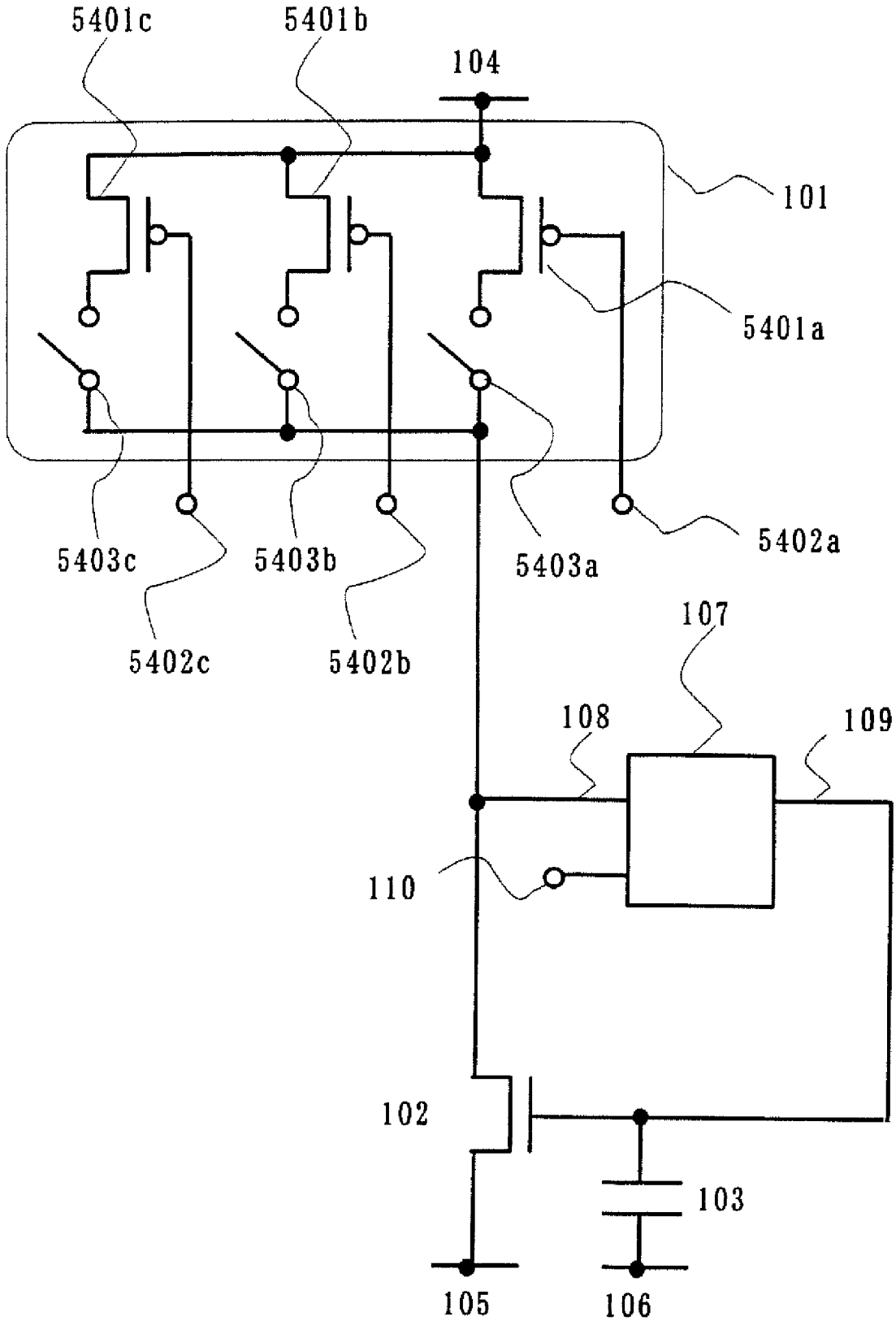
FIG. 54 is a diagram showing a configuration of a semiconductor device of the invention.

Note that a current value is changed by changing a gate potential of the transistor 5201 in FIG. 53 as the current source circuit 101 in some cases, however, there also is a current source circuit 101 having a plurality of transistors 5401*a*, 5401*b* 5401*c* and the like which operate as current sources as shown in FIG. 54, each of which current controls outputs by switches 5403*a*, 5403*b*, 5403*c*, and the like, namely the current source circuit 101 having a DA converting function. In that case, at least one of gate terminals of the transistors 5401*a*, 5401*b*, and 5401*c* and any one of input terminals of an amplifier circuit such as an operational amplifier may be connected. Note that transistors which operate as a current source and switches which operate as a current source are provided three each, however, the invention is not limited to this and they may be provided arbitrary number.

Note that this embodiment mode describes the case of applying the invention to FIG. 1, FIG. 9, FIG. 16 and the like, however, the invention is not limited to this. Similarly, the case where a current flows from the current source circuit 101 to the current source transistor 102 which is an N-channel type is shown, however, the invention is not limited to this. A direction of current flow and polarity of each transistor can be changed as well.

In this embodiment mode, the description is made by using the configuration of FIG. 1, the configuration using an operational amplifier as an amplifier circuit (FIG. 4) for simplicity, however, the invention is not limited to this. The invention can be applied to a different configuration such as the one described in FIGS. 2 to 8.

Note that the content described in this embodiment mode corresponds to the one utilizing the configurations described in Embodiment modes 1 to 6, however, the invention is not limited to this and various changes can be made as long as the gist thereof is not changed.

Further, the configuration described in this embodiment mode can be implemented in combination with Embodiment Modes 1 to 6.

Embodiment Mode 8

In this embodiment mode, configurations and operations of a display device, a signal line driver circuit and the like are described. A circuit of the invention can be applied to a part of the signal line driver circuit and a pixel.

Figure 55:
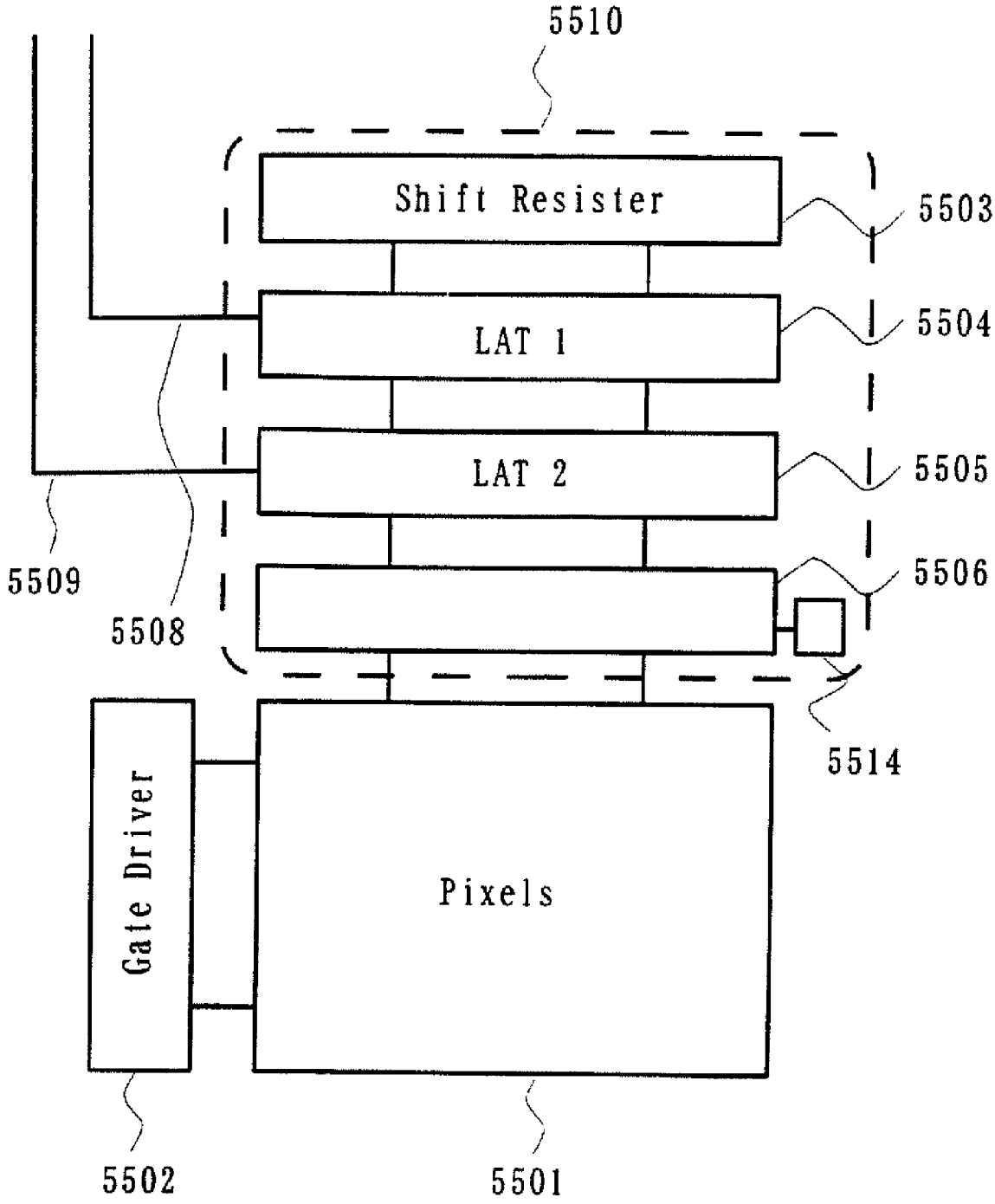
FIG. 55 is a diagram showing a structure of a display device of the invention.

A display device comprises a pixel arrangement 5501, a gate line driver circuit 5502, and a signal line driver circuit 5510 as shown in FIG. 55. The gate line driver circuit 5502 sequentially outputs a selection signal to the pixel arrangement 5501. The signal line driver circuit 5510 outputs a video signal sequentially to the pixel arrangement 5501. The pixel arrangement 5501 displays an image by controlling the state of light in accordance with the video signal. A video signal inputted from the signal line driver circuit 5510 to the pixel arrangement 5501 is often a current. That is, a display element and an element for controlling the display element disposed in each pixel change their states in accordance with the video signal (current) inputted from the signal line driver circuit 5510. An EL element, an element used in an FED (Field Emission Display) and the like are examples of the display element disposed in a pixel.

Note that a plurality of the gate line driver circuits 5502 and the signal line driver circuits 5510 may be provided.

The signal line driver circuit 5510 can be divided into a plurality of portions in its configuration. For example, it can be divided into a shift register 5503, a first latch circuit (LAT 1) 5504, a second latch circuit (LAT 2) 5505, and a digital-analog converter circuit 5506. The digital-analog converter circuit 5506 has a function to convert a voltage into a current, and may have a function to provide a gamma correction as well. That is, the digital-analog converter circuit 5506 has a circuit to output a current (video signal) to a pixel, namely a current source circuit to which the invention can be applied.

As shown in FIG. 29, a digital voltage signal for a video signal and a current for controlling a current source circuit in a pixel are inputted to the pixel in some cases depending on a configuration of the pixel. In that case, the digital-analog converter circuit 5506 does not have a digital-analog converting function, but has a function to convert a voltage into a current and a circuit to output the current to the pixel as a current for control, namely a current source circuit to which the invention can be applied.

Further, the pixel has a display element such as an EL element. The pixel has a circuit to output a current (video signal) to the display element, namely a current source circuit to which the invention can also be applied.

Now, an operation of the signal line driver circuit 5510 is described briefly. The shift register 5503 is formed by using a plurality of columns of flip-flop circuits (FFs) and the like and inputted with a clock signal (S-CLK), a start pulse (SP), and an inverted clock signal (S-CLKb). Sampling pulses are outputted sequentially in accordance with these signals.

The sampling pulse outputted from the shift register 5503 is inputted to the first latch circuit (LAT 1) 5504. The first latch circuit (LAT 1) 5504 is inputted with a video signal from a video signal line 5508 and holds a video signal in each column in accordance with a timing at which the sampling pulse is inputted. Note that a video signal has a digital value in the case where the digital-analog converter circuit 5506 is disposed. Further, a video signal in this stage is often a voltage.

In the case where the first latch circuit 5504 and the second latch circuit 5505 can store analog values, however, the digital-analog converter circuit 5506 can be omitted in many cases. In that case, a video signal is a current in many cases. Moreover, in the case where data outputted to the pixel arrangement 5501 have a binary value, namely a digital value, the digital-analog converter circuit 5506 can be omitted in many cases.

When video signals are held up to the last column in the first latch circuit (LAT 1) 5504, a latch pulse is inputted from a latch control line 5509 in a horizontal retrace period and the video signals held in the first latch circuit (LAT 1) 5504 are transferred to the second latch circuit (LAT 2) 5505 all at once. After that, the video signals held in the second latch circuit (LAT 2) 5505 are inputted to the digital-analog converter circuit 5506 one column at a time. Then, the signal outputted from the digital-analog converter circuit 5506 is inputted to the pixel arrangement 5501.

While the video signal held in the second latch circuit (LAT 2) 5505 is inputted to the digital-analog converter circuit 5506 and to the pixel 5501, a sampling pulse is outputted again from the shift register 5503. That is, two operations are performed at the same time. Thus, a line sequential drive can be performed. Subsequently, this operation is repeated.

In the case where the current source circuit of the digital-analog converter circuit 5506 is a circuit which performs the set operation and the output operation, that is a circuit which is inputted with a current from a different current source circuit and can output a current which is not affected by a variation in characteristics of a transistor, a circuit which flows a current to the current source circuit is required. In that case, a reference current source circuit 5514 is disposed.

Note that in the case where the set operation is performed to the current source circuit, a timing thereof is required to be controlled. In that case, a dedicated driver circuit (such as a shift register) may be disposed for controlling the set operation. Alternatively, the set operation to the current source circuit may be controlled by using a signal outputted from the shift register for controlling the LAT 1 circuit. That is, both of the LAT 1 circuit and the current source circuit may be controlled by one shift register. In that case, a signal outputted from the shift register for controlling the LAT 1 circuit may be inputted to the current source circuit directly. Alternatively, in order to separate a control of the LAT 1 circuit and a control of the current source circuit, the current source circuit may be controlled through a circuit for controlling the separation. Alternatively, the set operation to the current source circuit may be controlled by using a signal outputted from the LAT 2 circuit. The signal outputted from the LAT 2 circuit is normally a video signal. Therefore, in order to separate the case of using it as a video signal and the case of controlling the current source circuit, the current source circuit may be controlled through a circuit which controls the separation. In this manner, a circuit configuration for controlling the set operation and the output operation, an operation of the circuit and the like are described in International Publication WO03/038793, International Publication WO03/038794, and International Publication WO03/038795 of which contents can be applied to the invention.

Note that the signal line driver circuit and a part of it (a current source circuit, an amplifier circuit and the like) do not exist on the same substrate as the pixel arrangement 5501 and are formed by using, for example, an external IC chip in some cases.

Note that a transistor used in the invention may be any type of transistor or may be formed on any substrate. Therefore, the circuits shown in FIGS. 1, 79, 82 and the like may be all formed on a glass substrate, a plastic substrate, a single crystalline substrate, an SOI substrate, or any substrate. Alternatively, a part of the circuits in FIGS. 55, 56 and the like may be formed on a certain substrate and another part of the circuits in FIGS. 55, 56 and the like may be formed on a different substrate. That is, not all the circuits in FIGS. 55, 56 and the like has to be formed on the same substrate. For example, it is possible that a pixel and a gate line driver circuit are formed by using TFTs on a glass substrate, a signal line driver circuit (or a part of it) is formed on a single crystalline substrate, and an IC chip thereof may be mounted on the glass substrate by COG (Chip On Glass). Alternatively, the IC chip may be connected to the glass substrate by using TAB (Tape Auto Bonding) and a printed substrate.

Note that a configuration of a signal line driver circuit and the like are not limited to FIG. 55.

Figure 56:
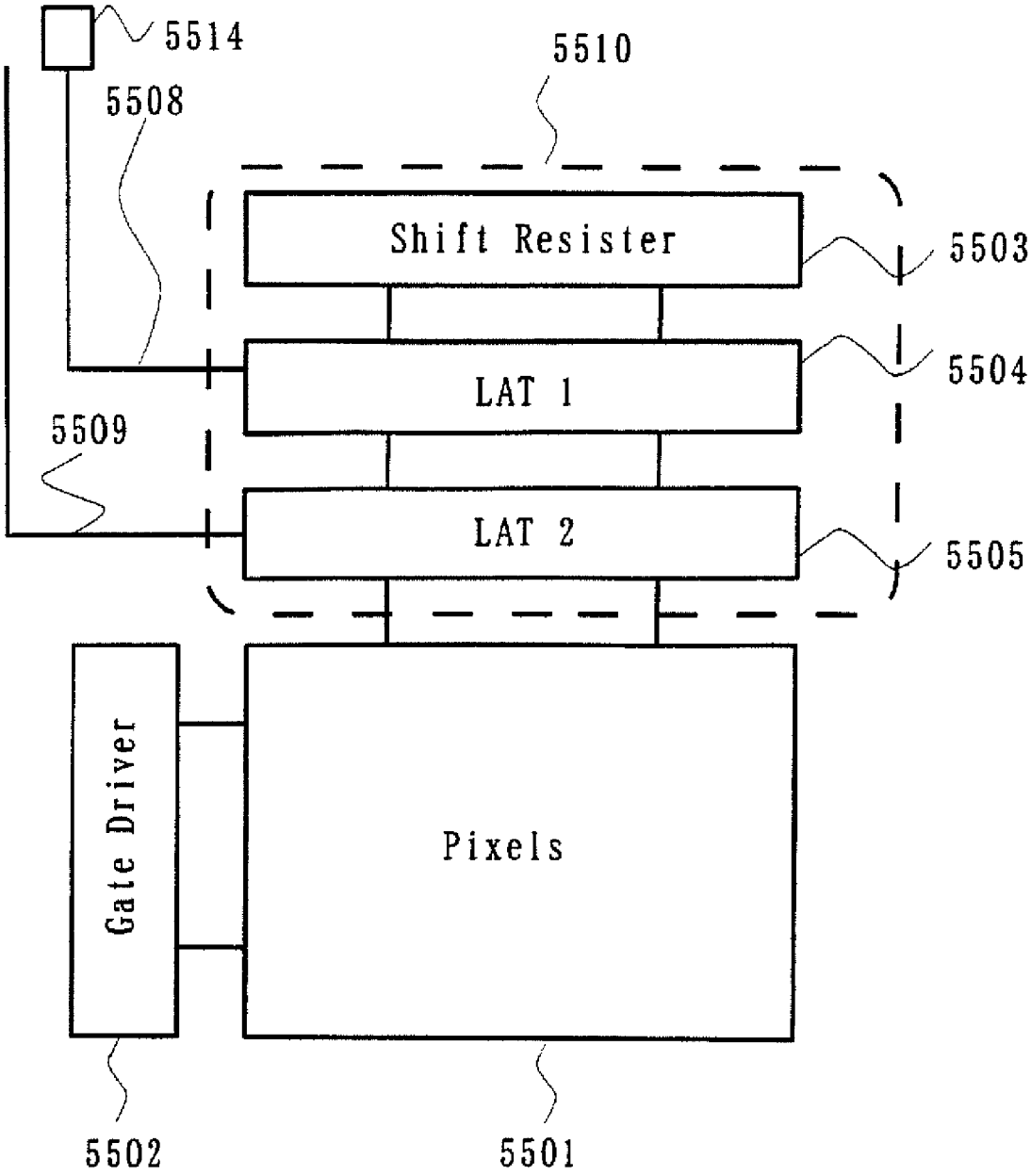
FIG. 56 is a diagram showing a structure of a display device of the invention.

For example, in the case where the first latch circuit 5504 and the second latch circuit 5505 can store analog values, a video signal (analog current) may be inputted from the reference current source circuit 5514 to the first latch circuit (LAT 1) 5504 as shown in FIG. 56. Further, the second latch circuit 5505 may not exist in FIG. 56 in some cases. In that case, more current source circuits are often disposed in the first latch circuit 5504.

In such a case, the invention can be applied to a current source circuit in the digital-analog converter circuit 5506 in FIG. 55. There are a lot of unit circuits in the digital-analog converter circuit 5506, and the current source circuit 101 and the amplifier circuit 107 are disposed in the reference current source circuit 5514.

Alternatively, the invention can be applied to a current source circuit in the first latch circuit (LAT 1) 5504, in FIG. 56. There are a lot of unit circuits in the first latch circuit (LAT 1) 5504 and the basic current source 101 and an additional current source 103 are disposed in the reference current source circuit 5514.

Alternatively, the invention can be applied to a pixel (a current source circuit therein) in the pixel arrangement 5501 in FIGS. 55 and 56. There are a lot of unit circuits in the pixel arrangement 5501, and the current source circuit 101 and the amplifier circuit 107 are disposed in the signal line driver circuit 5510.

Figure 57:
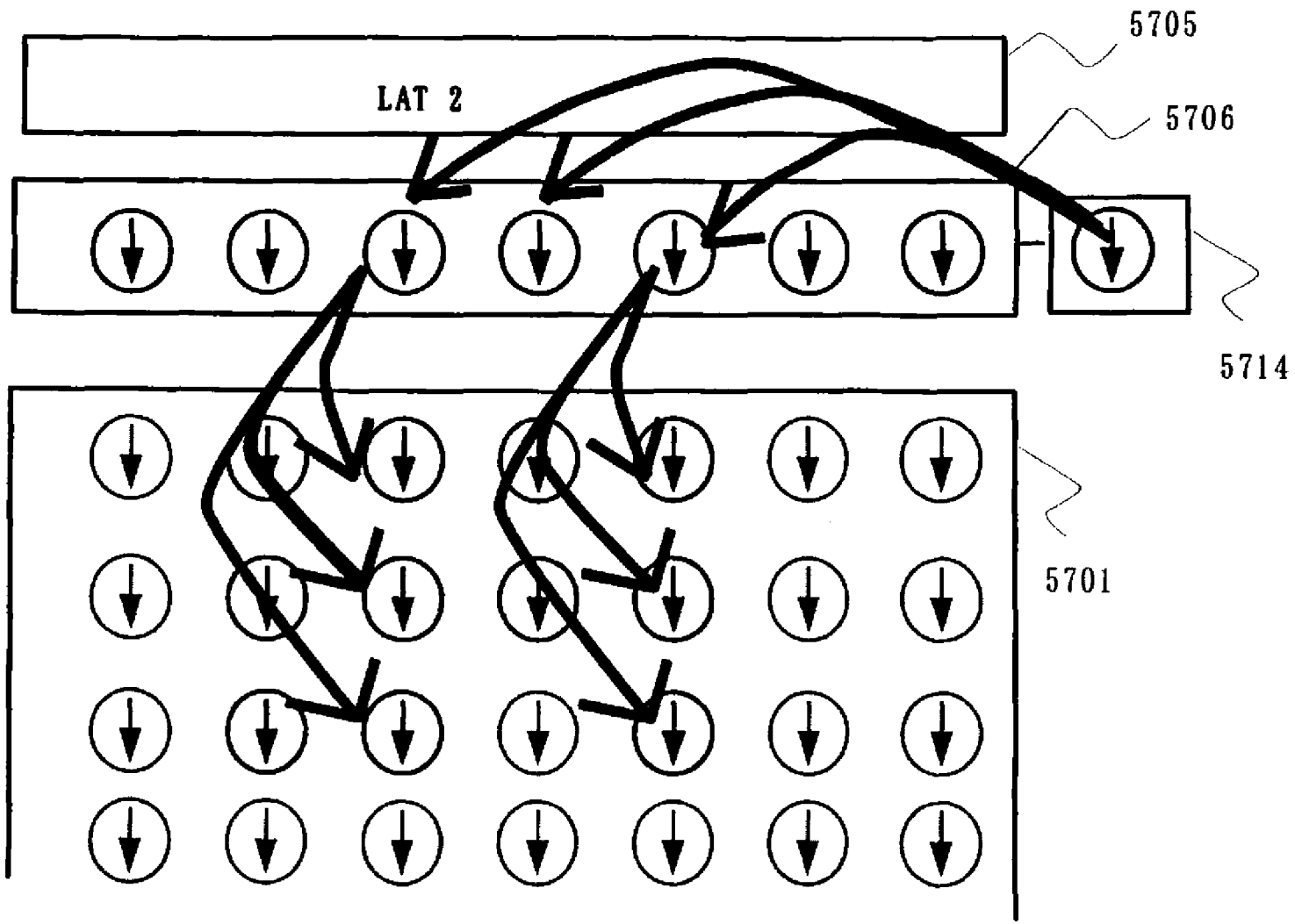
FIG. 57 is a diagram showing an operation of a display device of the invention.
Figure 58:
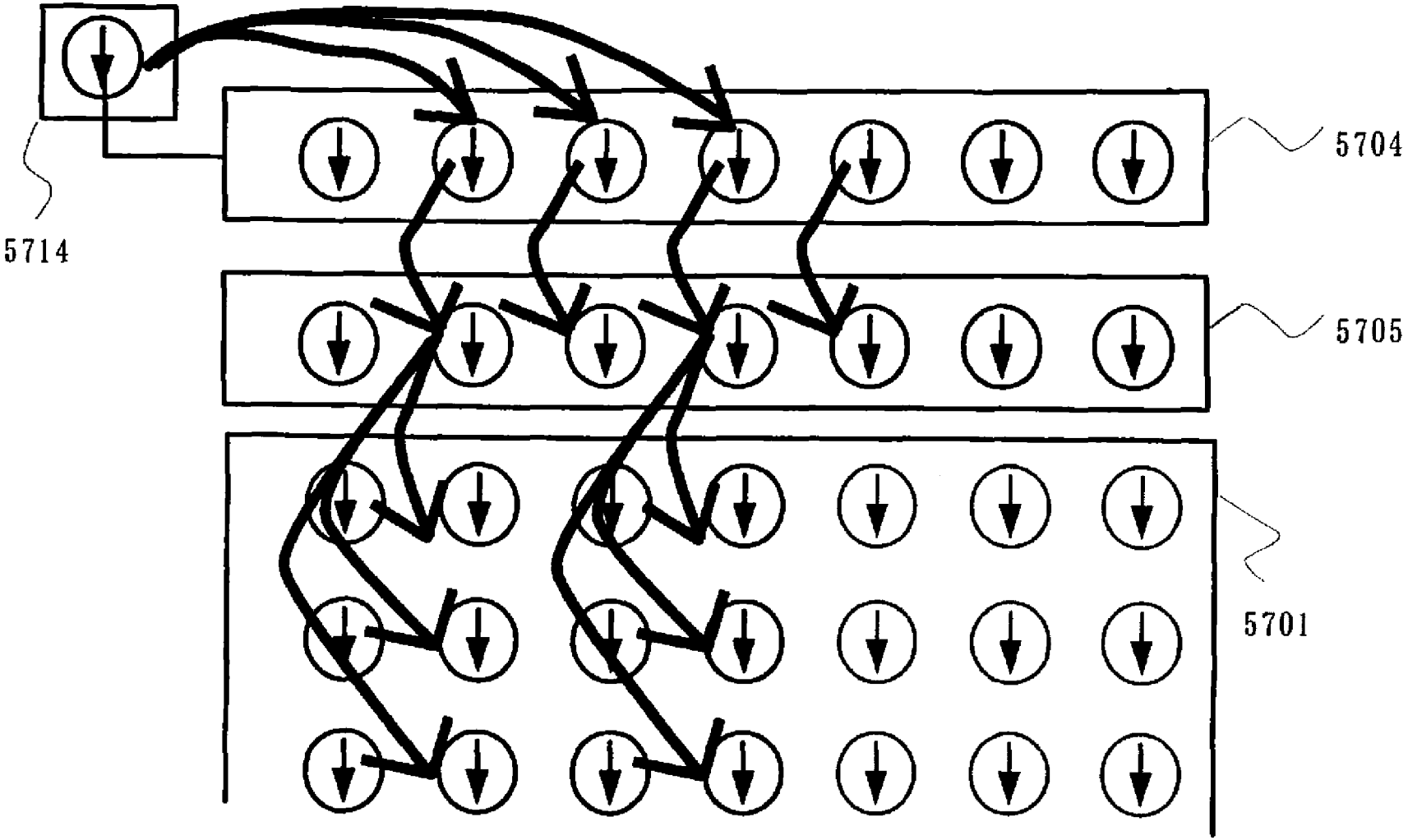
FIG. 58 is a diagram showing an operation of a display device of the invention.
Figure 59:
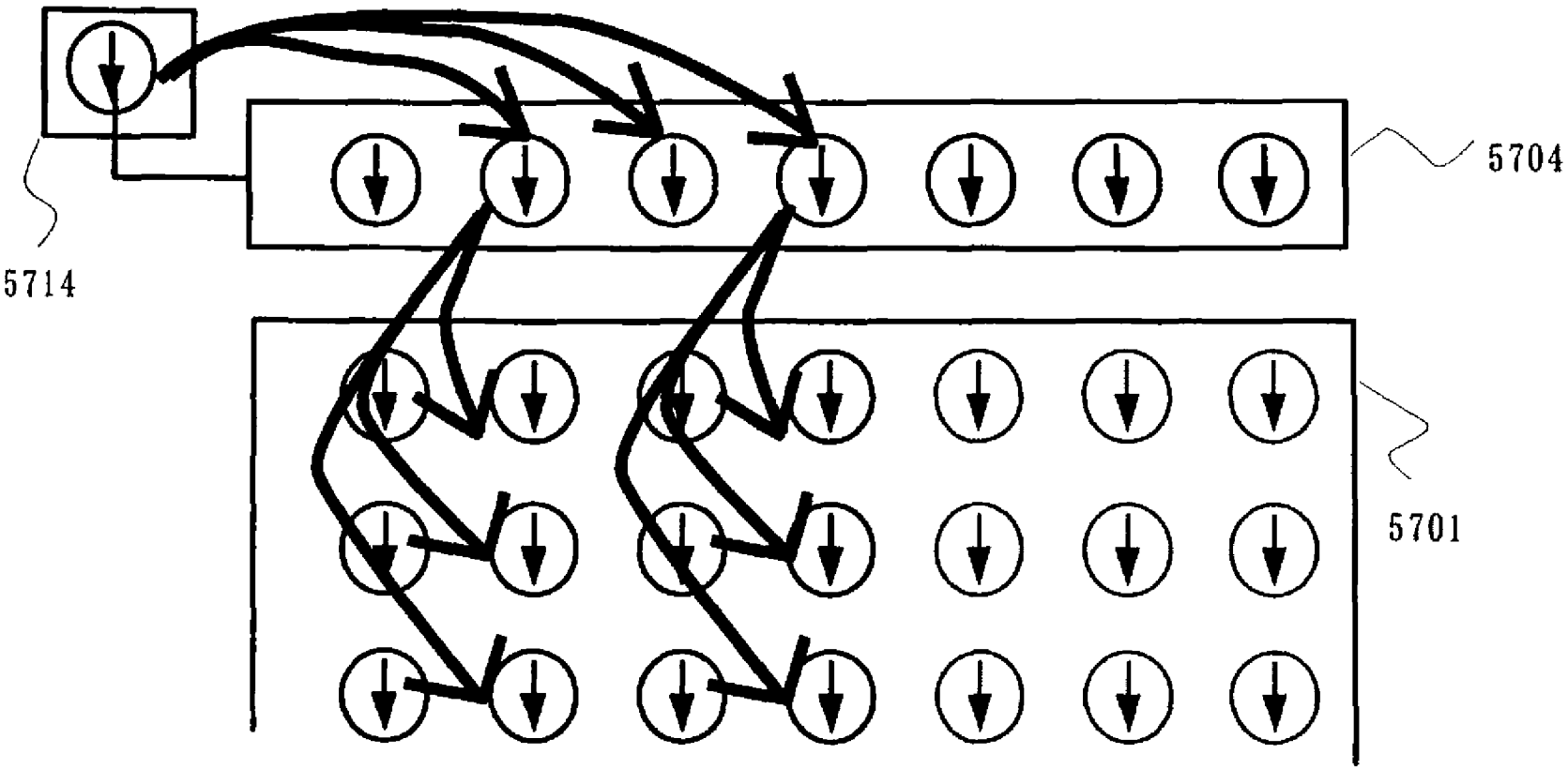
FIG. 59 is a diagram showing an operation of a display device of the invention.

That is, a circuit which supplies a current exists in various portions of a circuit. Such a current source circuit is required to output an accurate current. Therefore, such a current source circuit is set by using a different current source circuit so that a transistor can output an accurate current. The different current source circuit is required to output an accurate current as well. Therefore, as shown in FIGS. 57 to 59, there is a current source circuit as a reference from which current source transistors are set sequentially. Accordingly, the current source circuit can output an accurate current. Therefore, the invention can be applied to such a portion.

The configuration described in this embodiment mode can be implemented in combination with Embodiment Modes 1 to 7.

Embodiment Mode 9

Figure 60:
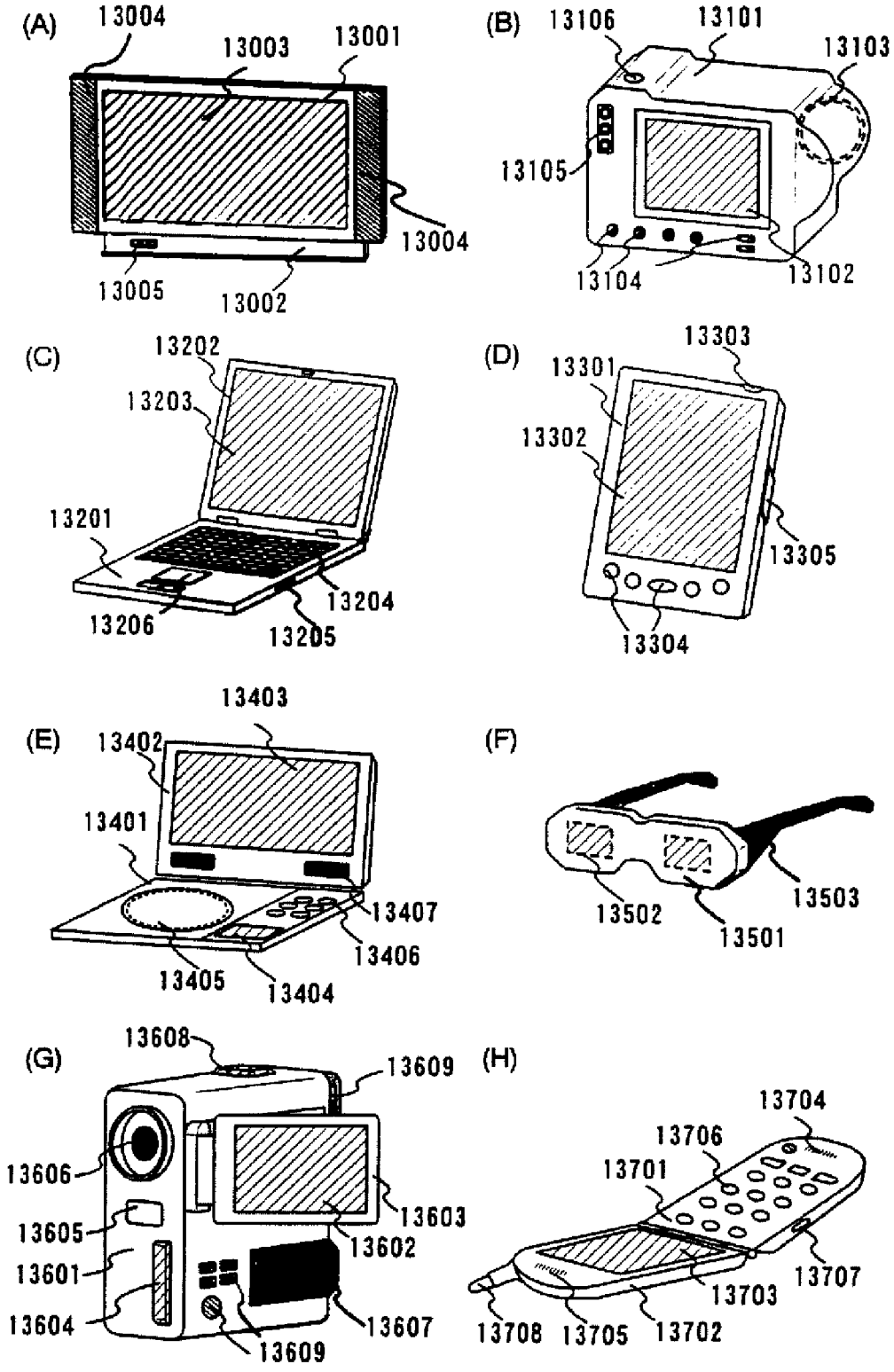
FIG. 60 shows views of electronic apparatuses to which the invention is applied.
Figure 61:
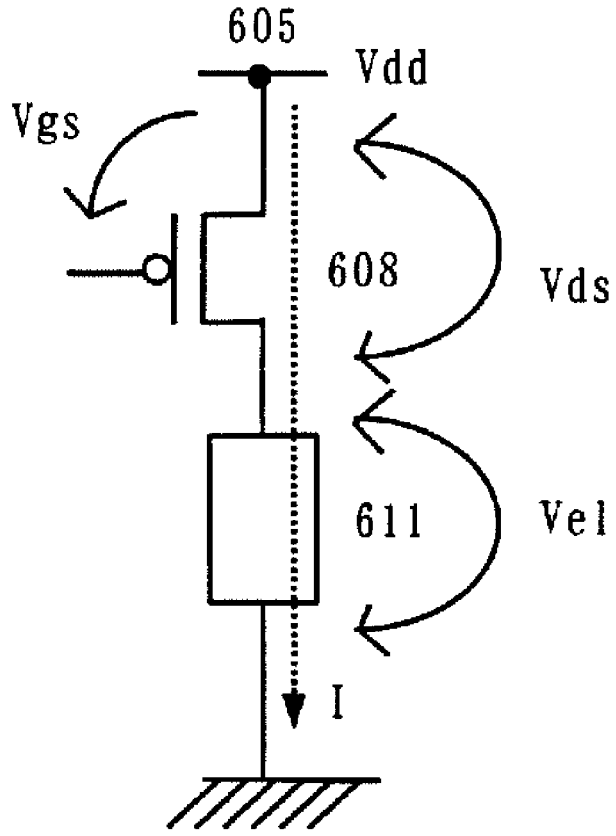
FIG. 61 is a diagram showing a configuration of a conventional pixel.
Figure 62:
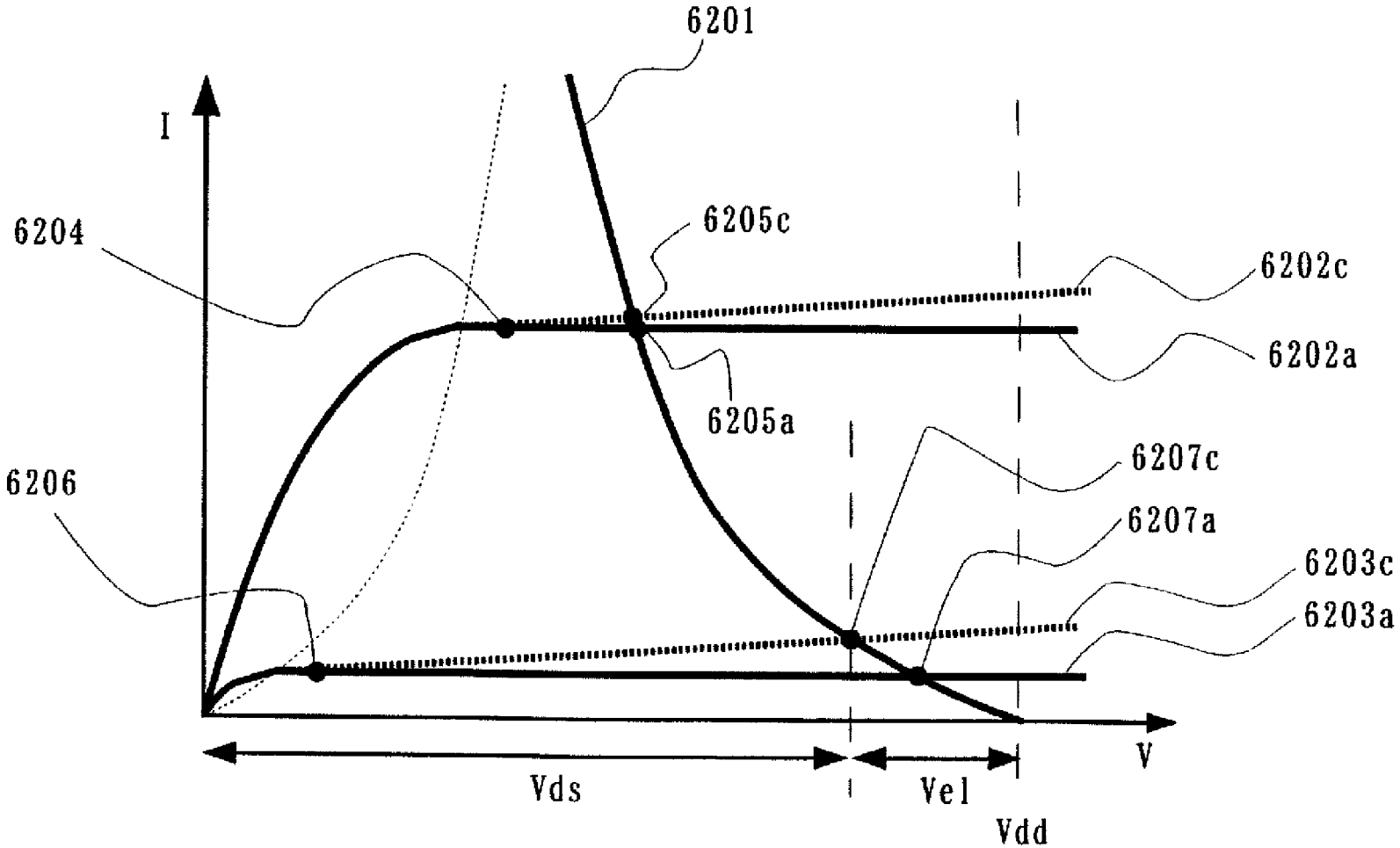
FIG. 62 is a diagram showing operating points of a conventional circuit.
Figure 63:
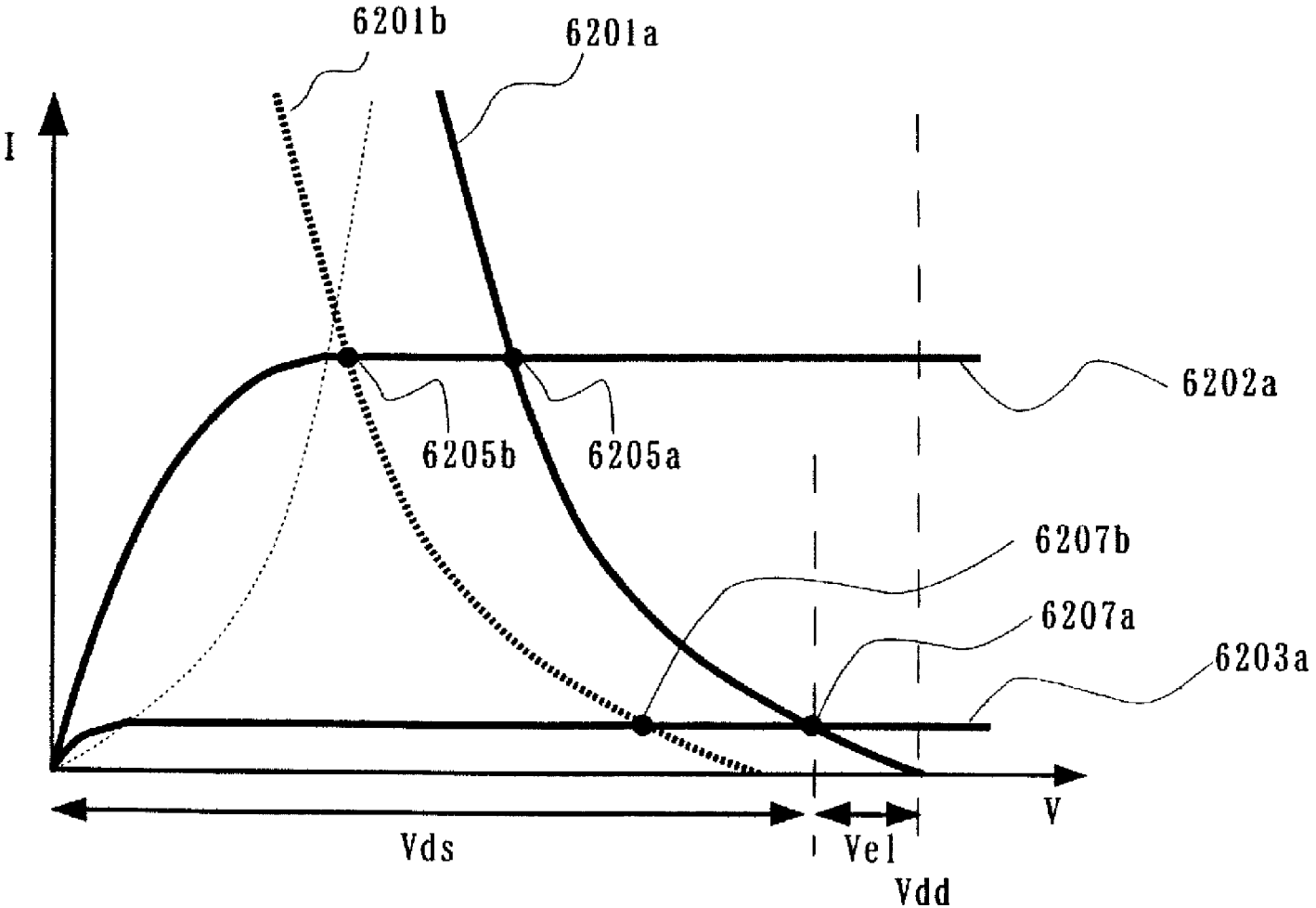
FIG. 63 is a diagram showing operating points of a conventional circuit.

The invention can be used in a circuit which forms a display portion of an electronic apparatus. Such an electronic apparatus includes a video camera, a digital camera, a goggle type display (head mounted display) a navigation system, an audio reproducing apparatus (a car audio set, an audio component system and the like), a computer, a game machine, a portable information terminal (a mobile computer, a portable phone, a portable type game machine, an electronic book or the like), an image reproducing apparatus provided with a recording medium (specifically an apparatus which reproduces a recording medium such as a Digital Versatile Disc (DVD) and provided with a display which is capable of displaying its image) and the like. Specific examples of these electronic apparatuses are shown in FIG. 60. That is, the invention can be applied to a pixel which forms a display portion of them, a signal line driver circuit which drives a pixel and the like.

FIG. 60A illustrates a light emitting device (here, the light emitting device means a display device using a self-light emitting element in a display portion) including a housing 13001, a support base 13002, a display portion 13003, speaker portions 13004, a video input terminal 13005 and the like. The invention can be applied to a pixel which forms the display portion 13003, a signal line driver circuit and the like. According to the invention, the light emitting device shown in FIG. 60A is completed. The light emitting device is self-light emitting type, therefore, a backlight is not required and a thinner display portion than a liquid crystal display can be formed. Note that the light emitting device refers to all light emitting devices for displaying information, including ones for personal computers, for TV broadcasting reception, and for advertisement.

FIG. 60B illustrates a digital still camera including a main body 13101, a display portion 13102, an image receiving portion 13103, operating keys 13104, an external connecting port 13105, a shutter 13106 and the like. The invention can be used in a pixel which forms the display portion 13102, a signal line driver circuit and the like. According to the invention, a digital still camera shown in FIG. 60B can be completed.

FIG. 60C illustrates a computer including a main body 13201, a housing 13202, a display portion 13203, a keyboard 13204, an external connecting port 13205, a pointing mouse 13206 and the like. The invention can be used in a pixel which forms the display portion 13203, a signal line driver circuit and the like. According to the invention, the light emitting device shown in FIG. 60C can be completed.

FIG. 60D illustrates a mobile computer including a main body 13301, a display portion 13302, a switch 13303, operating keys 13304, an infrared port 13305 and the like. The invention can be used in a pixel which forms the display portion 13302, a signal line driver circuit and the like. According to the invention, the mobile computer shown in FIG. 60D is completed.

FIG. 60E illustrates a portable type image reproducing apparatus provided with a recording medium (specifically a DVD reproducing device) including a main body 13401, a housing 13402, a display portion A13403, a display portion B13404, a recording medium (such as a DVD) reading portion 13405, an operating key 13406, a speaker portion 13407 and the like. The display portion A13403 mainly displays image data while the display portion B13404 mainly displays text data. The invention can be used in pixels which form the display portions A13403 and B13404, a signal line driver circuit and the like. Note that the image reproducing apparatus provided with a recording medium includes a home game machine and the like. According to the invention, the DVD reproducing apparatus shown in FIG. 60E is completed.

FIG. 60F illustrates a goggle type display (head mounted display) including a main body 13501, a display portion 13502, and an arm portion 13503. The invention can be used in a pixel which forms the display portion 13502, a signal line driver circuit and the like. According to the invention, the goggle type display shown in FIG. 60F is completed.

FIG. 60G illustrates a video camera including a main body 13601, a display portion 13602, a housing 13603, an external connecting port 13604, a remote control receiving portion 13605, an image receiving portion 13606, a battery 13607, an audio input portion 13608, operating keys 13609 and the like. The invention can be used in a pixel which forms the display portion 13602, a signal line driver circuit and the like. According to the invention, the video camera shown in FIG. 60G is completed.

FIG. 60H illustrates a portable phone including a main body 13701, a housing 13702, a display portion 13703, an audio input portion 13704, an audio output portion 13705, an operating key 13706, an external connecting port 13707, an antenna 13708 and the like. The invention can be used in a pixel which forms the display portion 13703, a signal line driver circuit and the like. Note that current consumption of the portable phone can be suppressed by displaying white text on a black background in the display portion 13703. According to the invention, the portable phone shown in FIG. 60H is completed.

Provided that a light emission luminance of a light emitting material becomes higher in the future, the light including outputted image data can be expanded and projected by using a lens and the like to be used for a front or rear type projector.

Furthermore, the aforementioned electronic apparatuses are becoming to be more used for displaying information distributed through a telecommunication path such as Internet, a CATV (cable television system), and in particular for displaying moving picture information. The display device is suitable for displaying moving pictures since the light emitting material can exhibit high response speed.

It is preferable to display data with as small a light emitting portion as possible because the light emitting device consumes power in the light emitting portion. Therefore, in the case of using the light emitting device in the display portions of the portable information terminal, in particular a portable phone or an audio reproducing device which mainly displays text data, it is preferable to drive so that the text data is formed by a light emitting portion with a non-light emitting portion as a background.

As described above, an application range of the invention is quite wide and the invention can be used in electronic apparatuses of various fields. Further, the electronic apparatuses of this embodiment mode may use a semiconductor device having any configurations described in Embodiment Modes 1 to 4.

The invention claimed is:

1. A semiconductor device comprising:

a first transistor having a first terminal and a second terminal;

a second transistor having a first terminal and a second terminal;

a third transistor having a gate, a first terminal and a second terminal;

an amplifier circuit having a first input terminal, a second input terminal and an output terminal; and a current source circuit, wherein the first terminal of the first transistor is electrically connected to the first input terminal of the amplifier circuit and the current source circuit, wherein the second terminal of the first transistor is electrically connected to the first terminal of the third transistor, wherein the first terminal of the second transistor is electrically connected to the output terminal of the amplifier circuit, and wherein the second terminal of the second transistor is electrically connected to the gate of the third transistor.

2. The semiconductor device according to claim 1, wherein the second input terminal of the amplifier circuit is connected to a wiring.

3. The semiconductor device according to claim 1, wherein the second terminal of the third transistor is connected to a wiring.

4. The semiconductor device according to claim 1, wherein the semiconductor device further comprises a capacitor having a first terminal and a second terminal, wherein the first terminal of the capacitor is electrically connected to the second terminal of the second transistor and the gate of the third transistor, and wherein the second terminal of the capacitor is connected to a wiring.

5. A semiconductor device comprising:

a first transistor having a first terminal and a second terminal;

a second transistor having a first terminal and a second terminal;

a third transistor having a gate, a first terminal and a second terminal;

a fourth transistor having a first terminal and a second terminal;

an amplifier circuit having a first input terminal, a second input terminal and an output terminal; and a current source circuit, wherein the first terminal of the first transistor is electrically connected to the first input terminal of the amplifier circuit and the current source circuit, wherein the second terminal of the first transistor is electrically connected to the first terminal of the third transistor and a first terminal of the fourth transistor, wherein the first terminal of the second transistor is electrically connected to the output terminal of the amplifier circuit, and wherein the second terminal of the second transistor is electrically connected to the gate of the third transistor.

6. The semiconductor device according to claim 5, wherein the second input terminal of the amplifier circuit is connected to a wiring.

7. The semiconductor device according to claim 5, wherein the second terminal of the third transistor is connected to a wiring.

8. The semiconductor device according to claim 5, wherein the semiconductor device further comprises a capacitor having a first terminal and a second terminal, wherein the first terminal of the capacitor is electrically connected to the second terminal of the second transistor and the gate of the third transistor, and wherein the second terminal of the capacitor is connected to a wiring.

9. The semiconductor device according to claim 5, wherein the second terminal of the fourth transistor is electrically connected to a load.

10. The semiconductor device according to claim 9, wherein the load is one of a resistor, a transistor, an EL element, a current source circuit configured with a transistor, a capacitor, or a switch, a wiring connected to a circuit, a signal line, and a signal line and a pixel connected to the signal line.

* * * * *